US009481180B2

(12) United States Patent
Kimura et al.

(10) Patent No.: US 9,481,180 B2
(45) Date of Patent: Nov. 1, 2016

(54) LIQUID CONTAINER, LIQUID CONTAINER UNIT, LIQUID EJECTING SYSTEM, AND LIQUID EJECTING APPARATUS

(71) Applicant: SEIKO EPSON CORPORATION, Tokyo (JP)

(72) Inventors: Naomi Kimura, Nagano (JP); Shoma Kudo, Nagano (JP); Hidenao Suzuki, Nagano (JP); Koji Nishimaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/771,587

(22) PCT Filed: Feb. 26, 2014

(86) PCT No.: PCT/JP2014/001017
§ 371 (c)(1),
(2) Date: Aug. 31, 2015

(87) PCT Pub. No.: WO2014/132635
PCT Pub. Date: Sep. 4, 2014

(65) Prior Publication Data

US 2016/0016409 A1 Jan. 21, 2016

(30) Foreign Application Priority Data

| | | |
|---|---|---|
| Mar. 1, 2013 | (JP) | 2013-040405 |
| Jul. 19, 2013 | (JP) | 2013-150217 |
| Sep. 26, 2013 | (JP) | 2013-199382 |
| Dec. 19, 2013 | (JP) | 2013-262146 |
| Dec. 20, 2013 | (JP) | 2013-263476 |
| Dec. 20, 2013 | (JP) | 2013-263477 |
| Dec. 20, 2013 | (JP) | 2013-263478 |
| Jan. 16, 2014 | (JP) | 2014-005694 |

(51) Int. Cl.
*B41J 2/175* (2006.01)

(52) U.S. Cl.
CPC ..... *B41J 2/17523* (2013.01); *B41J 2/1752* (2013.01); *B41J 2/17509* (2013.01); *B41J 2/17513* (2013.01); *B41J 2/17553* (2013.01)

(58) Field of Classification Search
CPC ..... B41J 2/17523; B41J 2/17553; B41J 2/17509; B41J 2/17513; B41J 2/1752
USPC ..... 347/86
See application file for complete search history.

(56) References Cited

U.S. PATENT DOCUMENTS

| | | | |
|---|---|---|---|
| 4,931,814 | A | 6/1990 | Yoshimura |
| 5,512,926 | A | 4/1996 | Uchikata et al. |

(Continued)

FOREIGN PATENT DOCUMENTS

| | | | |
|---|---|---|---|
| CN | 2367456 | Y | 3/2000 |
| JP | 05-162302 | A | 6/1993 |

(Continued)

*Primary Examiner* — Stephen Meier
*Assistant Examiner* — Alexander D Shenderov
(74) *Attorney, Agent, or Firm* — Global IP Counselors, LLP

(57) ABSTRACT

A liquid container is mountable on a mount portion in a state of being engaged into a first engaging portion with respect to a supporting portion. The liquid container includes a first wall including a first section mountable on the mount portion; a second wall facing the first wall; a third wall intersecting with the first wall and the second wall; a fourth wall which faces the third wall, and intersects with the first wall and the second wall; and a first engaged portion capable of being engaged into the first engaging portion, in which when a direction from the first wall to the second wall is defined as a Z-axis direction, the first engaged portion is projected to the side opposite to the second wall side from the first wall, and is capable of coming in contact with the first engaging portion in the Z-axis direction.

13 Claims, 43 Drawing Sheets

(56) References Cited

U.S. PATENT DOCUMENTS

| | | | | |
|---|---|---|---|---|
| 5,671,000 | A * | 9/1997 | Hirabayashi | B41J 2/17526 347/50 |
| 5,721,576 | A | 2/1998 | Barinaga | |
| 5,812,156 | A | 9/1998 | Bullock et al. | |
| 5,841,453 | A | 11/1998 | Sasaki | |
| 6,053,604 | A | 4/2000 | Sato et al. | |
| 6,065,826 | A | 5/2000 | Robinson et al. | |
| 6,102,535 | A * | 8/2000 | Papenfuhs | B41J 2/17506 347/86 |
| 6,158,848 | A | 12/2000 | Liu | |
| 6,168,267 | B1 | 1/2001 | Komplin | |
| 6,409,322 | B1 | 6/2002 | Ishitsu et al. | |
| 6,755,500 | B2 | 6/2004 | Hirano et al. | |
| 7,377,628 | B2 | 5/2008 | Oikawa et al. | |
| 2003/0076391 | A1 * | 4/2003 | Wilson | B41J 2/175 347/86 |
| 2004/0017445 | A1 * | 1/2004 | Kojima | B41J 2/17546 347/85 |
| 2005/0195449 | A1 | 9/2005 | Hattori et al. | |
| 2012/0038719 | A1 | 2/2012 | Shimizu et al. | |
| 2012/0050359 | A1 | 3/2012 | Koganehira et al. | |
| 2012/0182364 | A1 | 7/2012 | Takeda et al. | |

FOREIGN PATENT DOCUMENTS

| | | | |
|---|---|---|---|
| JP | 08-174862 | A | 7/1996 |
| JP | 11-348308 | A | 12/1999 |
| JP | 2000-141689 | A | 5/2000 |
| JP | 2002-001993 | A | 1/2002 |
| JP | 2003-205624 | A | 7/2003 |
| JP | 2005-041057 | A | 2/2005 |
| JP | 2005-246884 | A | 9/2005 |
| JP | 2005-343050 | A | 12/2005 |
| JP | 2006-159715 | A | 6/2006 |
| JP | 2006-168071 | A | 6/2006 |
| JP | 2008-534312 | A | 8/2008 |
| JP | 2009-269371 | A | 11/2009 |
| JP | 2010-280231 | A | 12/2010 |
| JP | 2011-167981 | A | 9/2011 |
| JP | 2012-020495 | A | 2/2012 |
| JP | 2012-051327 | A | 3/2012 |
| JP | 2012-066563 | A | 4/2012 |
| JP | 2012-144016 | A | 8/2012 |
| JP | 1455512 | S | 11/2012 |
| JP | 1455916 | S | 11/2012 |
| JP | 2013-000949 | A | 1/2013 |
| WO | 2006/104242 | A1 | 10/2006 |

* cited by examiner

LIQUID CONTAINER, LIQUID CONTAINER UNIT, LIQUID EJECTING SYSTEM, AND LIQUID EJECTING APPARATUS

TECHNICAL FIELD

The present invention is related to a liquid container, a liquid container unit, a liquid ejecting system, and a liquid ejecting apparatus.

BACKGROUND ART

In the related art, as an example of a liquid ejecting apparatus, an ink jet printer is known. In the ink jet printer, it is possible to perform printing on a printing medium by discharging ink which is an example of a liquid to the printing medium such as a printing sheet from an ejecting head. In such a liquid ejecting apparatus, in the related art, a configuration in which the ink stored in a tank which is an example of a liquid container is supplied to an ejecting head (for example, refer to PTL 1). In the tank, an injecting port is provided. A user can inject the ink to the tank from the injecting port. Note that, in the following description, a configuration in which a liquid container such as the tank is added to the liquid ejecting apparatus such as an ink jet printer will be expressed as a liquid ejecting system in some cases.

CITATION LIST

Patent Literature

PTL 1: Japanese Unexamined Patent Application Publication No. 2012-144016

SUMMARY OF INVENTION

Technical Problem

In the liquid ejecting system as disclosed in PTL 1, the tank is supported by a bottom face cover. In addition, in this liquid ejecting system, the tank is attached to the bottom face cover by using a screw. In a configuration in which the tank is attached to the bottom face cover by using the screw, there is a problem in that it is difficult to reduce the number of components, or to reduce labor for assembling.

In addition, in the liquid ejecting system including a liquid container which is capable of injecting a liquid, for example, when injecting the liquid into the liquid container, it is considered that the liquid is spilled out or is dripped down. If the liquid is spilled out or is dripped down, it is considered that dirt is spread over the liquid ejecting apparatus or the liquid ejecting system, and the dirt is spread out even environment in which the liquid ejecting apparatus or the liquid ejecting system is disposed. In this way, in the liquid ejecting system of the related art, there is a problem in that it is difficult to suppress dirt due to the liquid.

Solution to Problem

The present invention is made to solve the abovementioned problems, and the invention can be realized in the following forms or application examples.

Application Example 1

A liquid container which is mountable on a mount portion in a state of being engaged into a first engaging portion with respect to a supporting portion including the first engaging portion and the mount portion, including a first wall portion including a first section which is mountable on the mount portion; a second wall portion facing the first wall portion; a third wall portion intersecting with the first wall portion and the second wall portion; a fourth wall portion which faces the third wall portion, and intersects with the first wall portion and the second wall portion; and a first engaged portion which is capable of being engaged into the first engaging portion, in which when a direction from the first wall portion to the second wall portion is defined as a first direction, the first engaged portion is projected to the side opposite to the second wall portion side from the first wall portion, and is capable of coming in contact with the first engaging portion in the first direction.

In the liquid container in the application example, the first engaged portion is capable of coming in contact with the first engaging portion in the first direction, and thus in the first direction, a position of the liquid container with respect to the supporting portion is regulated. With this, it is possible to omit a component such as a screw for attaching the liquid container to the supporting portion, and thus it is likely to reduce the number of components. In addition, since it is possible to omit a component for attaching the liquid container to the supporting portion, it is possible to reduce labor for attaching the liquid container to the supporting portion.

Application Example 2

The liquid container described above, further including a liquid injecting portion which is projected to the side opposite to the first wall portion side from the second wall portion, and is capable of being blocked by a plug member, in which at least a portion of the first engaged portion overlaps the liquid injecting portion in the first direction.

In the application example, at least a portion of the first engaged portion overlaps the liquid injecting portion in the first direction, and thus when the plug member is detached to the first direction from the liquid injecting portion, it is likely that a force acting on the liquid container in the first direction is cancelled by a reaction on the first engaged portion in the direction opposite to the first direction.

Application Example 3

The liquid container described above, further including a second engaged portion which is capable of coming in contact with the second engaging portion that the supporting portion includes in the first direction, in which the first engaged portion is positioned in an area closer to the fourth wall portion than the third wall portion, and the second engaged portion is positioned in an area closer to the third wall portion than the fourth wall portion.

In the application example, due to the first engaged portion which is positioned in the area closer to the fourth wall portion than the third wall portion, and the second engaged portion which is positioned in the area closer to the third wall portion than the fourth wall portion, the position of the liquid container with respect to the supporting portion in the first direction is regulated. As a result, it is likely to improve accuracy of the position of the liquid container with respect to the supporting portion in the first direction.

Application Example 4

The liquid container described above further including a liquid injecting portion which is projected to the side opposite to the first wall portion side from the second wall portion included in the supporting portion and is capable of being blocked by a plug member; and a second engaging portion which is capable of coming in contact with the second engaged portion in the first direction, in which the liquid injecting portion is positioned in an area closer to the third wall portion than the fourth wall portion, the second engaged portion is positioned in an area closer to the fourth wall portion than the third wall portion, and at least a portion of the first engaged portion is positioned in an area which overlaps the liquid injecting portion of the first wall portion in the first direction, or is positioned between the area overlapping the liquid injecting portion and the fourth wall portion.

In the application example, when the plug member is detached to the first direction from the liquid injecting portion, it is likely that the force acting on the liquid container in the first direction is cancelled by the reaction on the first engaged portion in the direction opposite to the first direction.

Application Example 5

The liquid container described above, further including a connecting portion which is connectable to a tube in a direction opposite to the first direction from the first wall portion, in which the first engaged portion is positioned in an area closer to the fourth wall portion than the third wall portion, and the connecting portion is positioned in an area closer to the fourth wall portion than the third wall portion.

In the application example, both the first engaged portion and the connecting portion are positioned in the area closer to the fourth wall portion than the third wall portion, and thus it can be said that the connecting portion is positioned close to the first engaged portion. Here, the accuracy of the position of the liquid container with respect to the supporting portion in the first direction becomes higher as the position is close to the first engaged portion in the area of the liquid container. For this reason, when the connecting portion is positioned close to the first engaged portion, the accuracy of the position of the connecting portion with respect to the supporting portion in the first direction is improved. Accordingly, it is likely to suppress a connection failure, which occurs between the connecting portion and the tube, caused by the variation of the position of the connecting portion with respect to the supporting portion in the first direction.

Application Example 6

The liquid container described above, in which the first engaged portion includes a ring-shaped frame, and when a direction from the third wall portion to the fourth wall portion is defined as a second direction, at least a portion of the first engaging portion extends to the second direction, and is insertable into the frame.

In the application example, the area in the first engaging portion which extends to the second direction is insertable into the ring-shaped frame, and thus it is unlikely that the first engaged portion and the first engaging portion are detached from each other.

Application Example 7

The liquid container which is capable of being further engaged with the second engaging portion that the supporting portion includes, described above, in which the second engaging portion has a hook shape, the second engaged portion is a projecting portion which is projected from the third wall portion to the side opposite to the fourth wall portion side from the third wall portion, and the projecting portion is engaged with the hook shape.

In the application example, it is possible to easily engage the second engaging portion having the hook shape with the second engaged portion as the projecting portion.

Application Example 8

The liquid container described above, in which the first engaged portion is positioned in an area closer to the fourth wall portion than the third wall portion, and the fourth wall portion includes an area having light transmissivity.

In the application example, the fourth wall portion includes a portion having the light transmissivity, and thus it is possible to visually recognize an amount of liquid in the liquid container from the area having the light transmissivity. For this reason, it is possible to use the area having the light transmissivity as a viewing portion for visually recognizing the amount of liquid in the liquid container. In addition, in the liquid container, the first engaged portion is positioned in the area close to the fourth wall portion having the viewing portion, and thus it is possible to improve the accuracy of the position of the viewing portion with respect to the supporting portion in the first direction.

Application Example 9

A liquid container which is mountable on a mount portion in a state of being engaged into a first engaging portion with respect to a supporting portion including the first engaging portion and the mount portion, and the liquid container includes a first engaged portion which is projected to a direction opposite to a first direction from a second section of the first wall portion when a direction in which the mount portion faces a first section is defined as a first direction in a state where the first section of a first wall portion in the liquid container is mounted on the mount portion, in which the first engaged portion is capable of being engaged with the first engaging portion in the first direction.

In the application example, the first engaged portion is capable of coming in contact with the first engaging portion in the first direction, and thus in the first direction, a position of the liquid container with respect to the supporting portion is regulated. With this, it is possible to omit a component such as a screw for attaching the liquid container to the supporting portion, and thus it is likely to reduce the number of components. In addition, since it is possible to omit a component for attaching the liquid container to the supporting portion, it is possible to reduce labor for attaching the liquid container to the supporting portion.

Application Example 10

The liquid container described above, further including a liquid injecting portion which is projected to the first direction from the liquid container, and is capable of being blocked by a plug member, in which the plug member is attachable to and detachable from the liquid injecting portion in the first direction.

In the application example, when the plug member is detached to the first direction from the liquid injecting portion, it is likely that the force acting on the liquid container in the first direction is cancelled by the reaction on the first engaged portion in the direction opposite to the first direction.

Application Example 11

The liquid container which is capable of being engaged with a second engaging portion that the supporting portion includes, described above, a second engaged portion which is capable of coming in contact with respect to the second engaging portion in the first direction, and the first engaged portion is positioned on the side opposite to the second engaged portion by interposing the first section therebetween in a state where the liquid container is mounted on the mount portion.

In the application example, the first engaged portion and the second engaged portion are positioned so as to be opposite to each other by interposing the first section therebetween, and thus the position of the liquid container with respect to the supporting portion in the first direction is regulated. As a result, it is likely to improve accuracy of the position of the liquid container with respect to the supporting portion in the first direction.

Application Example 12

A liquid container unit including a supporting portion which includes a first engaging portion and a mount portion; and a liquid container which is mountable on the mount portion in a state of being engaged with the first engaging portion, in which the liquid container includes a first wall portion including a first section which is mountable on the mount portion; a second wall portion facing the first wall portion; a third wall portion intersecting with the first wall portion and the second wall portion; a fourth wall portion which faces the third wall portion, and intersects with the first wall portion and the second wall portion; and a first engaged portion which is capable of being engaged into the first engaging portion, in which when a direction from the first wall portion to the second wall portion is defined as a first direction, the first engaged portion is projected to the side opposite to the second wall portion side from the first wall portion, and is capable of coming in contact with the first engaging portion in the first direction.

In the liquid container unit according to the application example, the first engaged portion is capable of coming in contact with the first engaging portion in the first direction, and thus in the first direction, a position of the liquid container with respect to the supporting portion is regulated. With this, it is possible to omit a component such as a screw for attaching the liquid container to the supporting portion, and thus it is likely to reduce the number of components. In addition, since it is possible to omit a component for attaching the liquid container to the supporting portion, it is possible to reduce labor for attaching the liquid container to the supporting portion.

Application Example 13

The liquid container unit described above, further including a lid portion which is fitted into the supporting portion, in which the liquid container is positioned between the supporting portion and the lid portion, the liquid container includes a liquid injecting portion which can be capable of being blocked by a plug member, the liquid injecting portion is projected to the side opposite to the mount portion side from the liquid container, the lid portion includes an opening, and at least a portion of the liquid injecting portion is positioned in the opening.

In the application example, at least a portion of the liquid injecting portion is positioned in the opening, and thus when the liquid container is displaced with respect to the supporting portion to a direction intersecting with the first direction, at least a portion of the liquid injecting portion is regulated by the inner wall of the opening. As a result, it is likely to improve accuracy of the position of the liquid container with respect to the supporting portion in the direction intersecting with the first direction.

Application Example 14

A liquid ejecting system including the liquid container unit described above; a liquid ejecting apparatus which is provided with a liquid ejecting head; and a tube which is capable of supplying a liquid to the liquid ejecting head from the liquid container of the liquid container unit, in which the liquid container unit is fixed to an outer periphery of the liquid ejecting apparatus.

In the liquid ejecting system of the application example, it is possible to reduce the number of components, and to reduce labor for attaching the liquid container to the supporting portion.

Application Example 15

A liquid ejecting apparatus including a supporting portion which includes a first engaging portion and a mount portion; a lid portion which is fitted into the supporting portion; a liquid ejecting head which is disposed between the lid portion and the supporting portion, and is capable of ejecting a liquid; a liquid container which is mountable on the mount portion of the supporting portion in a state of being engaged with the first engaging portion, and is positioned between the supporting portion and the lid portion; and a tube which is positioned between the lid portion and the supporting portion, and is capable of supplying a liquid to the liquid ejecting head from the liquid container, in which the liquid container includes a first wall portion including a first section which is mountable on the mount portion; a second wall portion facing the first wall portion; a third wall portion intersecting with the first wall portion and the second wall portion; a fourth wall portion which faces the third wall portion, and intersects with the first wall portion and the second wall portion; and a first engaged portion which is capable of being engaged with the first engaging portion, in which when a direction from the first wall portion to the second wall portion is defined as a first direction, the first engaged portion is projected to the side opposite to the second wall portion side from the first wall portion, and is capable of coming in contact with the first engaging portion in the first direction.

In the liquid ejecting apparatus according to the application example, the first engaged portion is capable of coming in contact with the first engaging portion in the first direction, and thus in the first direction, a position of the liquid container with respect to the supporting portion is regulated. With this, it is possible to omit a component such as a screw for attaching the liquid container to the supporting portion, and thus it is likely to reduce the number of components. In addition, since it is possible to omit a component for attaching the liquid container to the supporting portion, it is possible to reduce labor for attaching the liquid container to the supporting portion.

Application Example 16

A liquid container unit including a lid portion; a supporting portion; and a liquid container which is disposed between the lid portion and the supporting portion, and is capable of storing a liquid, in which the liquid container includes a first wall portion; a second wall portion facing the first wall portion; a third wall portion intersecting with the first wall portion and the second wall portion; and a fourth wall portion which faces the third wall portion and intersects with the first wall portion and the second wall portion, a first concave portion which is recessed toward the side opposite to the liquid container side of the supporting portion is provided in an area facing the first wall portion of the liquid container in the supporting portion, in the first wall portion of the liquid container, a first convex portion which is projected toward the supporting portion side from the first wall portion side is provided in an area facing the first concave portion, the first convex portion is insertable into the first concave portion, and when a direction from the first wall portion to the second wall portion is defined as a first direction, a distance in the first direction from the liquid container to the lid portion is shorter than a distance between an endmost portion of the first convex portion in a direction opposite to the first direction and an endmost portion of the first concave portion in the first direction.

In the liquid container unit according to the application example, the distance between the endmost portion of the first concave portion in the first direction and the endmost portion of the first convex portion in the direction opposite to the first direction is longer than a distance between the lid portion and the liquid container in the first direction. For this reason, even though the position of the liquid container with respect to the supporting portion and the lid portion is deviated in the first direction, the liquid container is regulated by the lid portion before the first convex portion is detached from the first concave portion. With this, it is likely to prevent the position of the liquid container with respect to the supporting portion and the lid portion from being deviated from a predetermined range.

Application Example 17

The liquid container unit described above, in which when a direction from the third wall portion to the fourth wall portion is defined as a second direction, the first concave portion and the first convex portion regulate displacement of the liquid container with respect to the supporting portion at least in the second direction and the direction opposite to the second direction.

In the application example, it is possible to regulate displacement of the liquid container with respect to the supporting portion at least in the second direction and the direction opposite to the second direction by the first concave portion and the first convex portion.

Application Example 18

The liquid container unit described above, in which when a direction intersecting with the first direction and the second direction is defined as a third direction, the first concave portion and the first convex portion regulate displacement of the liquid container with respect to the supporting portion at least in the third direction and the direction opposite to the third direction.

In the application example, it is possible to regulate displacement of the liquid container with respect to the supporting portion in the third direction and the direction opposite to the third direction by the first concave portion and the first convex portion.

Application Example 19

The liquid container unit described above, in which a second concave portion, which is recessed toward the side opposite to the liquid container side of the supporting portion, is provided in an area facing the first wall portion of the liquid container and an area which is different from the first concave portion in the supporting portion, a second convex portion, which is projected to the supporting portion side from the first wall portion side, is provided in an area facing the second concave portion in the first wall portion of the liquid container, the second convex portion is inserted into the second concave portion, in a state where the liquid container is disposed between the lid portion and the supporting portion, a distance between the liquid container and the lid portion in first direction is shorter than a distance between an endmost portion of the second convex portion in a direction opposite to the first direction and an endmost portion of the second concave portion in the first direction, and the second concave portion and the second convex portion regulate the displacement of the liquid container with respect to the supporting portion at least in the second direction and the direction opposite to the second direction.

In the application example, the distance between the endmost portion of the second concave portion in the first direction and the endmost portion of the second convex portion in the direction opposite to the first direction is longer than a distance between the lid portion and the liquid container in the first direction. For this reason, even though the position of the liquid container with respect to the supporting portion and the lid portion is deviated in the first direction, the liquid container is regulated by the lid portion before the second convex portion is detached from the second concave portion. With this, in the first direction, it is likely to further prevent the position of the liquid container with respect to the supporting portion and the lid portion from being deviated from a predetermined range. In addition, in the liquid container unit, by inserting the first convex portion into the first concave portion, and inserting the second convex portion into the second concave portion, it is possible to regulate the position of the liquid container with respect to the supporting portion. With this, it is likely to prevent the liquid container from rotating around the insertion of the first concave portion into the first convex portion with respect to the supporting portion.

Application Example 20

The liquid container unit described above, in which a second concave portion, which is recessed toward the side opposite to the liquid container side of the supporting portion, is provided in an area facing the first wall portion of the liquid container and an area which is different from the first concave portion in the supporting portion, a second convex portion, which is projected to the supporting portion side from the first wall portion side, is provided in an area facing the second concave portion in the first wall portion of the liquid container, the second convex portion is inserted into the second concave portion, in a state where the liquid container is disposed between the lid portion and the supporting portion, a distance between the liquid container and the lid portion in first direction is shorter than a distance between an endmost portion of the second convex portion in a direction opposite to the first direction and an endmost portion of the second concave portion in the first direction, and, when a direction intersecting with the first direction and the second direction is defined as a third direction, the second concave portion and the second convex portion regulate the displacement of the liquid container with respect to the supporting portion at least in the third direction and the direction opposite to the third direction.

In the application example, the distance between the endmost portion of the second concave portion in the first direction and the endmost portion of the second convex portion in the direction opposite to the first direction is longer than a distance between the lid portion and the liquid container. For this reason, even though the position of the liquid container with respect to the supporting portion and the lid portion is deviated in the first direction, the liquid container is regulated by the lid portion before the second convex portion is detached from the second concave portion. With this, in the first direction, it is likely to further prevent the position of the liquid container with respect to the supporting portion and the lid portion from being deviated from a predetermined range. In addition, in the liquid container unit, by inserting the first convex portion into the first concave portion, and inserting the second convex portion into the second concave portion, it is possible to regulate the position of the liquid container with respect to the supporting portion. With this, it is likely to prevent the liquid container from rotating around the inserting and fitting of the first concave portion into the first convex portion with respect to the supporting portion.

Application Example 21

The liquid container unit described above, in which the lid portion includes a projecting portion which is projected to the liquid container side, and the projecting portion is capable of coming in contact with the liquid container.

In the application example, the projecting portion comes in contact with the liquid container, and thus it is likely to improve the accuracy of the position with respect to the supporting portion of the liquid container in the first direction.

Application Example 22

The liquid container unit described above, in which a contact portion, which is projected to the liquid container side from the supporting portion, is provided in an area facing the first wall portion of the liquid container and an area which is different from the first concave portion in the supporting portion, a contact target portion, which is projected to the supporting portion side from the first wall portion side, is provided in an area facing the contact portion in the first wall portion of the liquid container, and in a state where the contact portion and the contact target portion come in contact with each other and the first convex portion is inserted into the first concave portion, a gap is provided between a bottom portion of the first concave portion and the first convex portion.

In the application example, the contact portion and the contact target portion come in contact with each other, and thus it is likely to improve the accuracy of the position with respect to the supporting portion of the liquid container in the first direction.

Application Example 23

A liquid container unit including a lid portion; and a supporting portion; and a liquid container which is disposed between the lid portion and the supporting portion, and is capable of storing a liquid, in which the liquid container includes a first wall portion; a second wall portion facing the first wall portion; a third wall portion intersecting with the first wall portion and the second wall portion; and a fourth wall portion which faces the third wall portion and intersects with the first wall portion and the second wall portion, in which a first convex portion which is projected toward the liquid container side from the supporting portion is provided in an area facing the first wall portion of the liquid container in the supporting portion, in the first wall portion of the liquid container, a first concave portion which is recessed toward the second wall portion side from the first wall portion side is provided in an area facing the first concave portion, the first convex portion is insertable into the first concave portion, and when a direction from the first wall portion to the second wall portion is defined as a first direction, a distance in the first direction from the liquid container to the lid portion is shorter than a distance between an endmost portion of the first convex portion in a direction opposite to the first direction and an endmost portion of the first concave portion in the first direction.

In the liquid container unit according to the application example, the distance between the endmost portion of the first convex portion in the direction opposite to the first direction and the endmost portion of the first concave portion in the first direction is longer than a distance between the lid portion and the liquid container. For this reason, even though the position of the liquid container with respect to the supporting portion and the lid portion is deviated in the first direction, the liquid container is regulated by the lid portion before the first convex portion is detached from the first concave portion. With this, it is likely to prevent the position of the liquid container with respect to the supporting portion and the lid portion from being deviated from a predetermined range.

Application Example 24

The liquid container unit described above, in which when a direction from the third wall portion to the fourth wall portion is defined as a second direction, the first convex portion of the supporting portion and the first concave portion of the liquid container regulate displacement of the liquid container with respect to the supporting portion at least in the second direction and the direction opposite to the second direction.

In the application example, it is possible to regulate displacement of the liquid container with respect to the supporting portion at least in the second direction and the direction opposite to the second direction by the first concave portion of the liquid container and the first convex portion of the supporting portion.

Application Example 25

The liquid container unit described above, in which when a direction intersecting with the first direction and the second direction is defined as a third direction, the first convex portion of the supporting portion and the first concave portion of the liquid container regulate displacement of the liquid container with respect to the supporting portion at least in the third direction and the direction opposite to the third direction.

In the application example, it is possible to regulate displacement of the liquid container with respect to the supporting portion in the third direction and the direction opposite to the third direction by the first convex portion of the supporting portion and the first concave portion of the liquid container.

Application Example 26

A liquid ejecting system including the above-described liquid container unit, a liquid ejecting apparatus which is provided with a liquid ejecting head; and a tube which is capable of supplying a liquid to the liquid ejecting head from the liquid container of the liquid container unit, in which the liquid container unit is fixed to an outer periphery of the liquid ejecting apparatus.

In the liquid ejecting system of the application example, in the liquid container unit, it is likely to prevent the position of the liquid container with respect to the supporting portion and the lid portion from being deviated from a predetermined range.

Application Example 27

A liquid ejecting system including a liquid ejecting apparatus which includes a liquid ejecting head which is capable of ejecting a liquid; a case which is fixed to an outer periphery of the liquid ejecting apparatus; a liquid container which is disposed between the case and the liquid ejecting apparatus, and is capable of storing the liquid; and a tube which is capable of supplying the liquid to the liquid ejecting head from the liquid container, in which the liquid container includes a first wall portion; a second wall portion facing the first wall portion; a third wall portion intersecting with the first wall portion and the second wall portion; and a fourth wall portion which faces the third wall portion, and intersects with the first wall portion and the second wall portion, the case includes a projecting portion which is projected to the fourth wall portion side in an area facing the fourth wall portion of the liquid container, and the projecting portion comes in contact with the fourth wall portion of the liquid container, and presses the liquid container to the liquid ejecting apparatus side.

In the liquid ejecting system according to the application example, the projecting portion of the case comes in contact with the fourth wall portion of the liquid container, and presses the liquid container to the liquid ejecting apparatus side, and thus it is likely to improve accuracy of the position of the liquid container with respect to the case of the liquid container in the direction from the third wall portion to the fourth wall portion.

Application Example 28

A liquid ejecting apparatus including a lid portion; a supporting portion; and a liquid ejecting head which is disposed between the lid portion and the supporting portion, and is capable of ejecting a liquid; a liquid container which is disposed between the lid portion and the supporting portion, and is capable of storing the liquid; and a tube which is disposed between the lid portion and the supporting portion, and is capable of supplying the liquid to the liquid ejecting head from the liquid container, in which the liquid container includes a first wall portion; a second wall portion facing the first wall portion; a third wall portion intersecting with the first wall portion and the second wall portion; and a fourth wall portion which faces the third wall portion and intersects with the first wall portion and the second wall portion, a first concave portion which is recessed toward the side opposite to the liquid container side of the supporting portion is provided in an area facing the first wall portion of the liquid container in the supporting portion, in the first wall portion of the liquid container, a first convex portion which is projected toward the supporting portion side from the first wall portion side is provided in an area facing the first concave portion, the first convex portion is insertable into the first concave portion, and when a direction from the first wall portion to the second wall portion is defined as a first direction, a distance in the first direction from the liquid container to the lid portion is shorter than a distance between an endmost portion of the first convex portion in a direction opposite to the first direction and an endmost portion of the first concave portion in the first direction.

In the liquid ejecting apparatus according to the application example, the distance between the endmost portion of the first concave portion in the direction opposite to the first direction and the endmost portion of the first convex portion in the first direction is longer than a distance between the lid portion and the liquid container in the first direction. For this reason, even though the position of the liquid container with respect to the supporting portion and the lid portion is deviated in the first direction, the liquid container is regulated by the lid portion before the first convex portion is detached from the first concave portion. With this, it is likely to prevent the position of the liquid container with respect to the supporting portion and the lid portion from being deviated from a predetermined range.

Application Example 29

A liquid ejecting apparatus including a lid portion; a supporting portion; and a liquid ejecting head which is disposed between the lid portion and the supporting portion, and is capable of ejecting a liquid; a liquid container which is disposed between the lid portion and the supporting portion, and is capable of storing the liquid; and a tube which is disposed between the lid portion and the supporting portion, and is capable of supplying the liquid to the liquid ejecting head from the liquid container, in which the liquid container includes a first wall portion; a second wall portion facing the first wall portion; a third wall portion intersecting with the first wall portion and the second wall portion; and a fourth wall portion which faces the third wall portion and intersects with the first wall portion and the second wall portion, a first convex portion which is projected toward the liquid container side from the supporting portion side is provided in an area facing the first wall portion of the liquid container in the supporting portion, in the first wall portion of the liquid container, a first concave portion which is recessed toward the second wall portion side from the first wall portion side is provided in an area facing the first concave portion, the first convex portion is insertable into the first concave portion, and when a direction from the first wall portion to the second wall portion is defined as a first direction, a distance in the first direction from the liquid container to the lid portion is shorter than a distance between an endmost portion of the first convex portion in the first direction opposite to the first direction and an endmost portion of the first concave portion in the first direction.

In the liquid ejecting apparatus according to the application example, the distance between the endmost portion of the first convex portion in the first direction and the endmost portion of the first concave portion in the direction opposite to the first direction is longer than a distance between the lid portion and the liquid container in the first direction. For this reason, even though the position of the liquid container with respect to the supporting portion and the lid portion is deviated in the first direction, the liquid container is regulated by the lid portion before the first convex portion is detached from the first concave portion. With this, it is likely to prevent the position of the liquid container with respect to the supporting portion and the lid portion from being deviated from a predetermined range.

Application Example 30

A liquid container unit including a supporting portion; and a liquid container which is mounted on the supporting portion, in which the liquid container includes the liquid storage portion which is capable of storing a liquid; a liquid injecting portion which is capable of injecting the liquid to the liquid storage portion; and a liquid supply portion which is capable of supplying the liquid to the outside from the liquid storage portion, and the supporting portion includes a mount portion on which the liquid container is mounted; a concave portion which is adjacent to the mount portion, and a first partition wall which is adjacent to the concave portion.

In the liquid container unit according to the application example, it is possible to store the liquid, which is spilled out along the outer wall of the liquid container from the liquid injecting portion, in the concave portion via the mount portion. With this, it is likely to prevent the liquid from leaking to the outside of the liquid container unit. As a result, it is likely to suppress dirty due to the liquid.

Application Example 31

The liquid container unit described above, in which the supporting portion includes an engaging portion which is engaged with an engaged portion of the liquid container, and a portion of the concave portion is adjacent to the engaging portion.

In the application example, it is possible to store the liquid, which is spilled out along the outer wall of the liquid container from the liquid injecting portion, in the concave portion via the mount portion or the engaging portion. With this, it is likely to further prevent the liquid from leaking to the outside of the liquid container unit. As a result, it is likely to further suppress dirty due to the liquid.

Application Example 32

The liquid container unit described above, in which the liquid container includes a first wall portion; a second wall portion facing the first wall portion; a third wall portion intersecting with the first wall portion and the second wall portion; and a fourth wall portion which faces the third wall portion and intersects with the first wall portion and the second wall portion, the liquid injecting portion is positioned in an area closer to the fourth wall portion than the third wall portion, and the engaging portion is positioned in an area closer to the fourth wall portion than the third wall portion.

In the application example, the liquid injecting portion is positioned in the area closer to the fourth wall portion than the third wall portion, and the engaging portion is positioned also in the area closer to the fourth wall portion than the third wall portion, and thus it is likely that the liquid spilled out from the liquid injecting portion reaches the engaging portion. For this reason, it is likely to guide the liquid, which is spilled out from the liquid injecting portion, to the concave portion via the engaging portion.

Application Example 33

The liquid container unit described above, wherein the supporting portion includes an opening and a second partition wall which is adjacent to the opening.

In the application example, in the configuration in which the opening is provided in the supporting portion, it is likely to guide the liquid, which is spilled out along the outer wall of the liquid container from the liquid injecting portion, to the concave portion via the second partition wall. For this reason, even though the opening is provided in the supporting portion, it is likely to prevent the liquid, which is spilled out from the liquid injecting portion, from leaking to the outside via the opening.

Application Example 34

The liquid container unit described above, wherein the liquid container includes a first wall portion; a second wall portion facing the first wall portion; a third wall portion intersecting with the first wall portion and the second wall portion; and a fourth wall portion which faces the third wall portion and intersects with the first wall portion and the second wall portion, the liquid injecting portion, is positioned in an area closer to the fourth wall portion than the third wall portion, and the opening is positioned in an area closer to the third wall portion than the fourth wall portion.

In the application example, the opening is positioned in the area closer to the third wall portion than the fourth wall portion while the liquid injecting portion is positioned in the area closer to the fourth wall portion than the third wall portion, and thus it is likely that the liquid injecting portion and the opening are away from each other. With this, it is likely to further prevent the liquid, which is spilled out from the liquid injecting portion, from leaking to the outside via the opening.

Application Example 35

The liquid container unit described above, further including a lid portion which is fitted into the supporting portion, in which the liquid container is positioned between the supporting portion and the lid portion, the lid portion includes an opening for exposing the liquid injecting portion, a portion of the lid portion and a portion of the first partition wall of the supporting portion are fitted into each other, an inner wall of the portion of the lid portion and an inner wall of the portion of the first partition wall come in contact with each other in a first boundary so as to form an inside surface, an outer wall of the one portion of the lid portion and an outer wall of the one portion of the first partition wall come in contact with each other in a second boundary so as to form an outside surface, and in the concave portion, the height from a bottom portion of a part which is adjacent to the portion of the first partition wall to the first boundary is lower than the height from the bottom portion to the second boundary.

In the application example, in the inside surface on which the supporting portion and the lid portion are fitted into each other, the lid portion and the first partition wall of the supporting portion come in contact with each other in the first boundary. In addition, in the outside surface on which the supporting portion and the lid portion are fitted into each other, the lid portion and the first partition wall of the supporting portion come in contact with each other in the second boundary. In addition, in the concave portion, the height from a bottom portion of a part which is adjacent to the portion of the first partition wall to the first boundary is lower than the height from the bottom portion to the second boundary. In other words, when comparing a height position of the first boundary and a height position of the second boundary, the height position of the second boundary is higher than that of the first boundary. For this reason, for example, when the liquid, which is spilled out from the liquid injecting portion, is dripped down along the inside surface on which the supporting portion and the lid portion are fitted into each other, it is likely that the liquid which is dripped down along the inside surface reaches the concave portion through the first boundary. This is because that it is difficult for the liquid which is dripped down along the inside surface to go up from the first boundary to the second boundary of which the height position is higher than that of the first boundary. With this, it is likely to prevent the liquid, which is spilled out from the liquid injecting portion, from leaking to the outside of the liquid container unit.

Application Example 36

A liquid ejecting system including the liquid container unit described above; a liquid ejecting apparatus which is provided with a liquid ejecting head; and a tube which is capable of supplying a liquid to the liquid ejecting head from the liquid container of the liquid container unit, in which the liquid container unit is fixed to an outer periphery of the liquid ejecting apparatus.

In the liquid ejecting system according to application example, it is likely to prevent the liquid, which is spilled out from the liquid injecting portion of the liquid container, from leaking to the outside of the liquid container unit.

Application Example 37

A liquid ejecting apparatus including a lid portion; a supporting portion; and a liquid ejecting head which is disposed between the lid portion and the supporting portion, and is capable of ejecting a liquid; a liquid container which is disposed between the lid portion and the supporting portion; and a tube which is disposed between the lid portion and the supporting portion, and is capable of supplying the liquid to the liquid ejecting head from the liquid container, in which the liquid container includes the liquid storage portion which is capable of storing a liquid; a liquid injecting portion which is capable of injecting the liquid to the liquid storage portion; and a liquid supply portion which is capable of supplying the liquid to the outside from the liquid storage portion, and the supporting portion includes a mount portion on which the liquid container is mounted; a concave portion which is adjacent to the mount portion, and a first partition wall which is adjacent to the concave portion.

In the liquid ejecting apparatus according to the application example, it is possible to store the liquid, which is spilled out along the outer wall of the liquid container from the liquid injecting portion, in the concave portion via the mount portion. With this, it is likely to prevent the liquid from leaking to the outside of the lid portion and the supporting portion. As a result, it is likely to suppress dirty due to the liquid.

Application Example 38

The liquid ejecting apparatus described above, in which the lid portion includes an opening for exposing the liquid injecting portion, a portion of the lid portion and a portion of the first partition wall of the supporting portion are fitted into each other, an inner wall of the portion of the lid portion and an inner wall of the portion of the first partition wall come in contact with each other in a first boundary so as to form an inside surface, an outer wall of the one portion of the lid portion and an outer wall of the one portion of the first partition wall come in contact with each other in a second boundary so as to form an outside surface, and in the concave portion, the height from a bottom portion of a part which is adjacent to the portion of the first partition wall to the first boundary is lower than the height from the bottom portion to the second boundary.

In the application example, in the inside surface on which the supporting portion and the lid portion are fitted into each other, the lid portion and the first partition wall of the supporting portion come in contact with each other in the first boundary. In addition, in the outside surface on which the supporting portion and the lid portion are fitted into each other, the lid portion and the first partition wall of the supporting portion come in contact with each other in the second boundary. In addition, in the concave portion, the height from a bottom portion of a part which is adjacent to the portion of the first partition wall to the first boundary is lower than the height from the bottom portion to the second boundary. In other words, when comparing a height position of the first boundary and a height position of the second boundary, the height position of the second boundary is higher than that of the first boundary. For this reason, for example, when the liquid, which is spilled out from the liquid injecting portion, is dripped down along the inside surface on which the supporting portion and the lid portion are fitted into each other, it is likely that the liquid which is dripped down along the inside surface reaches the concave portion through the first boundary. This is because that it is difficult for the liquid which is dripped down along the inside surface to go up from the first boundary to the second boundary of which the height position is higher than that of the first boundary. With this, it is likely to prevent the liquid, which is spilled out from the liquid injecting portion, from leaking to the outside of the lid portion and the supporting portion.

DESCRIPTION OF EMBODIMENTS

As examples of a liquid ejecting system including an ink jet printer (hereinafter, referred to as a printer) which is an example of a liquid ejecting apparatus, embodiments will be described with reference to the drawings. Meanwhile, in each drawing, in order to make each configuration be the recognizable size, scales of structures and members are differently set in some cases.

First Embodiment

Figure 1:
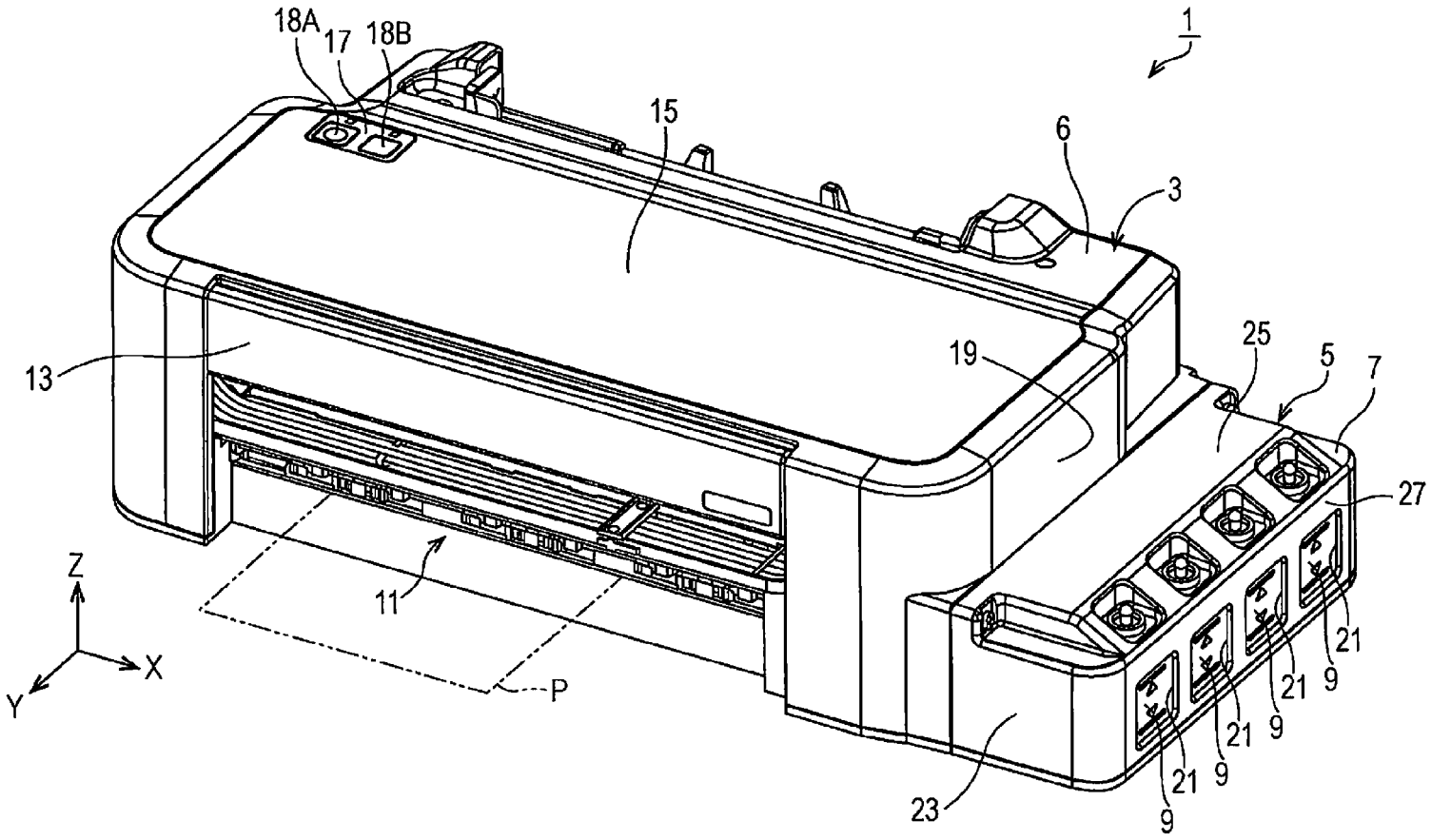
FIG. 1 is a perspective view illustrating a liquid ejecting system in a first embodiment.

A liquid ejecting system 1 in the first embodiment includes a printer 3 which is an example of a liquid ejecting apparatus, and a tank unit 5, as illustrated in FIG. 1. The printer 3 includes a first case 6. The first case 6 is formed as an outer shell of the printer 3. The tank unit 5 includes a second case 7, and a plurality of (two or more) tanks 9. The first case 6 and the second case 7 are formed as a shell of the liquid ejecting system 1. The tank 9 is an example of the liquid container. The liquid ejecting system 1 can perform printing on a printing medium P such as a printing sheet by using ink which is an example of a liquid.

Meanwhile, FIG. 1 shows X, Y, and Z axes which are axes of coordinates and are orthogonal to each other. In other drawings, the X, Y, and Z axes are shown as necessary. In each of the X, Y, and Z axes, a direction of an arrow indicates a +direction (a positive direction), and a direction opposite to the direction of arrow indicates a −direction (a negative direction). In a state of using the liquid ejecting system 1, the liquid ejecting system 1 is disposed on a horizontal plan which is defined by the X-axis and the Y-axis. In a state of using the liquid ejecting system 1, the Z-axis is an axis which is orthogonal to the horizontal plan, and the −Z-axis direction is a vertically lower direction.

The first case 6 accommodates a mechanism unit 10 (FIG. 4) of the printer 3. The mechanism unit 10 is a mechanism for performing a printing operation in the printer 3. The mechanism unit 10 will be described below in detail. The plurality of tanks 9 are accommodated in the second case 7, as illustrated in FIG. 1, and each of them accommodates ink for using the printing. In the embodiment, four tanks 9 are provided. Types of the inks the four tanks 9 are different from each other. In the embodiment, the types of the ink include four types of black, yellow, magenta, and cyan. Then, the four types of inks are provided in such a manner that the tank 9 accommodating a black ink, the tank 9 accommodating a yellow ink, the tank 9 accommodating a magenta ink, and the tank 9 accommodating a cyan ink. In the liquid ejecting system 1, the plurality of tanks 9 are provided on the outside of the first case 6. For this reason, in the liquid ejecting system 1, the plurality of tanks 9 are built in the first case 6 which covers the mechanism unit 10.

In addition, the printer 3 is provided with a paper discharge portion 11. In the printer 3, the printing medium P is discharge from the paper discharge portion 11. In the printer 3, a surface on which the paper discharge portion 11 is provided corresponds to a front surface 13. In addition, the printer 3 includes a control panel 17 on a front surface 15 which intersects with the front surface 13. A power button 18A and a control button 18B are provided in the control panel 17. The tank unit 5 is provided in a side portion 19 which intersects with the front surface 13 and the front surface 15, in the first case 6. A window portion 21 is provided in the second case 7. The window portion 21 is provided on a side portion 27 which intersects with a front surface 23 and a front surface 25 in the second case 7. The window portion 21 has light transmissivity. In addition, the four tanks 9 are provided in a position overlapping the window portion 21. For this reason, an operator using the liquid ejecting system 1 can recognize the four tanks 9 via the window portion 21. Meanwhile, in the embodiment, the window portion 21 is provided as an opening which is formed in the second case 7. The window portion 21 is provided as the opening, and thus has the light transmissivity. A configuration of the window portion 21 is not limited to the opening, for example, the window portion 21 may be a plate-shaped member which is formed of a material having the light transmissivity.

Figure 2:
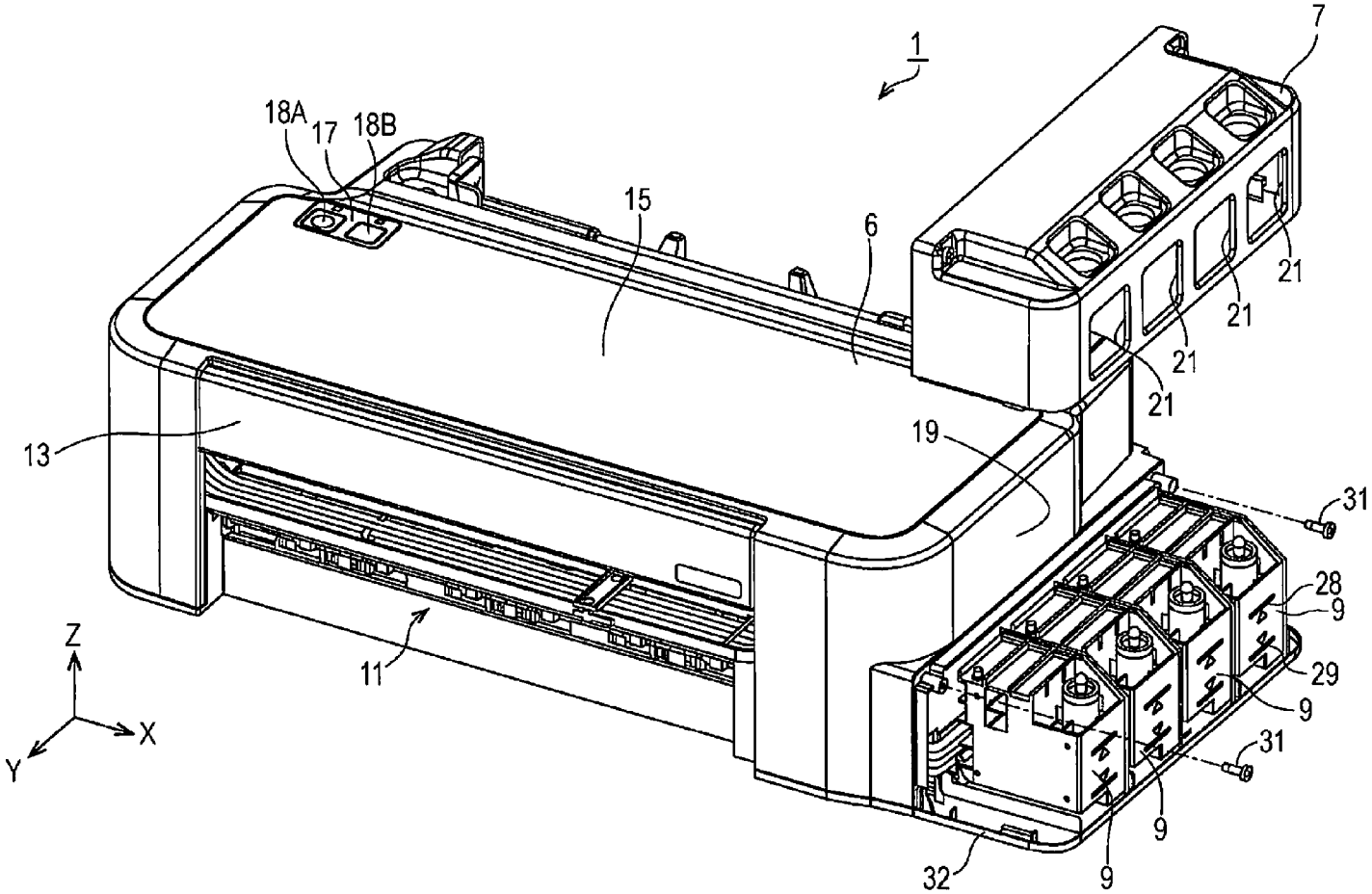
FIG. 2 is a perspective view illustrating the liquid ejecting system in the first embodiment.

In the embodiment, at least a portion of an area which faces the window portion 21 of each of the tanks 9 has the light transmissivity. It is possible to visually recognize the ink in the tank 9 from the area having the light transmissivity of each of the tanks 9. Accordingly, the operator can visually recognize the amount of the ink in each of the tanks 9 by visually recognizing the four tanks 9 via the window portion 21. That is, in the tank 9, it is possible to utilize at least a portion of an area facing the window portion 21 as a viewing portion which visually recognizes the amount of the ink. Each of the tanks 9, an upper limit mark 28 illustrating an upper limit of the amount of the ink, the amount of the ink and a lower limit mark 29 illustrating a lower limit of the amount of the ink are provided in the area facing the window portion 21. The operator can recognize the amount of the ink in each of the tanks 9 by marking the upper limit mark 28 and the lower limit mark 29. In addition, the first case 6 and the second case 7 are formed separated from each other. For this reason, in the embodiment, it is possible to separate the second case 7 from the first case 6, as illustrated in FIG. 2. The second case 7 is coupled with the first case 6 by using the attaching screw 31. In addition, as illustrated in FIG. 2, the second case 7 covers at least a portion of, for example, a front surface, an upper surface, and a side surface of the four tanks 9.

Figure 3:
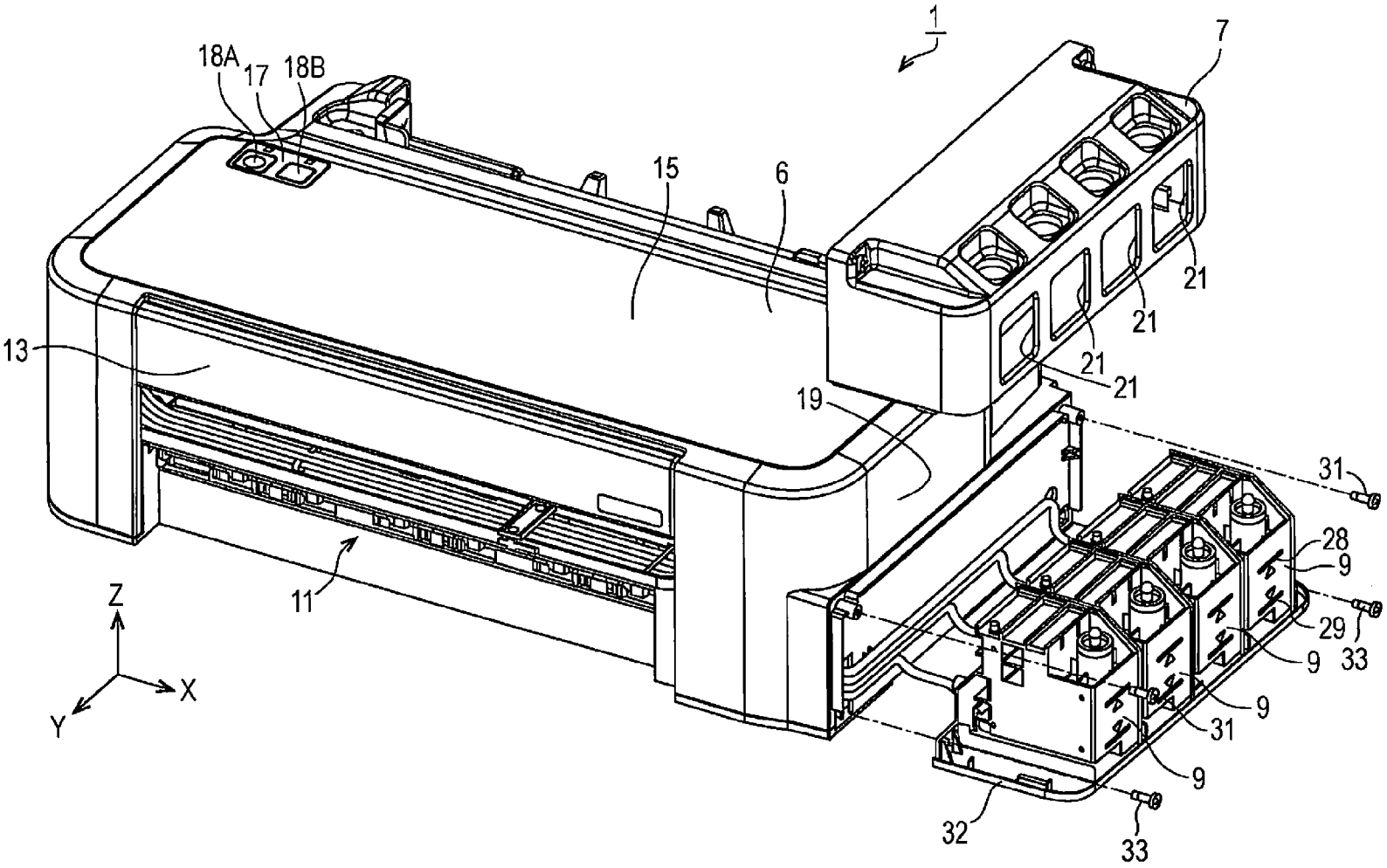
FIG. 3 is a perspective view illustrating the liquid ejecting system in the first embodiment.

In addition, the tank unit 5 includes a supporting frame 32. The four tanks 9 are supported by the supporting frame 32. The supporting frame 32 is formed separately from the first case 6. For this reason, in the embodiment, as illustrated in FIG. 3, it is possible to separate the supporting frame 32 from the first case 6. The supporting frame 32 is coupled with the first case 6 by the attaching screw 33. In this way, in the embodiment, the tank unit 5 (FIG. 1) is attached to the outside of the first case 6.

Figure 4:
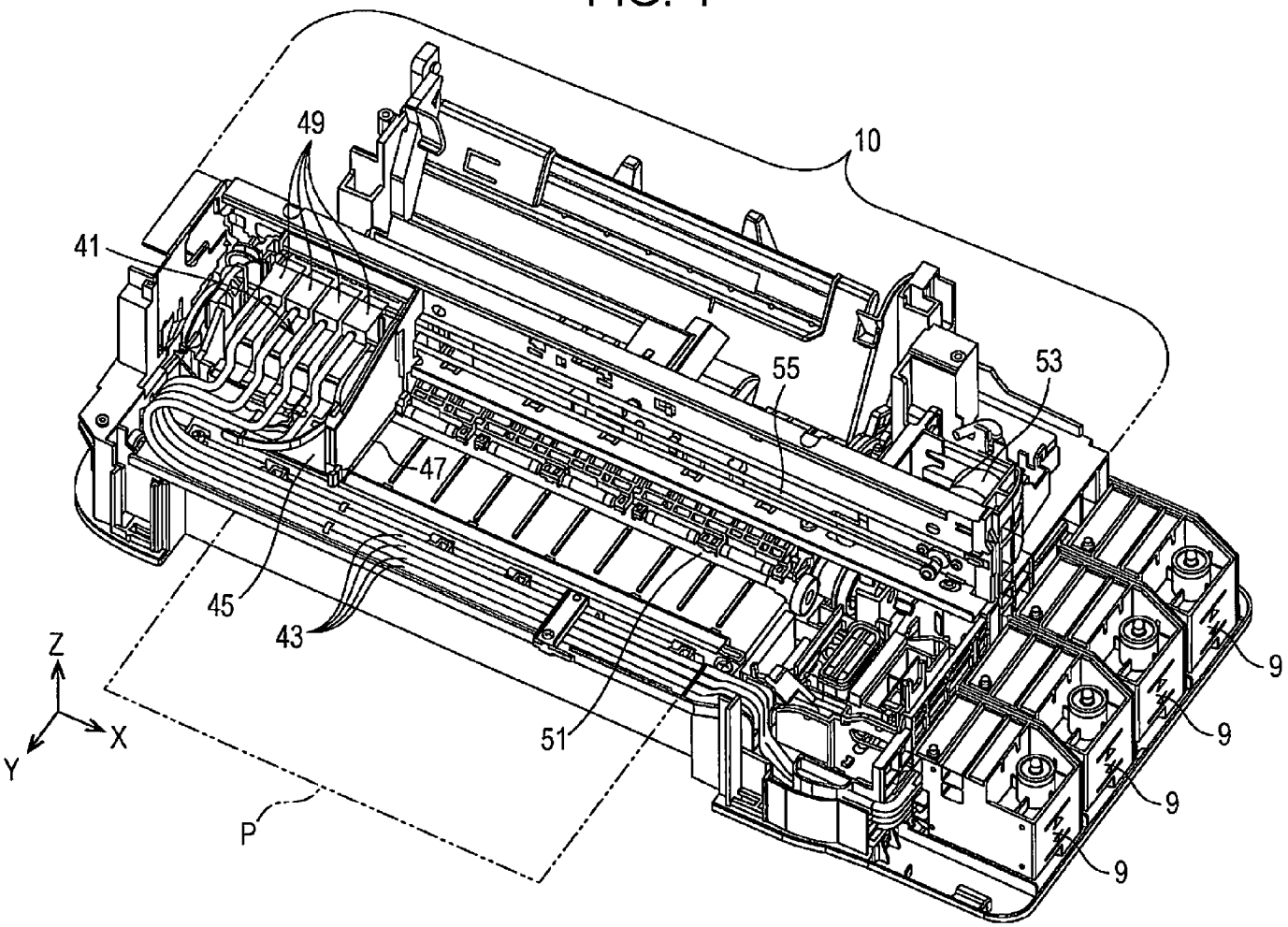
FIG. 4 is a perspective view illustrating a mechanism unit of a printer in the first embodiment.

The printer 3 includes a printing unit 41 and a supply tube 43 as illustrated in FIG. 4 which is a perspective view illustrating the mechanism unit 10. The printing unit 41 includes a carriage 45, a print head 47, and four relay units 49. The print head 47 and the four relay units 49 are built in the carriage 45. The supply tube 43 has flexibility, and is provided between the tank 9 and the relay unit 49. The ink in the tank 9 is transferred to the relay unit 49 via the supply tube 43. The relay unit 49 relays the ink which is supplied to the print head 47 from the tank 9 via the supply tube 43. The print head 47 discharges the supplied ink as an ink droplet.

In addition, the printer 3 includes a medium transport mechanism (not shown) and a head transport mechanism (not shown). The medium transport mechanism transports the printing medium P along the Y-axis direction by driving a transport roller 51 with a driving force from a motor (not shown). The head transport mechanism transports the carriage 45 along the X-axis direction by transferring the driving force of a motor 53 to the carriage 45 via a timing belt 55. The print head 47 is built in the carriage 45. For this reason, the print head 47 can be transported in the X-axis direction through the head transport mechanism via the carriage 45. Meanwhile, the print head 47 is supported by the carriage 45 in a state of facing the printing medium P. Through the medium transport mechanism and the head transport mechanism, the printing is performed on the printing medium P by discharging the ink from the print head 47 while changing a relative position of the print head 47 with respect to the printing medium P.

Figure 5:
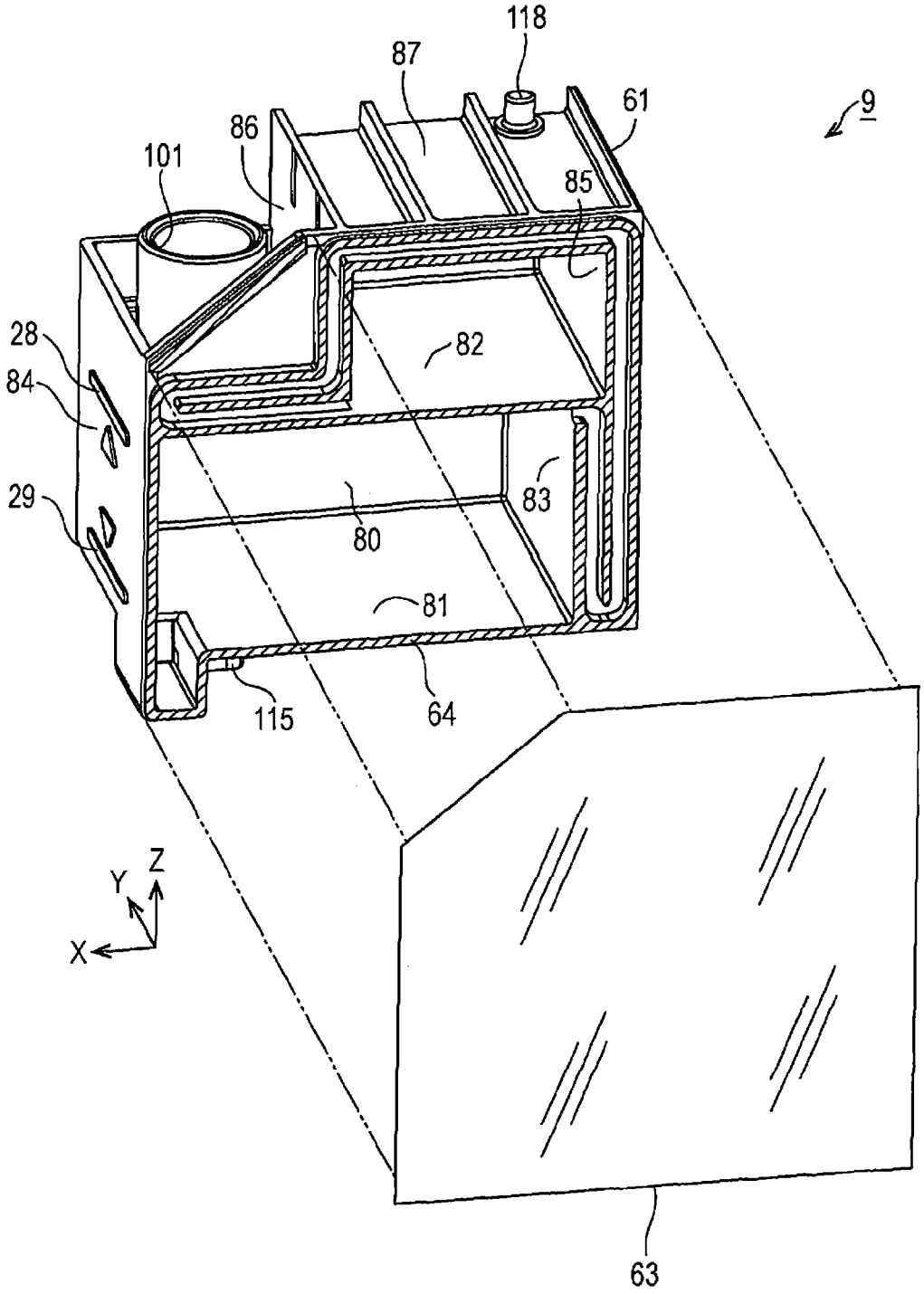
FIG. 5 is an exploded perspective view of a tank in the first embodiment.

The tank 9 will be described. The tank 9 is provided with, as illustrated in FIG. 5, a case 61 which is an example of a tank main body, and a sheet member 63. The case 61 is formed of a synthetic resin such as nylon and polypropylene. In addition, the sheet member 63 which is formed of a synthetic resin (for example, nylon and polypropylene) has a film shape, and has flexibility. In the embodiment, the sheet member 63 has the light transmissivity. The tank 9 has a configuration in which the case 61 and the sheet member 63 are bonded to each other. The case 61 is provided with a bonding portion 64. In FIG. 5, for easy illustration of the configuration, the bonding portion 64 is hatched. The sheet member 63 is bonded to the bonding portion 64 of the case 61. In the embodiment, the case 61 and the sheet member 63 are bonded to each other by welding.

Figure 6:
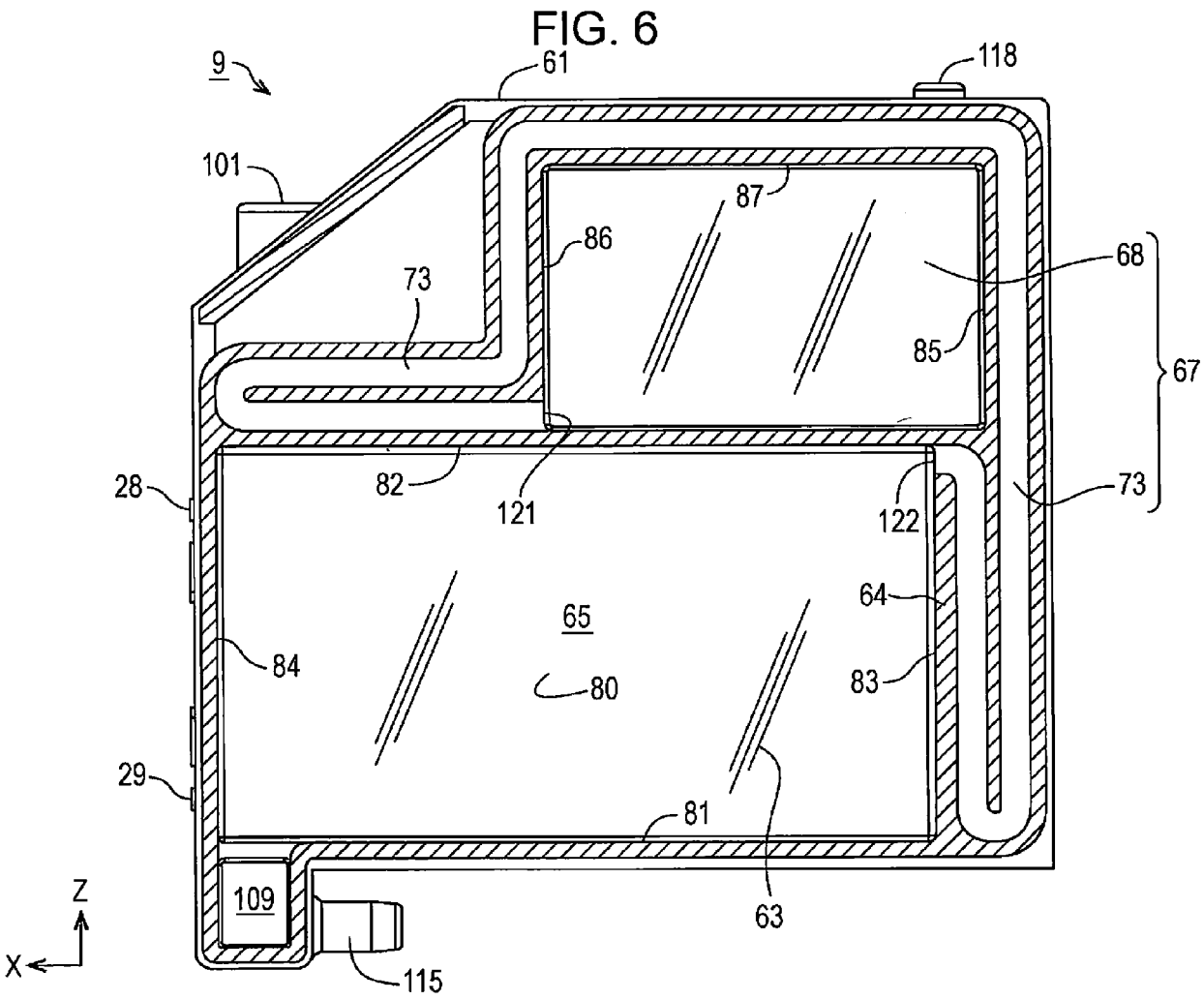
FIG. 6 is a side surface view of the tank when viewed from a sheet member side in the first embodiment.

The tank 9, as illustrated in FIG. 6, includes a storage portion 65 and a communication portion 67. The communication portion 67 includes an atmosphere chamber 68, and a communication path 73. In the tank 9, the ink is stored in the storage portion 65. Meanwhile, FIG. 6 illustrates the tank 9 in a planar view from the sheet member 63 side, and the case 61 the sheet member 63. The storage portion 65, the atmosphere chamber 68, and the communication path 73 are partitioned off from each other by the bonding portion 64. The case 61 includes a base wall 80, a first wall 81, a second wall 82, a third wall 83, a fourth wall 84, a fifth wall 85, a sixth wall 86, and a seventh wall 87. The atmosphere chamber 68 and a portion of the communication path 73 are disposed on the side opposite to the storage portion 65 side of the second wall 82. When viewing the base wall 80 from the sheet member 63 side, the storage portion 65 is surrounded by the first wall 81, the second wall 82, the third wall 83, and the fourth wall 84. In addition, the fourth wall 84 faces the window portion 21 of the second case 7. That is, in the tank 9, the fourth wall 84 includes an area having the light transmissivity.

Figure 7:
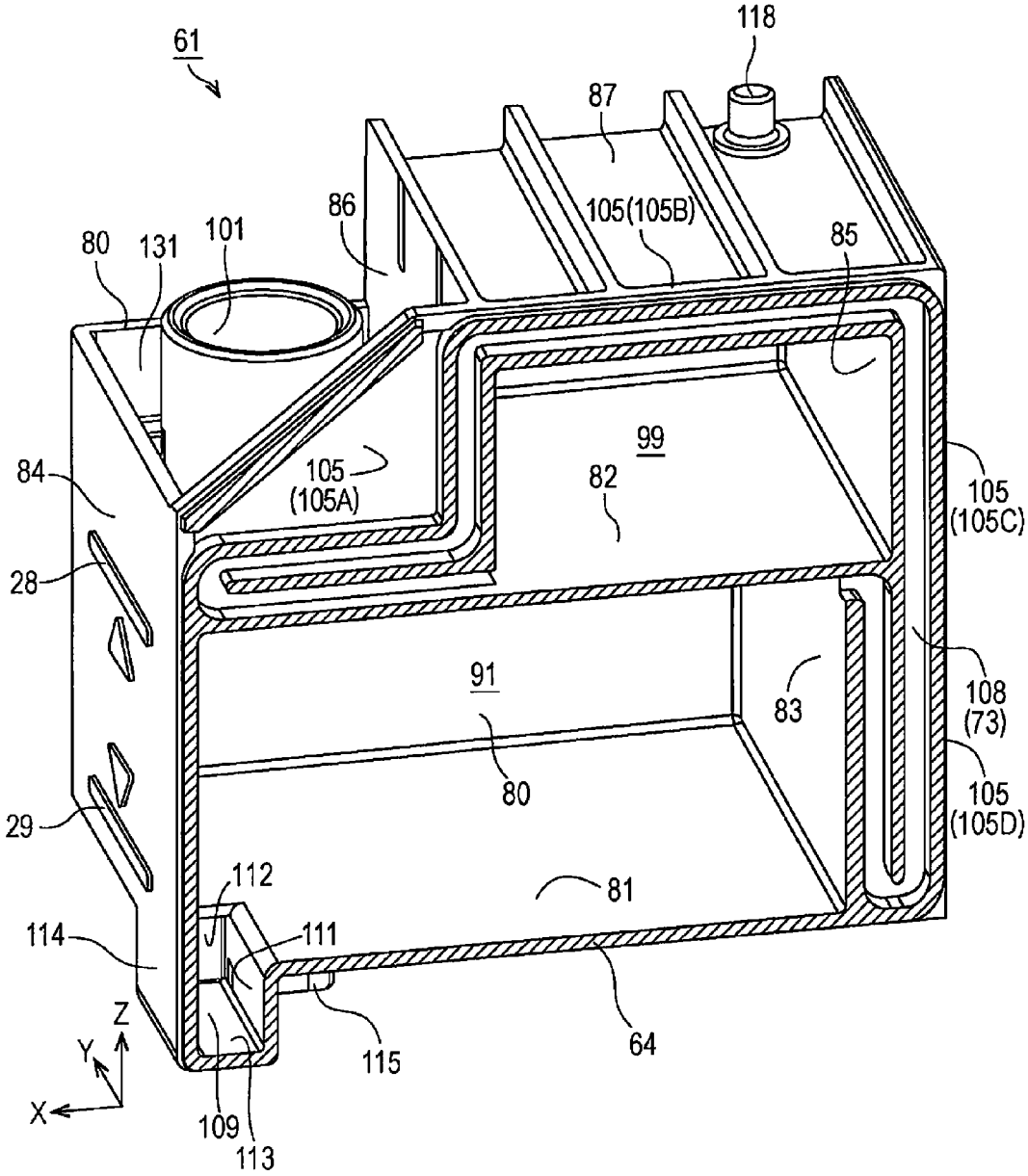
FIG. 7 is a perspective view illustrating a case in the first embodiment.

Further, when viewing the base wall 80 from the sheet member 63 side, the atmosphere chamber 68 is surrounded by the second wall 82, the fifth wall 85, the sixth wall 86, and the seventh wall 87. Note that, the base wall 80 of the storage portion 65 and the base wall 80 of the atmosphere chamber 68 are the same wall. That is, in the embodiment, the storage portion 65 shares the base wall 80 with the atmosphere chamber 68. Each of the first wall 81, the second wall 82, the third wall 83, and the fourth wall 84 intersects with the base wall 80, as illustrated in FIG. 7. The second wall 82 is positioned further from the first wall 81 in the Z-axis direction. The first wall 81 and the second wall 82 face to each other by interposing the base wall 80 therebetween. The fourth wall 84 is positioned further from the third wall 83 in the X-axis direction. The third wall 83 and the fourth wall 84 face each other by interposing the base wall 80 therebetween. The third wall 83 intersects with each of the first wall 81 and the second wall 82. The fourth wall 84 also intersects with each of the first wall 81 and the second wall 82.

The first wall 81, the second wall 82, the third wall 83, the fourth wall 84 are projected to the −Y-axis direction from the base wall 80. With this, a concave portion 91 is formed of, centering on the base wall 80 as a main wall, the first wall 81, the second wall 82, the third wall 83, and the fourth wall 84 which extend to the −Y-axis direction from the main wall. The concave portion 91 is recessed in the Y-axis direction. The concave portion 91 opens to the −Y-axis direction, that is, the sheet member 63 (FIG. 5) side. In other words, the concave portion 91 is recessed in the Y-axis direction, that is, toward the side opposite to the sheet member 63 (FIG. 5) side. In addition, when the sheet member 63 is bonded to the case 61, the concave portion 91 is blocked by the sheet member 63, and the storage portion 65 is formed. Note that, each of the base wall 80 and the first wall 81 to the seventh wall 87 may include unevenness on the surface thereof without being limited to a flat wall.

The fifth wall 85, as illustrated in FIG. 6, is projected to the side opposite to the first wall 81 side of the second wall 82 from the second wall 82, that is, the second wall 82 in the +Z-axis direction. The sixth wall 86 is projected to the side opposite to the first wall 81 side of the second wall 82 from the second wall 82, that is, the second wall 82 in the +Z-axis direction. The sixth wall 86 is positioned further from the fifth wall 85 in the X-axis direction. The fifth wall 85 and the sixth wall 86 are provided at positions facing each other by interposing the atmosphere chamber 68 therebetween. The seventh wall 87 is positioned further from the second wall 82 in the Z-axis direction. The second wall 82 and the seventh wall 87 are provided at positions facing each other by interposing the atmosphere chamber 68 therebetween. The fifth wall 85 intersects with each of the second wall 82 and the seventh wall 87. The sixth wall 86 also intersects with each of the second wall 82 and the seventh wall 87.

The fifth wall 85, the sixth wall 86, and the seventh wall 87 are projected to the −Y-axis direction from the base wall 80. With this, a concave portion 99 is formed of, centering on the base wall 80 as a main wall, the second wall 82, the fifth wall 85, the sixth wall 86, and the seventh wall 87 which extend to the −Y-axis direction from the main wall. The concave portion 99 is recessed in the Y-axis direction. The concave portion 99 opens to the −Y-axis direction, that is, the sheet member 63 (FIG. 5) side. In other words, the concave portion 99 is recessed in the Y-axis direction, that is, toward the side opposite to the sheet member 63 (FIG. 5) side. In addition, when the sheet member 63 is bonded to the case 61, the concave portion 99 is blocked by the sheet member 63, and the atmosphere chamber 68 is formed. Note that, projection amounts from the base wall 80 of the first wall 81 to the seventh wall 87 are set to be the same each other.

A step is formed between the third wall 83 and the fifth wall 85. The third wall 83 is positioned closer to the fourth wall 84 side than the fifth wall 85, that is, further from the fifth wall 85 in the X-axis direction. In addition, the fourth wall 84 and the sixth wall 86 have a step. The sixth wall 86 is positioned closer to the third wall 83 side than the fourth wall 84, that is, further from the fourth wall 84 in the −X-axis direction. In addition, in a state of viewing the base wall 80 from the sheet member 63 side in a planar view, an ink injecting portion 101 is provided between fourth wall 84 and the sixth wall 86. The ink injecting portion 101 is provided on the second wall 82.

As illustrated in FIG. 7, the case 61 is provided with the extending portion 105. The communication path 73 is provided in the extending portion 105. The extending portion 105 includes an area 105A which extends along the frame of the opening of the concave portion 91 from the second wall 82 to the Z-axis direction in an area of the second wall 82 which is further from the sixth wall 86 in the X-axis direction. The area 105A extends along the frame of the opening of the concave portion 99 from the sixth wall 86 to the X-axis direction in the sixth wall 86. In addition, the extending portion 105 includes an area 105B which extends further from the seventh wall 87 in the Z-axis direction. Further, the extending portion 105 includes an area 105C which extends along the frame of the opening of the concave portion 99 from the fifth wall 85 to the −X-axis direction in the fifth wall 85. In addition, the extending portion 105 includes an area 105D which extends along the frame of the opening of the concave portion 91 from the third wall 83 to the −X-axis direction in the third wall 83. The communication path 73 is formed in the extending portion 105 as a groove 108 which is recessed toward the side opposite to the sheet member 63 (FIG. 5) side.

Here, as illustrated in FIG. 7, a concave portion 109 is provided in the concave portion 91. The concave portion 109 is surrounded by an eighth wall 111, a ninth wall 112, a tenth wall 113, and the fourth wall 84. The concave portion 109 is provided on the side opposite to the second wall 82 side of the first wall 81 from the first wall 81, that is, is recessed in the −Z-axis direction from the first wall 81. Each of the eighth wall 111 and the ninth wall 112 is provided on the first wall 81, and is projected to the side opposite to the second wall 82 side of the first wall 81 from the first wall 81, that is, to the −Z-axis direction from the first wall 81.

The eighth wall 111 is positioned between the fourth wall 84 and the third wall 83, and faces the fourth wall 84 by interposing the tenth wall 113 therebetween. The ninth wall 112 is positioned between the base wall 80 and the sheet member 63 (FIG. 5), and faces the sheet member 63 by interposing the tenth wall 113 therebetween. The tenth wall 113 is positioned closer to the side opposite to the second wall 82 side than the first wall 81, that is, further from the first wall 81 in the −Z-axis direction. The tenth wall 113 faces the second wall 82. The eighth wall 111 intersects with the first wall 81, the ninth wall 112, and the tenth wall 113. The ninth wall 112 intersects with the first wall 81, the fourth wall 84, and the tenth wall 113. The tenth wall 113 intersects with the fourth wall 84.

Figure 8:
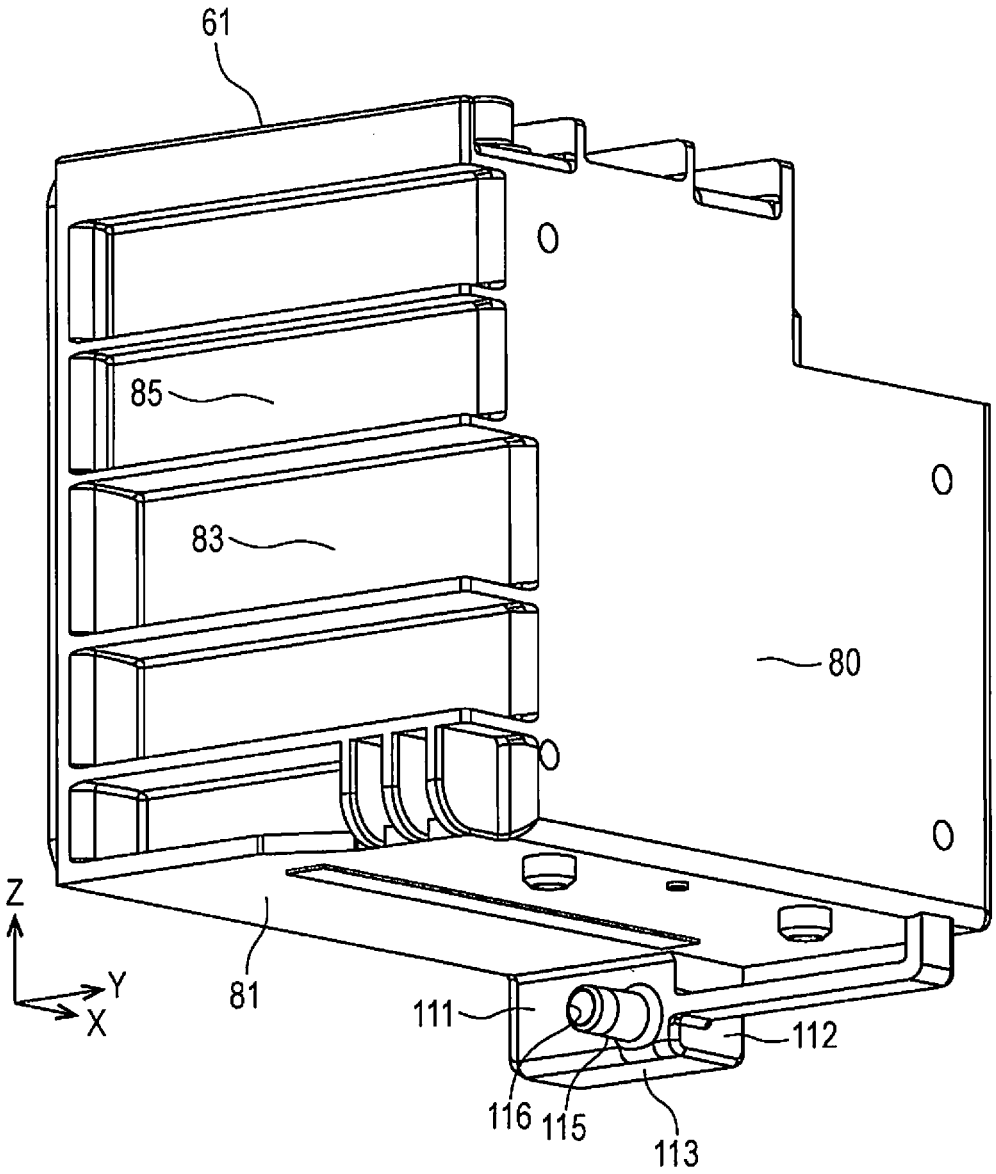
FIG. 8 is a perspective view illustrating the case in the first embodiment.

As illustrated in FIG. 7, the eighth wall 111, the ninth wall 112, the tenth wall 113, and the fourth wall 84 which surround the concave portion 109 form a supply portion 114. The supply portion 114 is provided with a connecting portion 115. The connecting portion 115 is provided on the eighth wall 111. The connecting portion 115 is provided on the side opposite to the concave portion 109 side of the eighth wall 111. The connecting portion 115 is projected to the side opposite to the concave portion 109 side from the eighth wall 111, that is, to the third wall 83 side from the eighth wall 111. The connecting portion 115 is formed into a cylindrical shape, as illustrated in FIG. 8. The connecting portion 115 is provided with a supply port 116. The supply port 116 is an opening which is formed in the connecting portion 115, and is a discharge port of the ink from the tank 9. The supply tube 43 (FIG. 4) is connected to the connecting portion 115. The ink stored in the tank 9 is discharged to the supply tube 43 from the connecting portion 115 via the supply port 116. The ink which is discharged from the supply tube 43 is guided to the print head 47 through the supply tube 43.

In addition, as illustrated in FIG. 7, the seventh wall 87 is provided with an air communicating port 118. The air communicating port 118 is projected to the side opposite to the second wall 82 side of the seventh wall 87 from the seventh wall 87, that is, to the seventh wall 87 in the Z-axis direction. The air communicating port 118 is provided at a position overlapping the concave portion 99 when viewing the seventh wall 87 in a planar view, that is, when viewing the seventh wall 87 in an XY plane. The air communicating port 118 communicates the outside of the case 61 and inside of the concave portion 99 with each other. The air communicating port 118 is a path for the atmosphere in which the atmosphere of the outside of the case 61 can be guided to the inside of the concave portion 99. Note that, in the case 61, the bonding portion 64 is provided along an outline of each of the concave portion 91, the concave portion 99, the concave portion 109, and the communication path 73.

The sheet member 63 faces the base wall 80 by interposing the first wall 81 to the seventh wall 87 therebetween, as illustrated in FIG. 5. In planar view, the size of the sheet member 63 is enough to cover the concave portion 91, the concave portion 99, the concave portion 109, and the extending portion 105 (FIG. 7). The sheet member 63 is welded to the bonding portion 64. With this, the concave portion 91, the concave portion 99, the concave portion 109, and the communication path 73 are sealed by the sheet member 63. For this reason, the sheet member 63 can be considered a lid with respect to the case 61.

The communication path 73 is provided with, as illustrated in FIG. 6, a communication port 121, and a communication port 122. The communication port 121 is an opening portion which opens to the inside of the atmosphere chamber 68. The communication port 122 is an opening portion which opens to the inside of the storage portion 65. The atmosphere chamber 68 communicates with the storage portion 65 from the communication port 121 via the communication port 122 by passing through the communication path 73. As described above, the storage portion 65 communicates with the outside of the tank 9 via the communication path 73, the atmosphere chamber 68, and the air communicating port 118. In other words, the communication portion 67 communicates the air communicating port 118 and the storage portion 65 with each other. The atmosphere which flows into the atmosphere chamber 68 from the air communicating port 118 flows into the storage portion 65 via the communication path 73.

The ink injecting portion 101 is provided on the second wall 82. The ink injecting portion 101 is provided in, as illustrated in FIG. 7, the concave portion 131 which is surrounded by the sixth wall 86, the extending portion 105, the fourth wall 84, and the base wall 80. As described above, the extending portion 105 is projected closer to the seventh wall 87 side than the second wall 82. In addition, the sixth wall 86 is also projected closer to the seventh wall 87 side than the second wall 82. Similarly, in the embodiment, each of the base wall 80 and the fourth wall 84 is also projected closer to the seventh wall 87 side than the second wall 82. In addition, the extending portion 105 intersects with both of the sixth wall 86 and the fourth wall 84. In addition, the base wall 80 intersects both of the fourth wall 84 and the sixth wall 86. For this reason, an area of the second wall 82 which is on the fourth wall 84 side further from the sixth wall 86 forms the concave portion 131 which is surrounded by the sixth wall 86, the extending portion 105, the fourth wall 84, and the base wall 80. The concave portion 131 is recessed toward the first wall 81 side from the second wall 82 side.

With such a configuration, the ink injecting portion 101 is surrounded by the sixth wall 86, the extending portion 105, the fourth wall 84, and the base wall 80. In other words, the ink injecting portion 101 is provided in an area of the second wall 82 which is surrounded by the sixth wall 86, the extending portion 105, the fourth wall 84, and the base wall 80. In addition, the concave portion 131 serves as an ink reception portion. The ink reception portion can receive, for example, the ink which is spilled out from the ink injecting portion 101, and the ink which is dripped down at the time of injecting. In this way, the concave portion 131 serves as the ink reception portion for receiving the ink.

Figure 9:
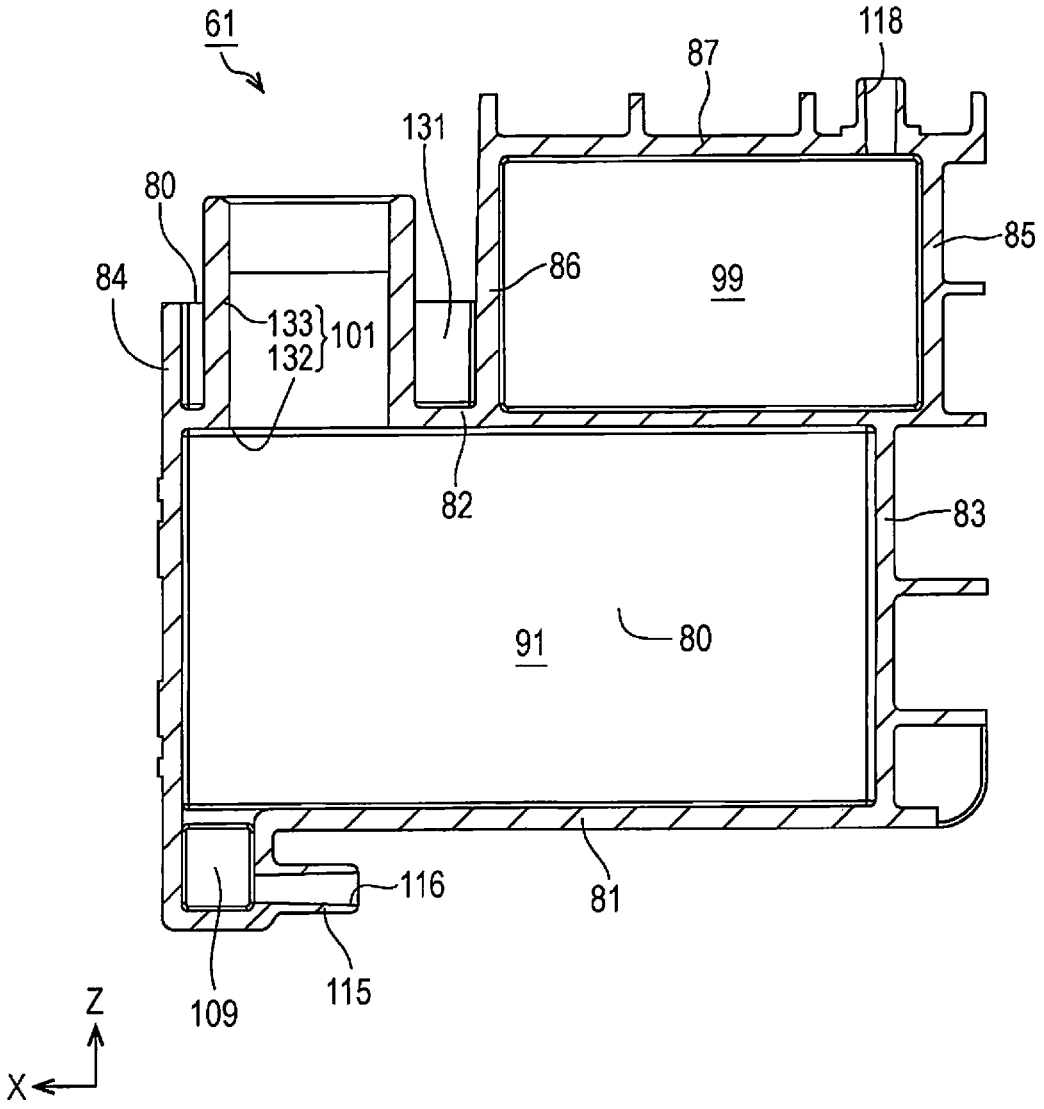
FIG. 9 is a sectional view when an ink injecting portion, a supply port, and an air communicating port are cut along planes X and Z in the first embodiment.

The ink injecting portion 101 includes an opening 132 and a side wall 133 in FIG. 9 which illustrates a sectional view when cutting the ink injecting portion 101, the supply port 116, and the air communicating port 118 by an XZ plane. The opening 132 is a through hole which is provided on the second wall 82. The opening 132 is intersecting portion in which the ink injecting portion 101 intersects with the storage portion 65. The ink injecting portion 101 may apply a configuration such that the side wall 133 is projected to the inside of the storage portion 65. Even in the configuration such that the side wall 133 is projected to the inside of the storage portion 65, the intersecting portion in which the ink injecting portion 101 intersects with the storage portion 65 is defined as the opening 132. The concave portion 91 is communicates with the outside of the concave portion 91 via the opening 132 which is the through hole. The side wall 133 is provided on the side opposite to the first wall 81 side of the second wall 82, and forms an ink injection path by surrounding the vicinity of the opening 132. The side wall 133 is projected to the side opposite to the first wall 81 side the second wall 82. Meanwhile, in the embodiment, the side wall 133 is projected closer to the side opposite to the first wall 81 side than each of the base wall 80 and the fourth wall 84. It is possible to prevent the ink which is stored in the concave portion 131 from flowing into the opening 132 by the side wall 133.

Figure 10:
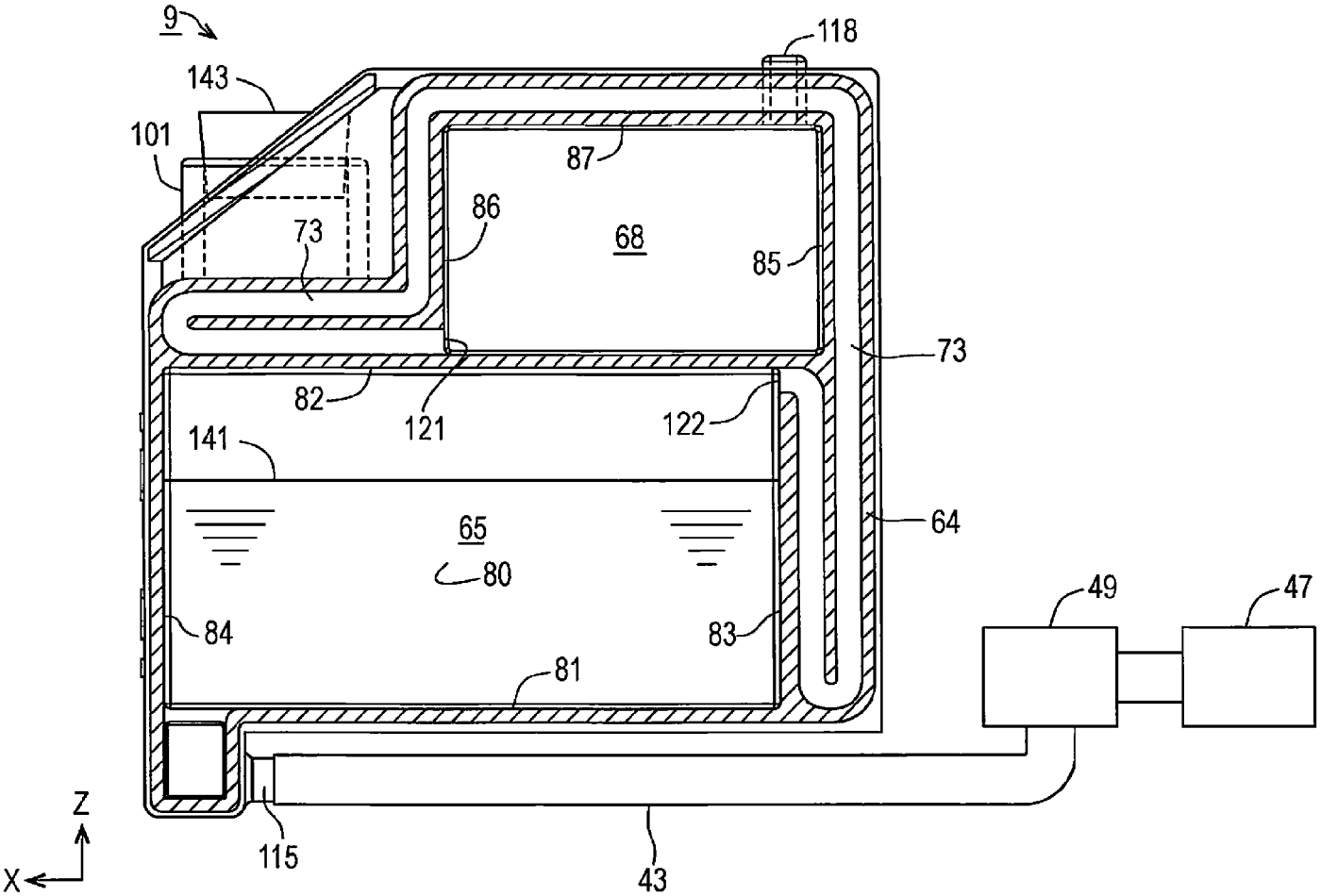
FIG. 10 is a side surface view of the tank when viewed from the sheet member side in the first embodiment.

In the tank 9, when viewing the tank 9 from the sheet member 63 side in a planar view, an ink 141 is stored in the storage portion 65 as illustrated in FIG. 10 which is a side surface view. In FIG. 10, in order to facilitate understanding of the configuration, the sheet member 63 is not illustrated in the drawings, and the bonding portion 64 is hatched. The ink 141 in the storage portion 65 is supplied to the print head 47 from the supply port 116 (FIG. 9) which is formed in the connecting portion 115. In the embodiment, in a state where the liquid ejecting system 1 is used for printing, the supply tube 43 is connected to the supply port 116, and a cap 143 is fitted into the ink injecting portion 101. The ink 141 in the storage portion 65 reaches the print head 47 from the supply port 116 via the relay unit 49 by suctioning the inside of the supply tube 43.

The ink 141 in the storage portion 65 is transferred to the print head 47 side in accordance with the printing performed by the print head 47. For this reason, in accordance with the printing performed by the print head 47, a pressure in the storage portion 65 becomes lower than the atmosphere. When the pressure in the storage portion 65 becomes lower than the atmosphere, the atmosphere in the atmosphere chamber 68 flows into the storage portion 65 through the communication path 73. With this, it is likely to keep the pressure in the storage portion 65 in an atmospheric pressure. As described above, the ink 141 in the tank 9 is supplied to the print head 47. When the ink 141 in the storage portion 65 of the tank 9 is consumed, and thus a residual amount of the ink 141 is reduced, an operator can charge additional ink to the storage portion 65 from the ink injecting portion 101.

Figure 11:
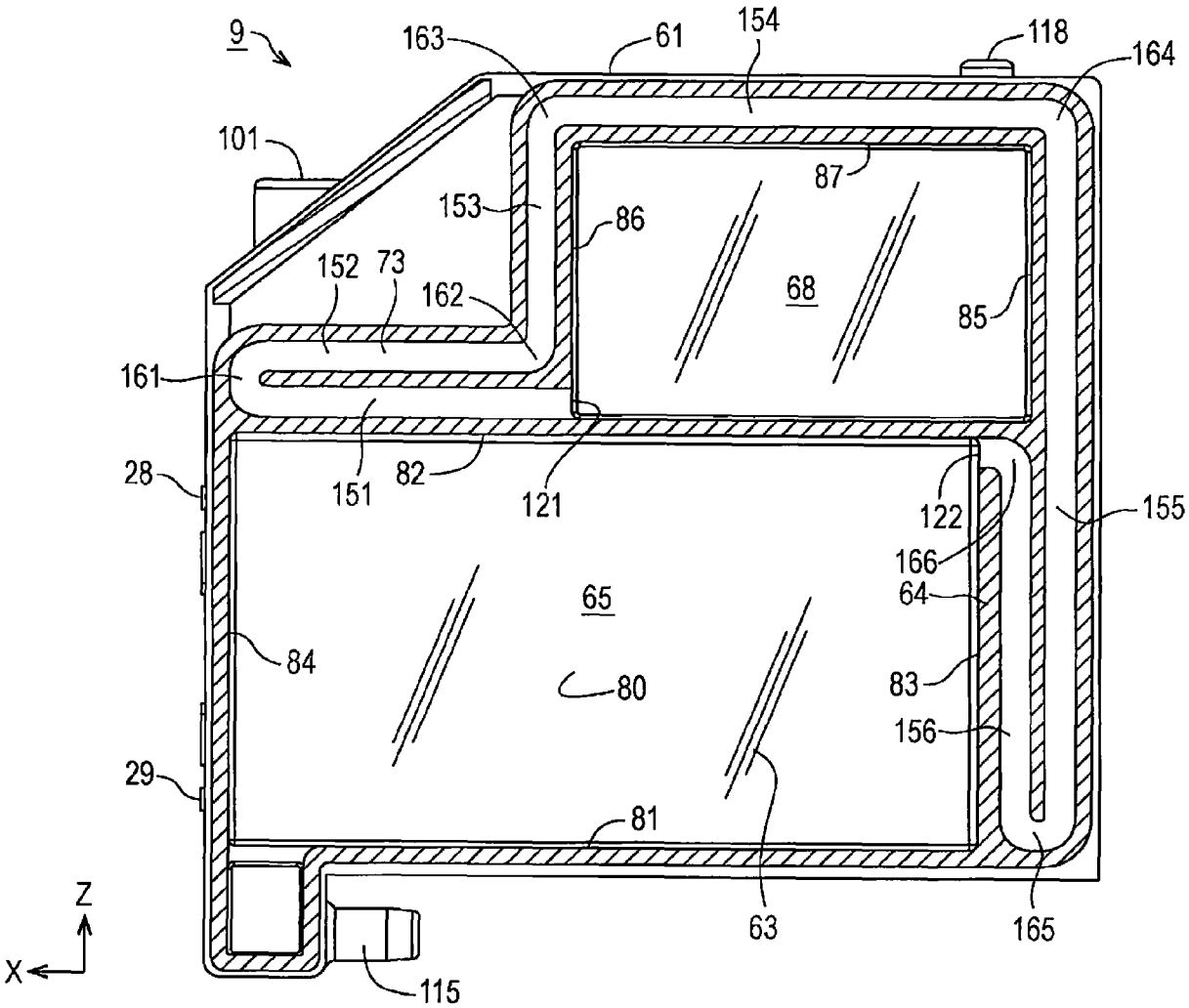
FIG. 11 is a side surface view of the tank when viewed from the sheet member side in the first embodiment.
Figure 12:
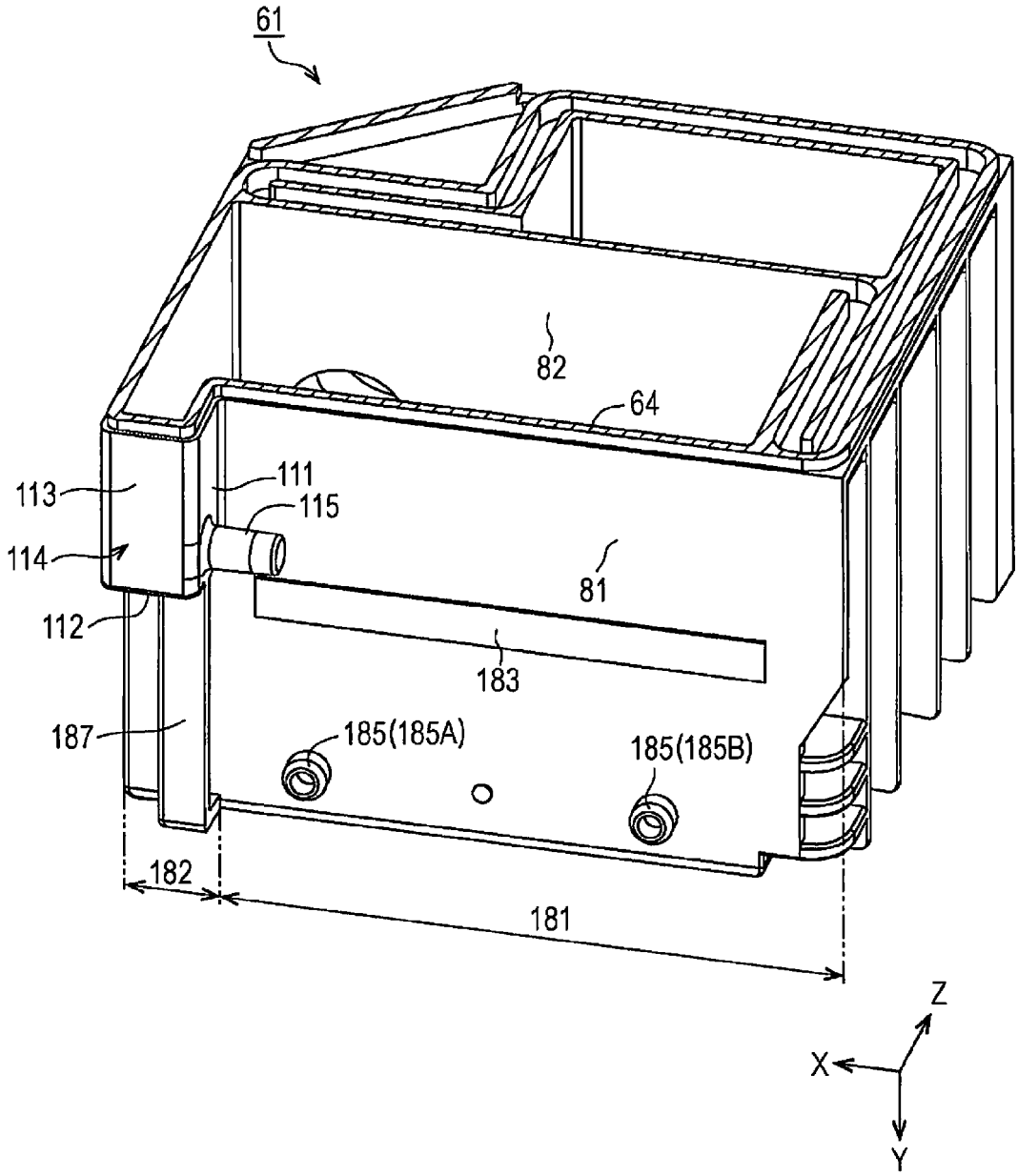
FIG. 12 is a perspective view illustrating the case in the first embodiment.

As illustrated in FIG. 11, the communication path 73 may be divided into a first communication path 151, a second communication path 152, a third communication path 153, a fourth communication path 154, a fifth communication path 155, and a sixth communication path 156. The first communication path 151 is formed along the second wall 82 from the communication port 121, that is, toward the fourth wall 84 along the X-axis direction. The first communication path 151 reaches an inverting portion 161 from the communication port 121. The inverting portion 161 is an area in which the direction of the flow path is reserved in the communication path 73. In the inverting portion 161, the direction of the flow path is reserved from the X-axis direction to −X-axis direction. Note that, in a route of the atmosphere from the air communicating port 118 to the storage portion 65, the air communicating port 118 side is referred to as the upstream side, and the communication port 122 side is referred to as the downstream side.

The second communication path 152 is formed along the direction in which the first communication path 151 extends from the inverting portion 161, that is, toward the sixth wall 86 along the −X-axis direction. The second communication path 152 reaches a bending portion 162 from the inverting portion 161. The bending portion 162 is an area in which the direction of the flow path is bent in the communication path 73. In the bending portion 162, the direction of the flow path is bent to the Z-axis direction from the −X-axis direction. The third communication path 153 is formed along the sixth wall 86 from the bending portion 162, that is, toward the seventh wall 87 along the Z-axis direction. The third communication path 153 reaches a bending portion 163 from the bending portion 162. The bending portion 163 is an area in which the direction of the flow path is bent in the communication path 73. In the bending portion 163, the direction of the flow path is bent to the −X-axis direction from the Z-axis direction.

The fourth communication path 154 is formed along the seventh wall 87 from the bending portion 163, that is, toward the fifth wall 85 along the −X-axis direction. The fourth communication path 154 is positioned further from the atmosphere chamber 68 in the Z-axis direction (upper side). The fourth communication path 154 reaches a bending portion 164 from the bending portion 163. The bending portion 164 is an area in which the direction of the flow path is bent in the communication path 73. In the bending portion 164, the direction of the flow path is bent to the −Z-axis direction from the −X-axis direction. The fifth communication path 155 is formed along the fifth wall 85 from the bending portion 164, that is, toward the first wall 81 along the −Z-axis direction. The fifth communication path 155 reaches the inverting portion 165 from the bending portion 164.

As described above, the fourth communication path 154 is positioned above the atmosphere chamber 68. That is, a portion of the communication path 73 is positioned above the atmosphere chamber 68. With such a configuration, the ink which flows into the communication path 73 from the storage portion 65 is difficult to go to the upside father from the atmosphere chamber 68 due to an action of gravity. For this reason, the ink which flows into the communication path 73 from the storage portion 65 is difficult to reach the atmosphere chamber 68. As a result, it is likely to prevent the ink which flows into the communication path 73 from the storage portion 65 from leaking from the tank 9.

In addition, in the tank 9, the third communication path 153 and the fifth communication path 155 are positioned on the side opposite to each other by interposing the atmosphere chamber 68 therebetween. With such a configuration, the communication path 73 is formed so as to surround the vicinity of the atmosphere chamber 68 by using a space in the vicinity of the atmosphere chamber 68, and thus it is possible to make the route of the communication path 73 long. From an aspect that a liquid component of the ink in the storage portion 65 is hardly vaporized, and an aspect that the ink which flows into the communication path 73 from the storage portion 65 hardly reaches the atmosphere chamber 68, it is preferable that the route of the communication path 73 is made long.

The inverting portion 165 is an area in which the direction of the flow path is reversed in the communication path 73. In the inverting portion 165, the direction of the flow path is reversed from the −Z-axis direction to the +Z-axis direction. The sixth communication path 156 is formed along the third wall 83 from the inverting portion 165, that is, toward the second wall 82 along the Z-axis direction. The sixth communication path 156 reaches the communication port 122 from the inverting portion 165 via the bending portion 166. The bending portion 166 is an area in which the direction of the flow path is bent in the communication path 73. The communication path 73 communicates with the inside of the storage portion 65 via the communication port 122 after the direction of the flow path is bent to the X-axis direction from the +Z-axis direction in the bending portion 166.

As illustrated in 12, in the tank 9, the first wall 81 of the case 61 may be divided into a first section 181 and a second section 182. In the embodiment, the first wall 81 is divided into two areas in the direction intersecting with the X-axis, for example, the first section 181 and the second section 182. The first section 181 is positioned in the second section 182 in the −X-axis direction. In other words, the first section 181 and the second section 182 are in a line in the X-axis direction. The first section 181 is provided with a supported portion 183 and two convex portions 185. In the following description, in a case of specifying the two convex portions 185, the two convex portions 185 are respectively referred to as a convex portion 185A and a convex portion 185B.

The convex portion 185A is positioned further from the convex portion 185B in the X-axis direction. The two convex portions 185 are in a line along the X-axis. The two convex portions 185 is projected to the side opposite to the second wall 82 side from the first wall 81, that is, to the −Z-axis direction from the first wall 81. The supported portion 183 is positioned closer to the bonding portion 64 side than the two convex portions 185, that is, closer to −Y-axis direction than two convex portions 185. The supported portion 183 is projected to the side opposite to the second wall 82 side from the first wall 81, that is, to the −Z-axis direction from the first wall 81. The supported portion 183 extends along the X-axis.

Figure 13:
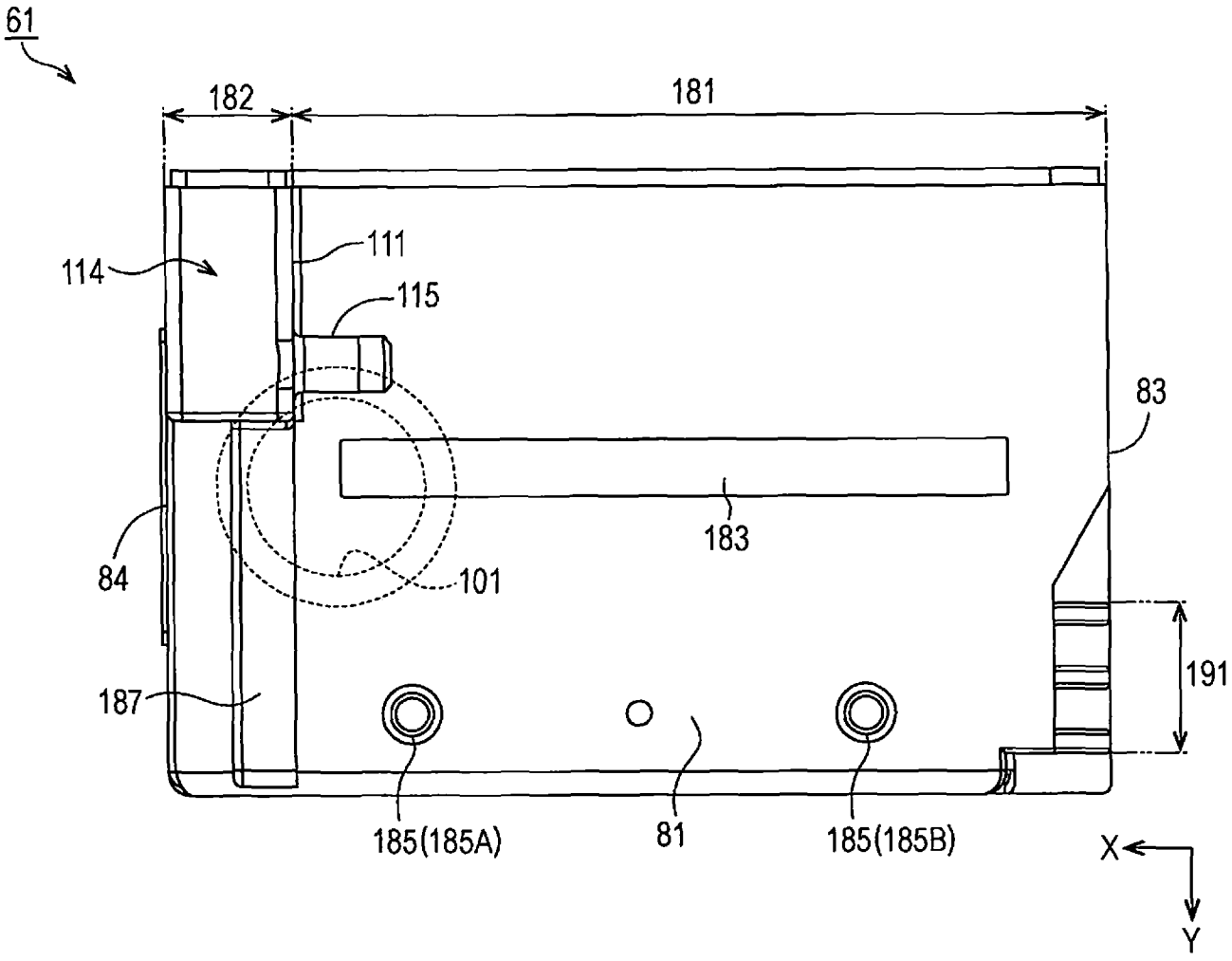
FIG. 13 is a bottom view of the case in the first embodiment.

The second section 182 is provided with a supply portion 114 and a first engaged portion 187. An area in which the supply portion 114 and the first engaged portion 187 are provided is considered the second section 182. For this reason, as illustrated in FIG. 13, the first section 181 is an area of the first wall 81 which is further from the supply portion 114 in the −X-axis direction. The supported portion 183 is positioned further from the connecting portion 115 in the Y-axis direction when viewing the first wall 81 in a planar view. In addition, the supported portion 183 is positioned further from the two convex portions 185 in the −Y-axis direction, when viewing the first wall 81 in a planar view. That is, the supported portion 183 is positioned between the connecting portion 115 and the two convex portions 185 in the Y-axis direction. In addition, the length of the supported portion 183 is longer than a gap between the two convex portions 185 in the X-axis direction.

Figure 14:
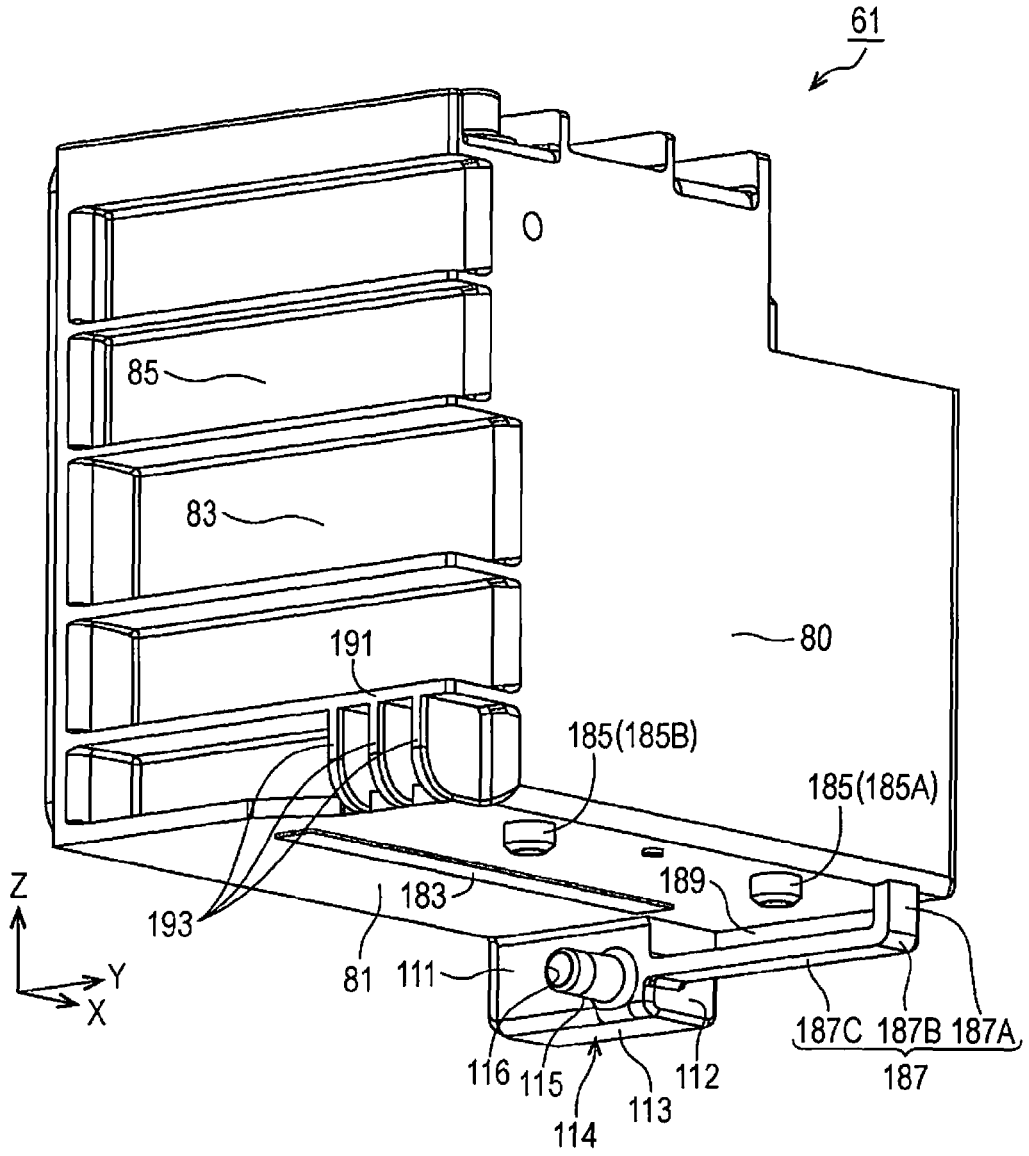
FIG. 14 is a perspective view illustrating the case in the first embodiment.

As illustrated in FIG. 14, the first engaged portion 187 is bridged between the first wall 81 and the ninth wall 112.

That is, one end of the first engaged portion 187 is connected to the first wall 81, and the other end is connected to the ninth wall 112. For example, the first engaged portion 187 may be divided into a first section 187A, a bending portion 187B, and a second section 187C. The first section 187A is projected to the −Z-axis direction from the first wall 81. For this reason, the first engaged portion 187 is projected to the −Z-axis direction from the first wall 81. The second section 187C is projected to the Y-axis direction from the ninth wall 112. The first section 187A and the second section 187C intersect with each other in the bending portion 187B. In other words, after being projected to the −Z-axis direction from the first wall 81, the first engaged portion 187 is bent in the −Y-axis direction, and is connected to the ninth wall 112.

Figure 15:
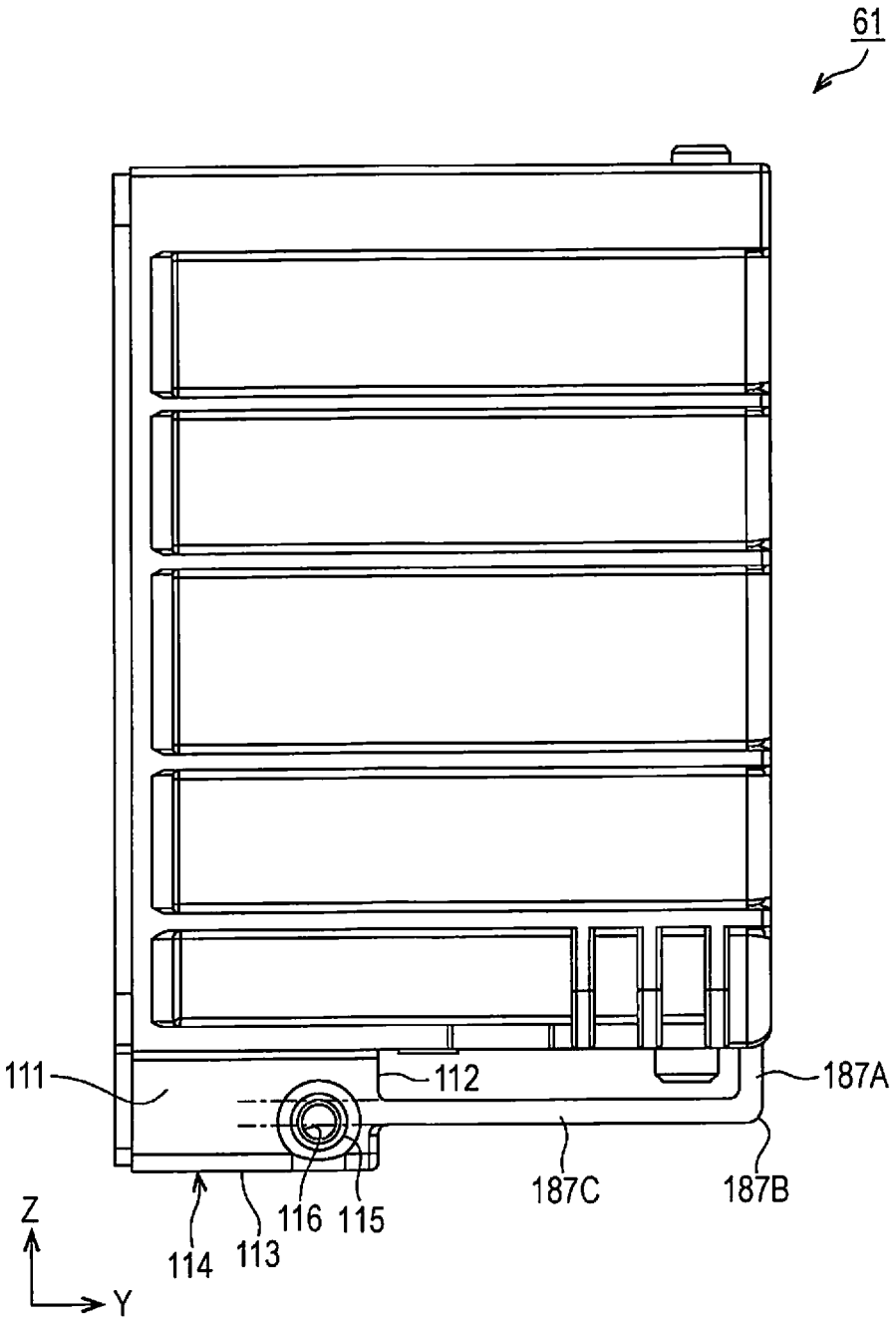
FIG. 15 is a side surface view illustrating the case in the first embodiment.

The second section 187C in the first engaged portion 187 is separated from the first wall 81. In other words, a gap is provided between the second section 187C in the first engaged portion 187 and the first wall 81. Note that, in the following description, gap is provided between the second section 187C in the first engaged portion 187 and the first wall 81 is referred to as the opening 189. The first engaged portion 187 is formed into a frame shape by the opening 189. In addition, the first engaged portion 187 is formed into a ring shape by the opening 189. For this reason, the first engaged portion 187 forms a frame having the ring shape by the opening 189. In addition, as illustrated in FIG. 15, when viewing the connecting portion 115 in the X-axis direction, the connecting portion 115 overlaps an area in which the second section 187C of the first engaged portion 187 extends in the −Y-axis direction. Further, the supply port 116 also overlaps an area in which the second section 187C of the first engaged portion 187 extends in the −Y-axis direction.

In addition, a form of the first engaged portion 187 is not limited to the frame shape or the ring shape. For example, the first section 187A and the bending portion 187B are not illustrated in FIG. 14, and the first engaged portion 187 may be formed into a rod shape such that the second section 187C is projected from the ninth wall 112. Alternately, the first engaged portion 187 may be formed into a hook shape such that the first section 187A and the bending portion 187B exist, but the second section 187C and the ninth wall 112 are not connected to each other, that is, a gap between the second section 187C and the ninth wall 112.

In addition, as illustrated in FIG. 14, the second engaged portion 191 is provided in the third wall 83 of the case 61. The second engaged portion 191 is formed into a plate shape which extends along the XY plane, and is projected to the −X-axis direction from the third wall 83. A rib 193 is provided in the second engaged portion 191 in the −Z-axis direction. The rib 193 is formed into a plate shape which extends along the XZ plane, and intersects with the third wall 83 and the second engaged portion 191. It is possible to improve rigidity of the second engaged portion 191 by the rib 193. Meanwhile, the first engaged portion 187 is positioned on the side opposite to the second engaged portion 191 by interposing the first section 181 (FIG. 13).

Figure 16:
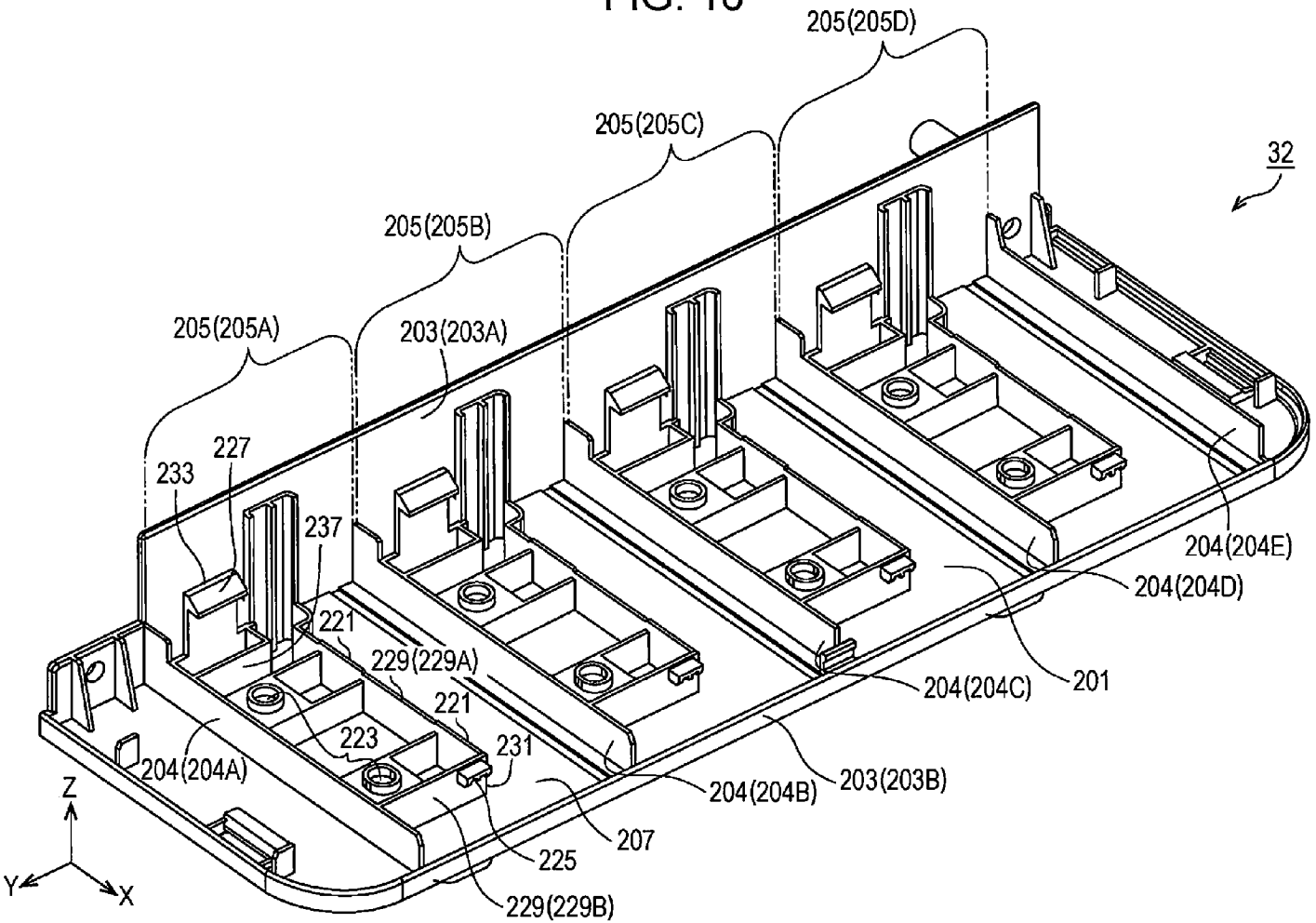
FIG. 16 is a perspective view illustrating a supporting frame in the first embodiment.

As illustrated in FIG. 16, the supporting frame 32 includes a base portion 201 having a plate shape, a partition wall 203 surrounds the base portion 201 along an outer frame of the base portion 201, and a plurality of partition walls 204 which divide the base portion 201 which is surrounded by the partition wall 203 into a plurality of areas. The partition wall 203 and the plurality of partition walls 204 are respectively projected to the Z-axis direction from the base portion 201. The plurality of partition walls 204 respectively extend along the X-axis, and cover a width along the X-axis the base portion 201. The plurality of partition walls 204 respectively cross the base portion 201 along the X-axis, and are connected to the inside of the partition wall 203. For this reason, one partition wall 204 divides the base portion 201 into two areas.

In addition, an area between the two partition walls 204 which are adjacent to each other along the Y-axis is divided as a tank disposition area 205 in which one tank 9 is disposed. In the embodiment, five partition walls 204 are provided. For this reason, the four tank disposition areas 205 are divided by these five partition walls 204. Each of the four tank disposition areas 205 is surrounded by the two partition walls 204 which are adjacent to each other, and the partition wall 203 along the Y-axis. In the following description, when specifying each of the plurality of partition walls 204, the plurality of partition walls 204 are respectively referred to as a partition wall 204A, a partition wall 204B, a partition wall 204C, a partition wall 204D, and a partition wall 204E. Similarly, when specifying each of the plurality of tank disposition areas 205, the plurality of tank disposition areas 205 are respectively referred to as a tank disposition area 205A, a tank disposition area 205B, a tank disposition area 205C, and a tank disposition area 205D.

The five partition walls 204 are in a line along the Y-axis. The partition wall 204A of the five partition walls 204 is positioned in the most Y-axis direction. The partition wall 204B is positioned further from the partition wall 204A in the −Y-axis direction. The partition wall 204C is positioned further from the partition wall 204B in the −Y-axis direction. The partition wall 204D is positioned further from the partition wall 204C in the −Y-axis direction. The partition wall 204E is positioned further from the partition wall 204D in the −Y-axis direction. Similarly, the four tank disposition areas 205 are also in a line along the Y-axis. The tank disposition area 205A of the four tank disposition areas 205 is positioned in the most Y-axis direction. The tank disposition area 205B is positioned further from the tank disposition area 205A in the −Y-axis direction. The tank disposition area 205C is positioned further from the tank disposition area 205B in the −Y-axis direction. The tank disposition area 205D is positioned further from the tank disposition area 205C in the −Y-axis direction. In the following description, an area which is positioned on the plurality of partition walls 204, of the partition wall 203 which surrounds the base portion 201, in the −X-axis direction is referred to as a partition wall 203A. In addition, an area which is positioned on the plurality of partition walls 204 of the partition wall 203 in the X-axis direction is referred to as a partition wall 203B.

A concave portion 207 is provided in each of the tank disposition areas 205. In addition, a plurality of mount portions 221, a plurality of concave portions 223, a first engaging portion 225, and a second engaging portion 227 are provided in each of the tank disposition areas 205. In addition, in the embodiment, two mount portions 221 and two concave portions 223 are provided.

The two mount portions 221 are provided on a mount wall 229 and are in a line along the X-axis. The mount wall 229 is formed into a plate shape which is projected to the Z-axis direction from the base portion 201. The mount wall 229 extends to the partition wall 203B side from the partition wall 203A side between the two partition walls 204 which are adjacent to each other, is bent by the bending portion 231, and then is connected to the partition wall 204, of the two partition walls 204 which are adjacent to each other, which is positioned in the Y-axis direction. The two mount portions 221 are provided on the mount wall 229A, of the mount wall 229, which extends along the X-axis. The two mount portions 221 are projected to the Z-axis direction from an end portion of the mount wall 229A in the Z-axis direction. The concave portion 207 is formed of the base portion 201, two partition walls 204 which divide the tank disposition area 205, the partition wall 203, and the mount wall 229. For this reason, the mount portion 221 is adjacent to the concave portion 207. In addition, the two partition walls 204 which divide the tank disposition area 205, the partition wall 203, and the mount wall 229 are respectively adjacent to the concave portion 207 as well. Accordingly, the first engaging portion 225 which is provided on the mount wall 229 is also adjacent to the concave portion 207.

A space in which the supply tube 43 is extendable is formed in a space between the mount wall 229 in the tank disposition area 205A and the partition wall 204B in the tank disposition area 205B which is adjacent to the tank disposition area 205A. The supply tube 43 is connected to the supply port 116 of the tank 9 by passing through a space between the mount wall 229 and the partition wall 203A. At this time, in a case where a shape of an area, of the mount wall 229, which is connected to the supply tube 43 is formed into a square shape, stress is applied to the area which is connected to the supply tube 43, and thus it is likely that the bent flow path is clocked, or the outer surface is damaged. Considering this, it is preferable that area, of the mount wall 229, which is connected to the supply tube 43 has a curvature. With this, it is possible to prevent the supply tube 43 from being bent and being damaged.

Figure 17:
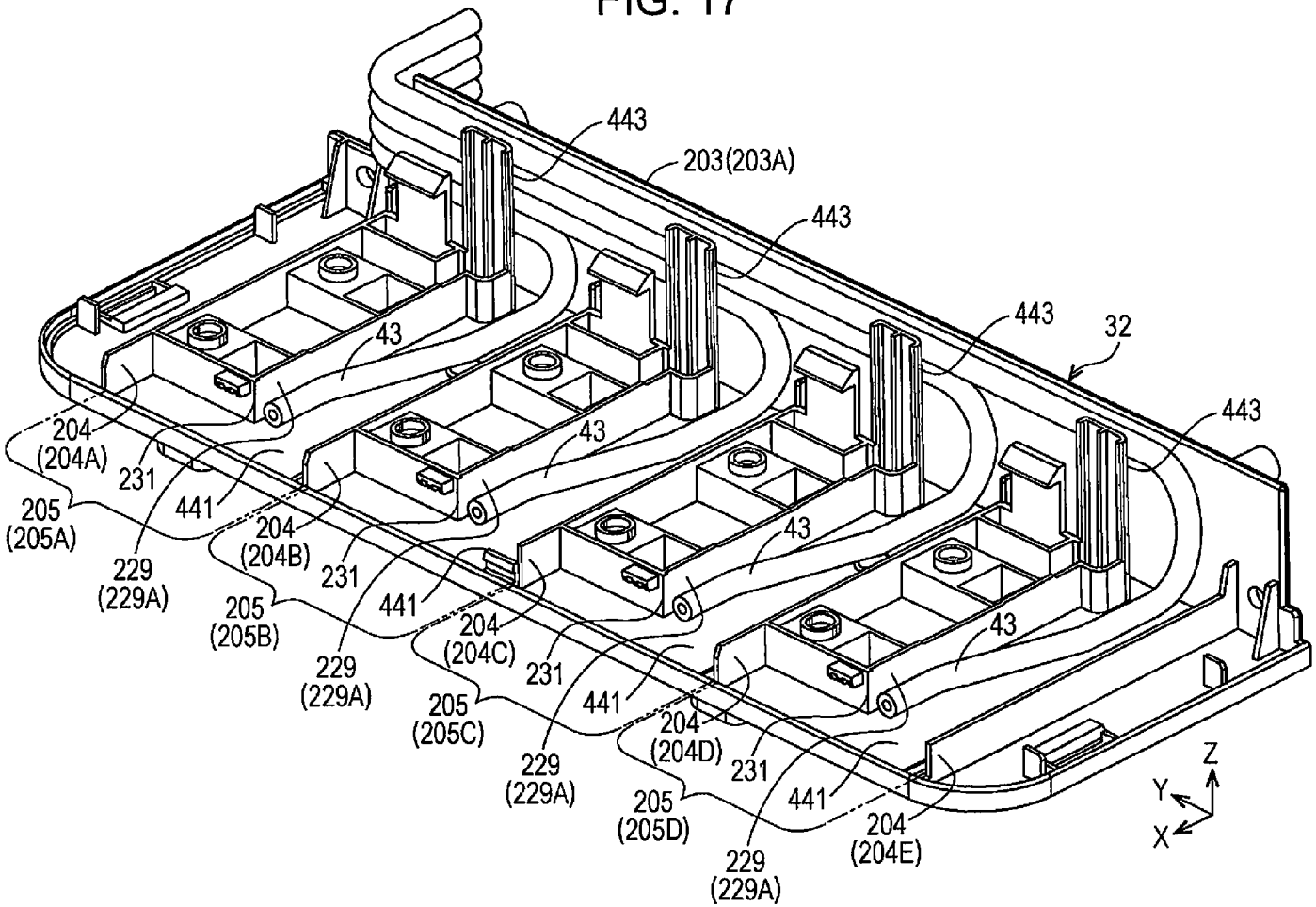
FIG. 17 is a perspective view illustrating the supporting frame and a supply tube in the first embodiment.

In the supporting frame 32, as illustrated in FIG. 17, the supply tube 43 is laid between the partition wall 204 and the mount wall 229A which is adjacent to the partition wall 204 in the Y-axis direction. A space between the partition wall 204 and the mount wall 229A which is adjacent to the partition wall 204 in the Y-axis direction corresponds to a space which is extendable in the supply tube 43 as described above. That is, the space between the mount wall 229 of the tank disposition area 205A and the partition wall 204B of the tank disposition area 205B which is adjacent to the tank disposition area 205A belongs the space between the partition wall 204 and the mount wall 229A which is adjacent to the partition wall 204 in the Y-axis direction. In the following description, the space between the partition wall 204 and the mount wall 229A which is adjacent to the partition wall 204 in the Y-axis direction is referred to as a plumbing area 441.

Figure 18:
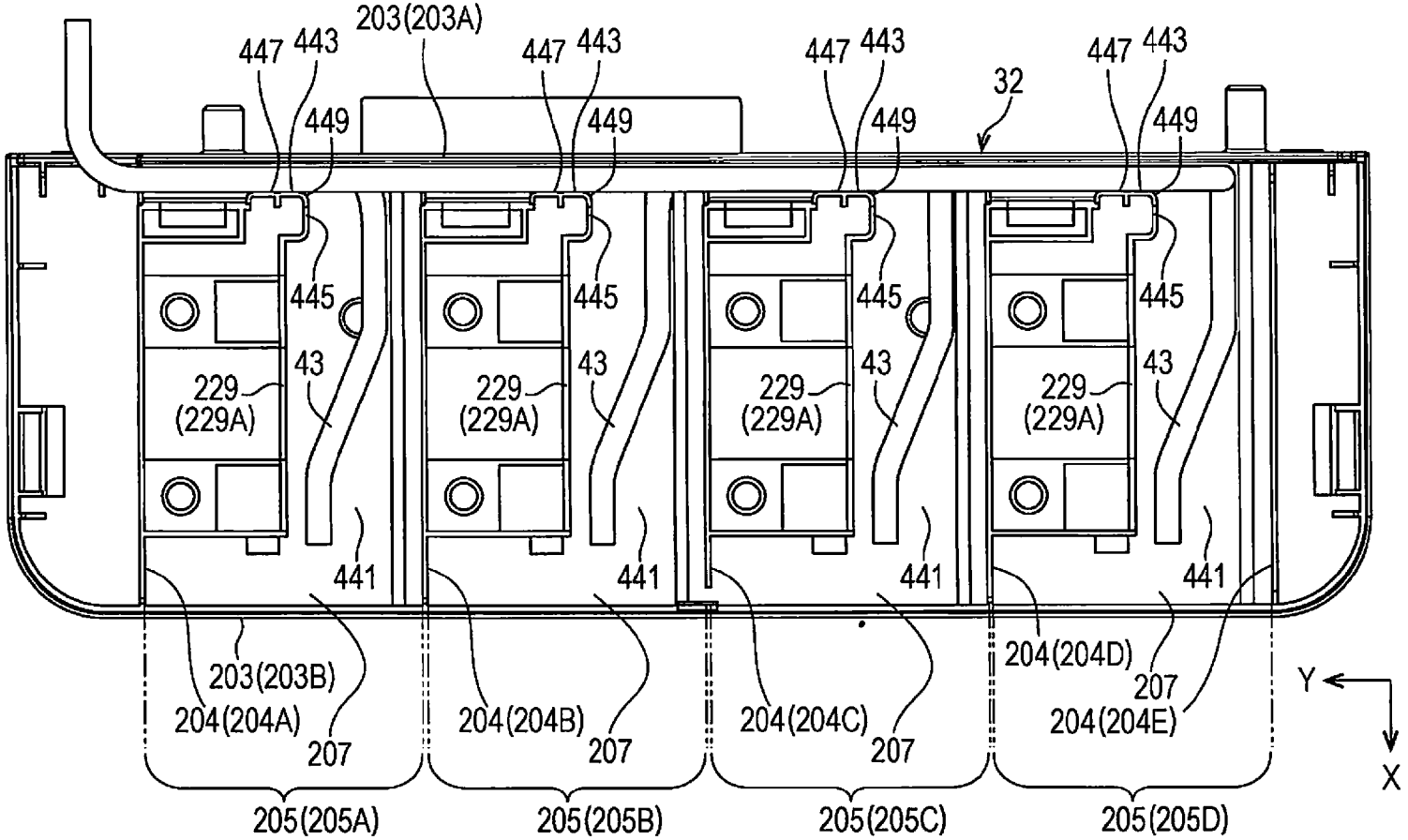
FIG. 18 is a plan view illustrating the supporting frame and the supply tube in the first embodiment.

A regulating portion 443 is provided in each of the tank disposition areas 205. The regulating portion 443 is projected to the Z-axis direction from the base portion 201. The regulating portion 443 is connected to the end portion of the mount wall 229A on the side opposite to the bending portion 231 of the mount wall 229A which extends along the X-axis. A gap is provided between the regulating portion 443 and the partition wall 203A, as illustrated in FIG. 18. The supply tube 43 which is laid in the plumbing area 441 is bent between the regulating portion 443 and the partition wall 203A, and then extends along the partition wall 203A. That is, the supply tube 43 which is laid in the plumbing area 441 is extend to the printer 3 (FIG. 1) side by passing through the space between the regulating portion 443 and the partition wall 203A.

The regulating portion 443 includes a first section 445 which is an area extending along the X-axis, and a second section 447 which is an area extending along the Y-axis. The first section 445 and the second section 447 are connected to each other via the bending portion 449. The bending portion 449 is formed into a curved-surface shape. In the embodiment, the bending portion 449 has a curvature. For this reason, when the supply tube 43 which is laid in the plumbing area 441 is bent between the regulating portion 443 and the partition wall 203A, even in a case where the supply tube 43 comes in contact with the bending portion 449 of the regulating portion 443, it is possible to prevent the supply tube 43 from being bent and being damaged. For example, when the bending portion 449 is formed into a square shape, as described above, when the supply tube 43 comes in contact with the bending portion 449, it is likely that the flow path of the supply tube 43 is clocked in the area which comes in contact with the bending portion 449, and the outer surface of the supply tube 43 is damaged. In contrast, in the embodiment, when the supply tube 43 is bent between the regulating portion 443 and the partition wall 203A, even in a case where the supply tube 43 comes in contact with the bending portion 449 of the regulating portion 443, it is possible to prevent the supply tube 43 from being bent or being damaged.

The first engaging portion 225 is provided on the mount wall 229B. The first engaging portion 225 is provided on the surface facing the partition wall 203B side of the mount wall 229B. The first engaging portion 225 is projected to the partition wall 203B side from the mount wall 229B. The two concave portions 223 is provided within the area which is interposed between the partition wall 204 which is positioned in the Y-axis direction, of the two partition walls 204 which are adjacent to each other, and the mount wall 229. The two concave portions 223 are provided further from the base portion 201 in the Z-axis direction. The two concave portions 223 are provided further from the base portion 201 in the Z-axis direction toward the base portion 201 side, that is, are recessed toward further from the base portion 201 from the Z-axis direction to the −Z-axis direction. The two concave portions 223 are in a line along the X-axis. In addition, the two concave portions 223 are positioned further from the two mount portions 221 in the Y-axis direction. The concave portion 223 which is positioned in the X-axis direction, of the two concave portions 223 and the mount portion 221, of the two mount portions 221, which is positioned in the X-axis direction are in a line along the Y-axis. In addition, the concave portion 223 which is positioned in the −X-axis direction, of the two concave portions 223 and the mount portion 221, of the two mount portions 221, which is positioned in the −X-axis direction are in a line along the Y-axis.

Figure 19:
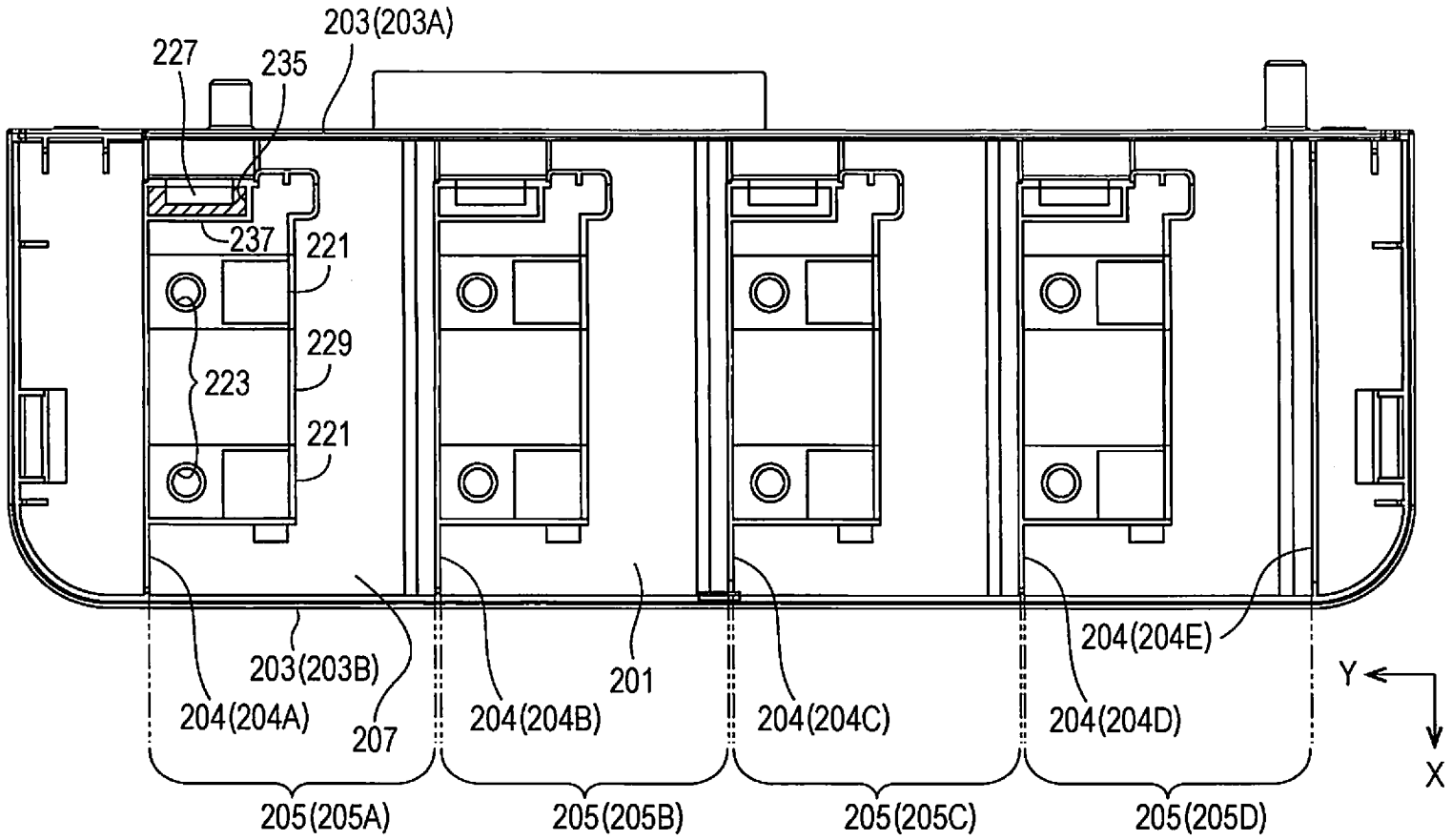
FIG. 19 is a plan view illustrating the supporting frame in the first embodiment.

The second engaging portion 227 is projected to the Z-axis direction from the base portion 201, and is formed into a plate shape which extends along the Y-axis. The second engaging portion 227 is positioned closer to the partition wall 203A side than the two concave portions 223. The second engaging portion 227 is projected to the Z-axis direction from the base portion 201, and bent to X-axis direction in the bending portion 233. With this, the second engaging portion 227 is formed into a hook shape which is projected to the Z-axis direction from the base portion 201. Here, in the supporting frame 32, as illustrated in FIG. 19, the opening 235 is formed for each the tank disposition area 205. Note that, the opening 235 is hatched for easy illustration of the configuration in FIG. 19. The opening 235 is provided in the second engaging portion 227 in the X-axis direction, that is, the concave portion 223 side of the second engaging portion 227.

The opening 235 is formed in the base portion 201, and passes through the base portion 201 along the Z-axis. The opening 235 is adjacent to the partition wall 204, of the two partition walls 204 which are adjacent to each other, which is positioned in the Y-axis direction and the second engaging portion 227. In addition, the second partition wall 237 is provided in the opening 235 in the −Y-axis direction and in the opening 235 in the X-axis direction. The second partition wall 237 is adjacent to the opening 235. The second partition wall 237 is connected to the second engaging portion 227 and the partition wall 204, of the two partition walls 204 which are adjacent to each other, which are positioned in the Y-axis direction. In addition, the second engaging portion 227 is connected to the partition wall 204, of the two partition walls 204 which are adjacent to each other, which are positioned in the Y-axis direction. For this reason, the opening 235 is surrounded by the partition wall 204, of the two partition walls 204 which are adjacent to each other, which is positioned in the Y-axis direction, the second engaging portion 227, and the second partition wall 237. The second partition wall 237 is projected to the Z-axis direction from the base portion 201, as illustrated in FIG. 16.

Figure 20:
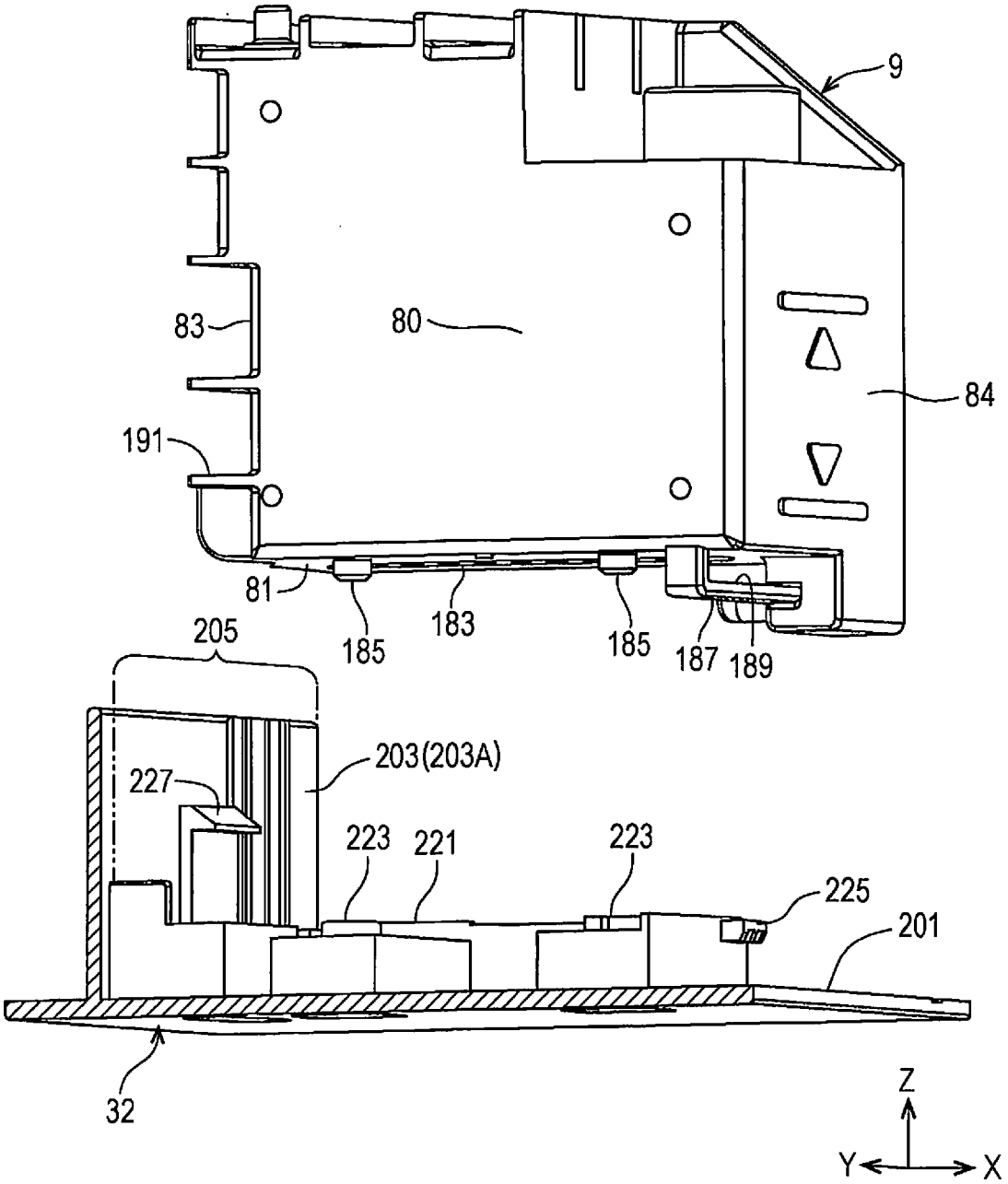
FIG. 20 is an exploded perspective view of the tank and the supporting frame in the first embodiment.

A method of disposing the tank 9 in the tank disposition area 205 of the supporting frame 32 will be described. When the tank 9 is discharge in the tank disposition area 205, as illustrated in FIG. 20, the first wall 81 of the tank 9 is directed toward the base portion 201 of the supporting frame 32. Note that, for easy illustration of the configuration, a state where the supporting frame 32 is partially cut is illustrated in FIG. 20. Further, when the tank 9 is disposed in the tank disposition area 205, the supported portion 183 of the tank 9 is directed toward the two mount portions 221 of the supporting frame 32. In addition, the two convex portions 185 of the tank 9 are provided in the two concave portions 223 of the supporting frame 32. With this, the first engaged portion 187 of the tank 9 faces the first engaging portion 225 of the supporting frame 32, and the second engaged portion 191 of the tank 9 faces the second engaging portion 227 of the supporting frame 32. As described above, the direction of the tank 9 with respect to the supporting frame 32 is determined.

Figure 21:
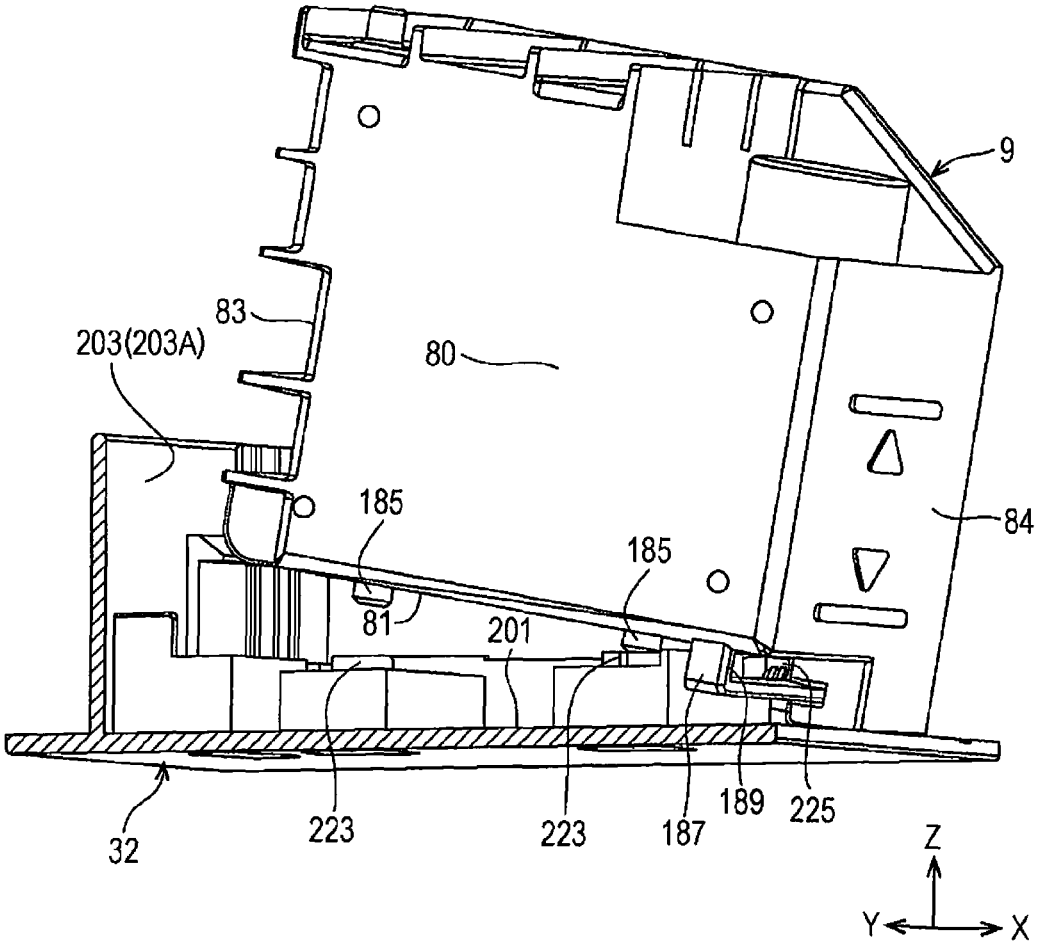
FIG. 21 is an exploded perspective view of the tank and the supporting frame in the first embodiment.

In a state where the direction of the tank 9 with respect to the supporting frame 32 is determined, and subsequently, the tank 9 is inclined with respect to the supporting frame 32 as illustrated in FIG. 21. At this time, the tank 9 is inclined to the direction close to the base portion 201 of the supporting frame 32 as being directed to the fourth wall 84 side from the third wall 83 side of the tank 9 along the first wall 81 of the tank 9. In a state where the tank 9 is inclined with respect to the supporting frame 32, the first engaging portion 225 of the supporting frame 32, from the second engaged portion 191 side further form the first engaged portion 187, is inserted into the opening 189 of the first engaged portion 187. With this, the first engaged portion 187 of the tank 9 and the first engaging portion 225 of the supporting frame 32 are engaged with each other.

Figure 22:
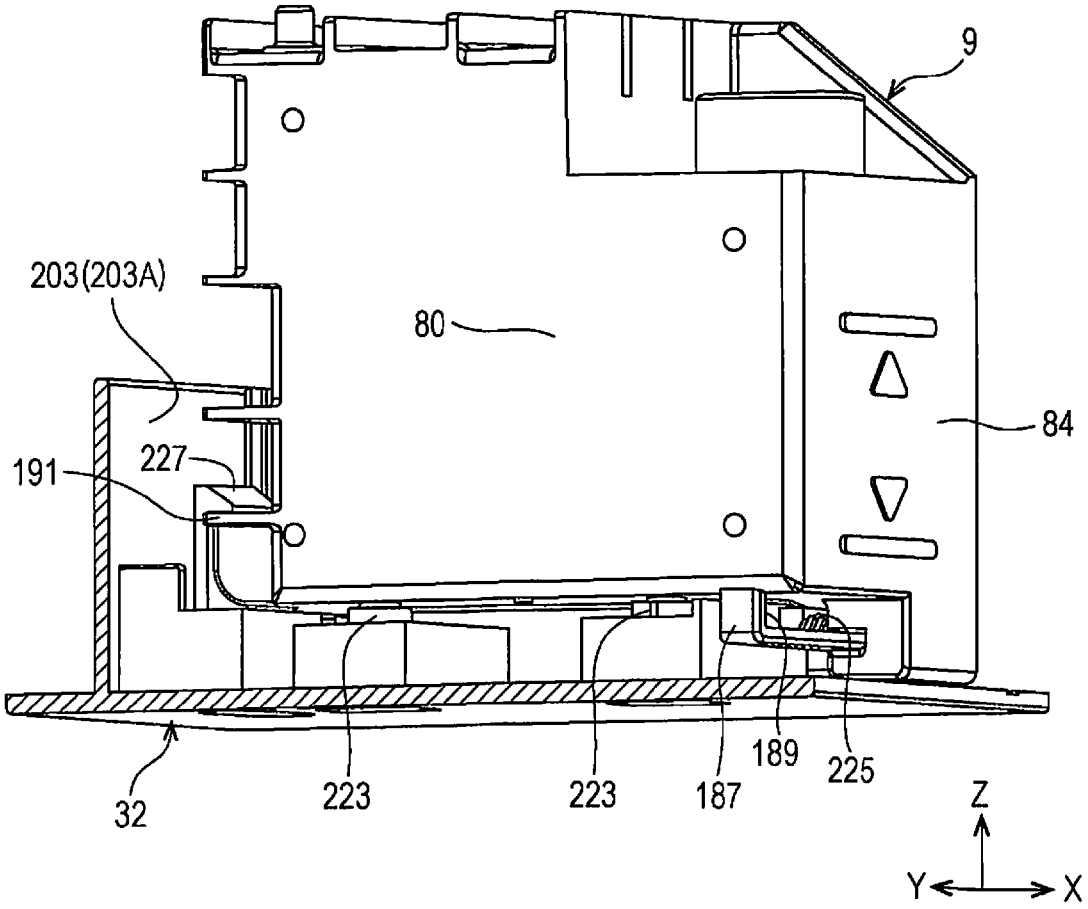
FIG. 22 is an exploded perspective view of the tank and the supporting frame in the first embodiment.

In addition, in a state where the first engaged portion 187 and the first engaging portion 225 are engaged with each other, the second engaged portion 191 of the tank 9 is engaged with the second engaging portion 227 of the supporting frame 32 by pressing down the tank 9 to the supporting frame 32 side, as illustrated in FIG. 22. At this time, the two convex portions 185 (FIG. 20) of the tank 9 is inserted into the two concave portions 223 of the supporting frame 32. In addition, at this time, the supported portion 183 (FIG. 20) of the tank 9 comes in contact with the two mount portions 221 of the supporting frame 32. As described above, the tank 9 is disposed in the tank disposition area 205 of the supporting frame 32. In addition, the first engaging portion 225 of the supporting frame 32 is inserted into the first engaged portion 187 of the tank 9, the two convex portions 185 are inserted into the two concave portions 223, and the second engaged portion 191 is engaged with the second engaging portion 227, and thus the tank 9 is fixed to the supporting frame 32. Meanwhile, in a state where the first engaging portion 225 of the supporting frame 32 is inserted into the first engaged portion 187 of the tank 9, a gap is provided between the first engaged portion 187 and the first engaging portion 225.

In the embodiment, as illustrated in FIG. 16, the concave portion 207 is formed in the supporting frame 32. The concave portion 207 is adjacent to the mount wall 229 on which the mount portion 221 is provided. With such a configuration, for example, when the ink is injected to the tank 9 from the ink injecting portion 101 of the tank 9, it is possible to store ink which is spilled out along the outer wall of the tank 9 in the concave portion 207 via the mount wall 229 on which the mount portion 221 is provided. With this, it is likely to prevent the ink from leaking to the outside of the tank unit 5. As a result, it is likely to suppress dirty due to the liquid.

In addition, in the embodiment, the first engaging portion 225 which is provided on the mount wall 229 is also adjacent to the concave portion 207, as illustrated in FIG. 16. With such a configuration, for example, when the ink is injected to the tank 9 from the ink injecting portion 101 of the tank 9, it is possible to store the ink which is spilled out along the outer wall of the tank 9 in the concave portion 207 via the first engaging portion 225. With this, it is likely to prevent the ink from leaking to the outside of the tank unit 5. As a result, it is likely to suppress dirty due to the liquid.

Further, in the embodiment, as illustrated in FIG. 13, the ink injecting portion 101 is positioned in the area closer to the fourth wall 84 than the third wall 83. In addition, as illustrated in FIG. 16, the first engaging portion 225 is positioned in the area closer to the fourth wall 84 than the third wall 83. For this reason, it is likely that the ink which is spilled out from the ink injecting portion 101 reaches the first engaging portion 225. Therefore, it is likely to guide the ink which is spilled out from the ink injecting portion 101 to the concave portion via the first engaging portion 225.

In addition, in the embodiment, as illustrated in FIG. 19, the opening 235 is formed in the supporting frame 32, and the second partition wall 237 which is adjacent to the opening 235 is provided in the supporting frame 32. With such a configuration, it is likely to guide the ink which is spilled out along the outer wall of the tank 9 from the ink injecting portion 101 to the concave portion via the second partition wall 237. For this reason, even in a case where the opening 235 is provided in the supporting frame 32, it is possible to prevent the ink which is spilled out from the ink injecting portion 101 from leaking to the outside via the opening 235. In addition, the second partition wall 237 and the partition wall 204A surround the opening 235, and thus it is likely to prevent the ink which is stored in the concave portion 207 from entering the opening 235.

In addition, in the embodiment, the ink injecting portion 101 is positioned in the area closer to the fourth wall 84 than the third wall 83. In addition, the opening 235 of the supporting frame 32 is positioned in the area closer to the fourth wall 84 than the third wall 83. With such a configuration, the opening 235 is positioned in the area closer to the third wall 83 than the fourth wall 84 while the ink injecting portion 101 is positioned in the area closer to the fourth wall 84 than the third wall 83, and thus it is likely that the ink injecting portion 101 are the opening 235 are away from each other. With this, it is likely to further prevent the liquid, which is spilled out from the ink injecting portion 101, from leaking to the outside via the opening 235.

Figure 23:
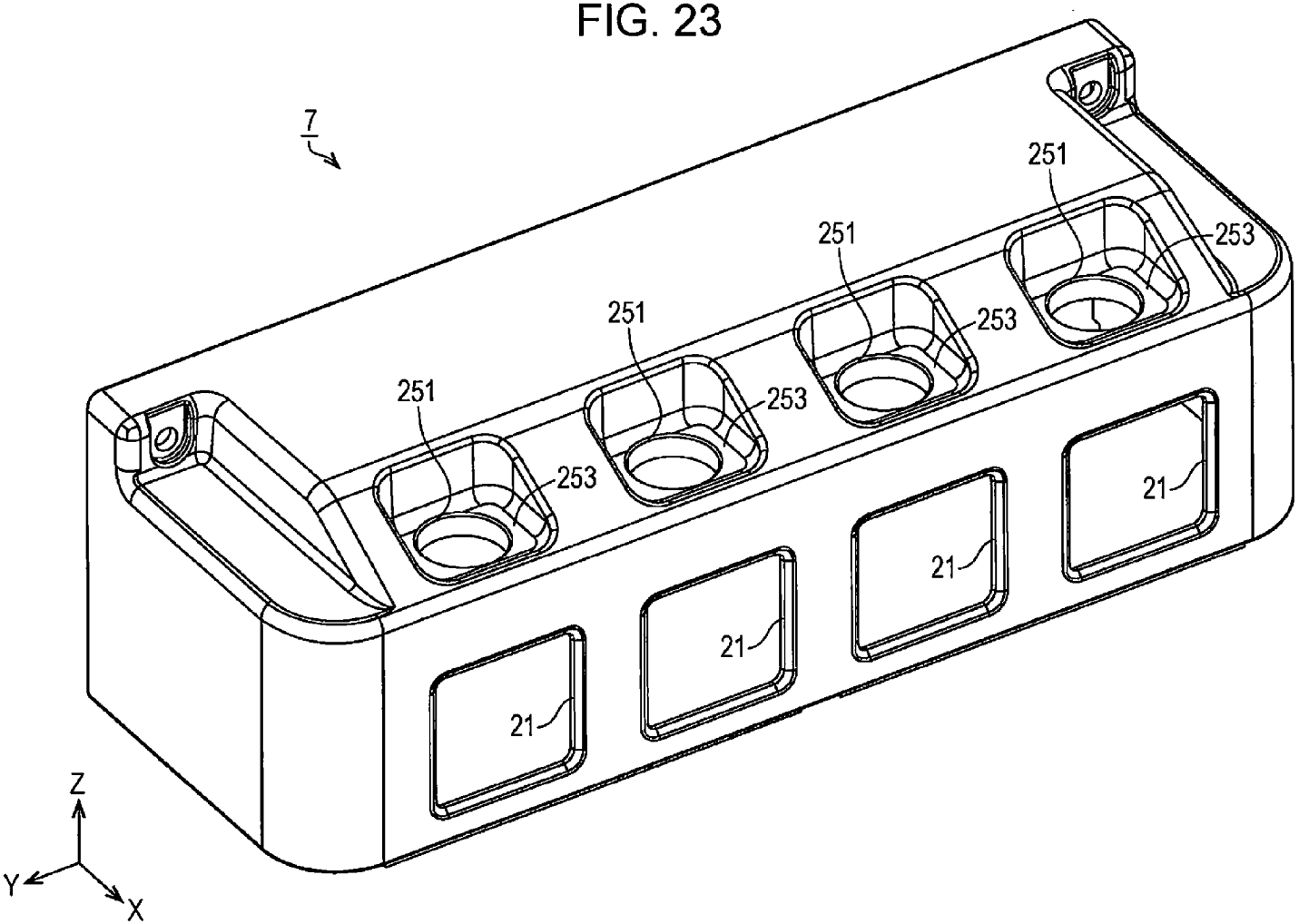
FIG. 23 is a perspective view illustrating a second case in the first embodiment.
Figure 24:
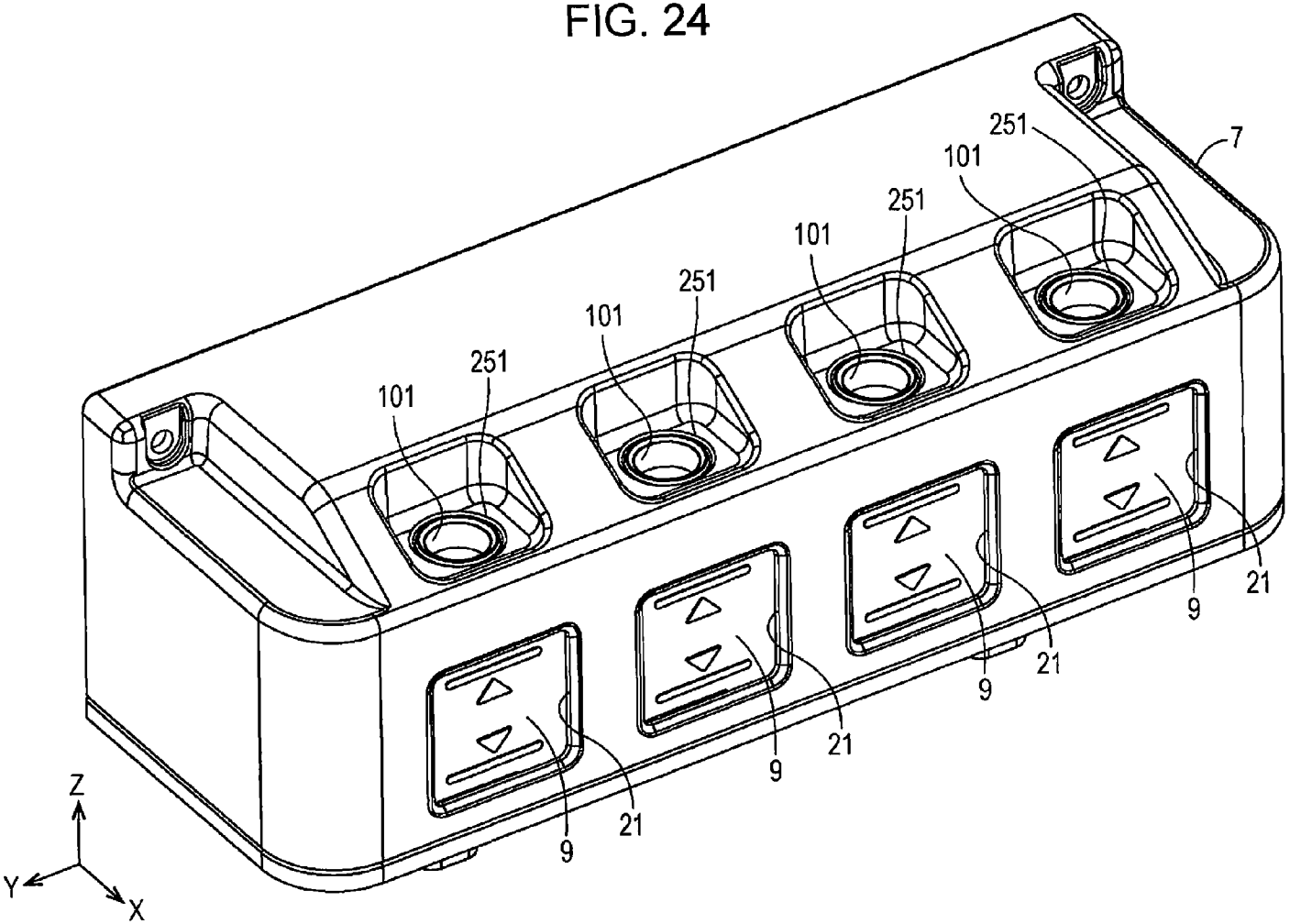
FIG. 24 is a perspective view illustrating the tank, the supporting frame, and the second case in the first embodiment.

As illustrated in FIG. 23, four openings 251 are formed in the second case 7. Each of the four openings 251 is formed in the concave portion 253 which is formed in the second case 7. Each of the four openings 251 is provided an area overlapping the ink injecting portion 101 of the respective tanks 9. Each of the four openings 251 passes through the second case 7. For this reason, as illustrated in FIG. 24, the ink injecting portion 101 of the respective tanks 9 is exposed to the outside of the second case 7 via the opening 251. For this reason, an operator can inject the ink in the tank 9 from the ink injecting portion 101 through the second case 7 in a state where the tank 9 is stored in the second case 7.

Figure 25:
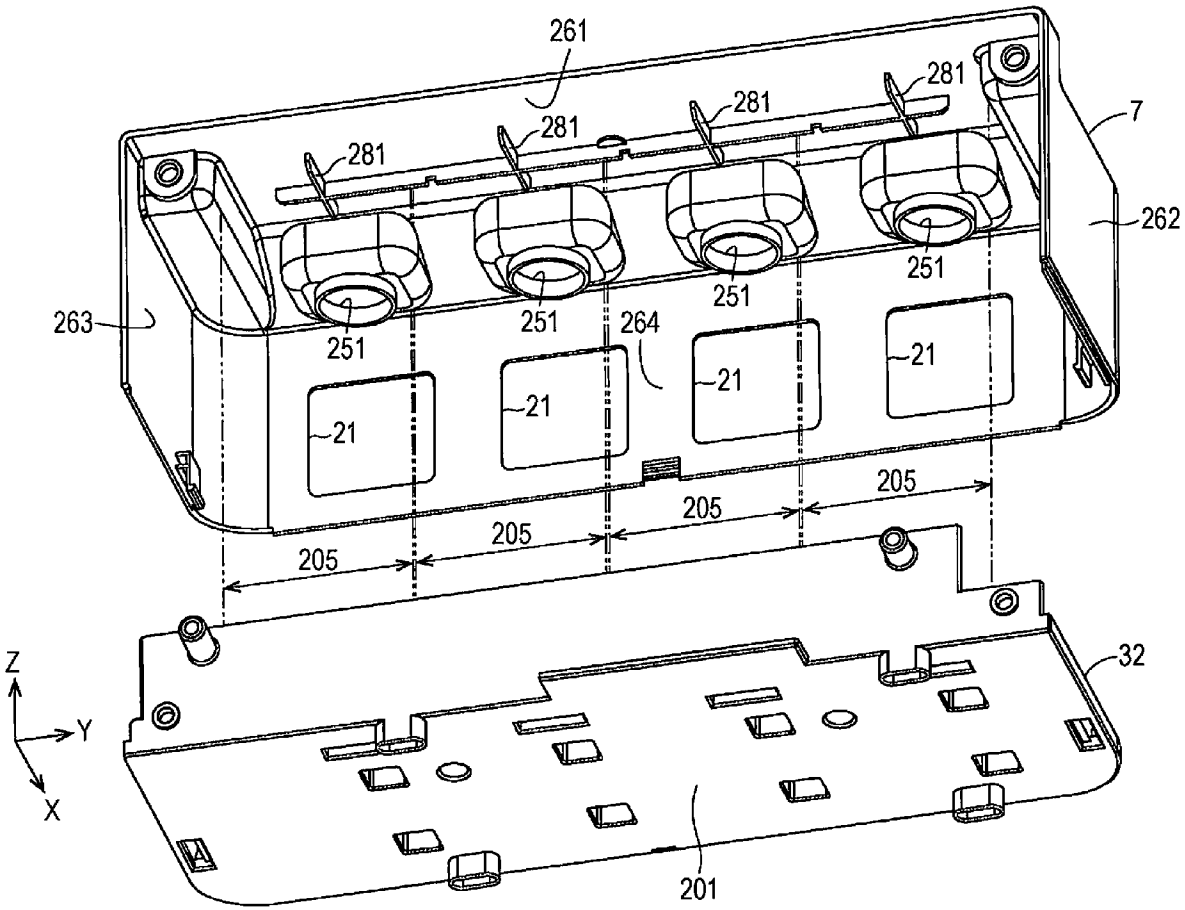
FIG. 25 is an exploded perspective view illustrating the supporting frame and the second case in the first embodiment.

The second case 7 is provided in the supporting frame 32 in the Z-axis direction as illustrated in FIG. 25. The second case 7 is formed so as to be fit into the supporting frame 32. The second case 7 is provided with the first wall 261, the second wall 262, the third wall 263, and the fourth wall 264. The first wall 261 faces the base portion 201 of the supporting frame 32. The four openings 251 are formed in the first wall 261. Each of the second wall 262, the third wall 263, and the fourth wall 264 intersects with the first wall 261. Each of the second wall 262, the third wall 263, and the fourth wall 264 is projected to the −Z-axis direction from the first wall 261, that is, the supporting frame 32 side. Note that, each of the first walls 261 to the fourth wall 264 may include unevenness on the surface thereof without being limited to a flat wall.

The second wall 262 and the third wall 263 face each other along the Y-axis. The second wall 262 is positioned further from the third wall 263 in the Y-axis direction. The fourth wall 264 is provided in the first wall 261 in the X-axis direction, and intersects with each of the second wall 262 and the third wall 263. Four window portions 21 are formed on the fourth wall 264. In the second case 7, an area which is surrounded by the first wall 261, the second wall 262, the third wall 263, and the fourth wall 264 is referred to as the inside of the second case 7.

The first wall 261 is provided with a plurality of projecting portions 281. In the embodiment, four projecting portions 281 are provided. The four projecting portions 281 are provided in the inside of the second case 7. The four projecting portions 281 projected to the supporting frame 32 side from the first wall 261, that is, to the −Z-axis direction from the first wall 261. Each of the four projecting portions 281 is formed into a plate shape, and extends along the X-axis. The four projecting portions 281 are in a line along the Y-axis. Each of the four projecting portions 281 is provided in each of the four tank disposition areas 205. In other words, one of the projecting portions 281 is provided in one of the tank disposition area 205.

Figure 26:
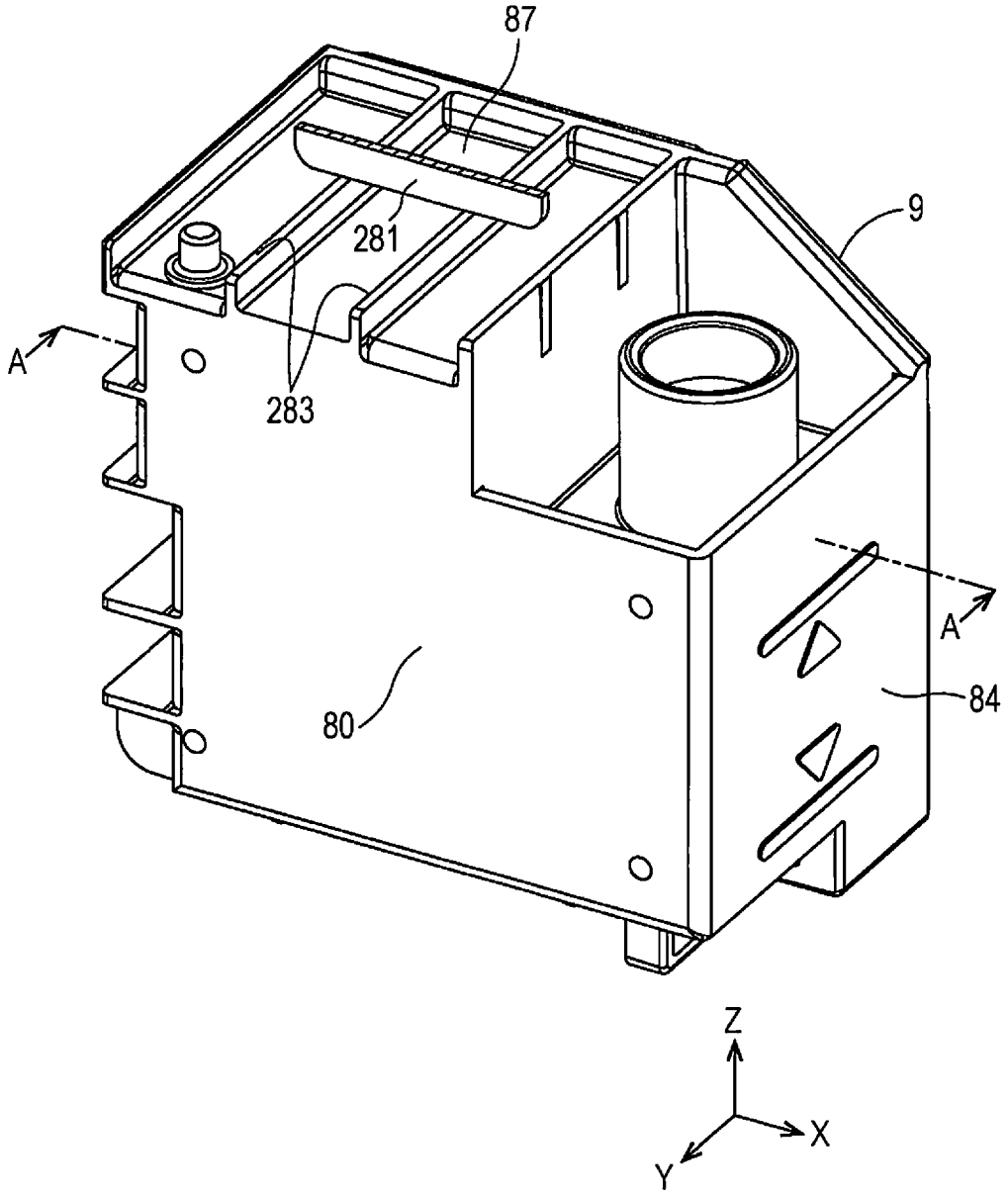
FIG. 26 is a perspective view illustrating the tank and a projecting portion in the first embodiment.

The projecting portion 281 is provided in as area overlapping the seventh wall 87 when viewing the seventh wall 87 of the tank 9 in a planar view, as illustrated in FIG. 26. In addition, for easy illustration of the configuration, a state where the projecting portion 281 is cut out from the second case 7 is illustrated in FIG. 26. The tank 9 is provided with a plurality of ribs 283 on the seventh wall 87. The plurality of ribs 283 projected to the Z-axis direction from the seventh wall 87. Each of the plurality of ribs 283 extends along the Y-axis. The projecting portion 281 is positioned in the plurality of ribs 283 in the Z-axis direction, and intersects with the plurality of ribs 283.

Figure 27:
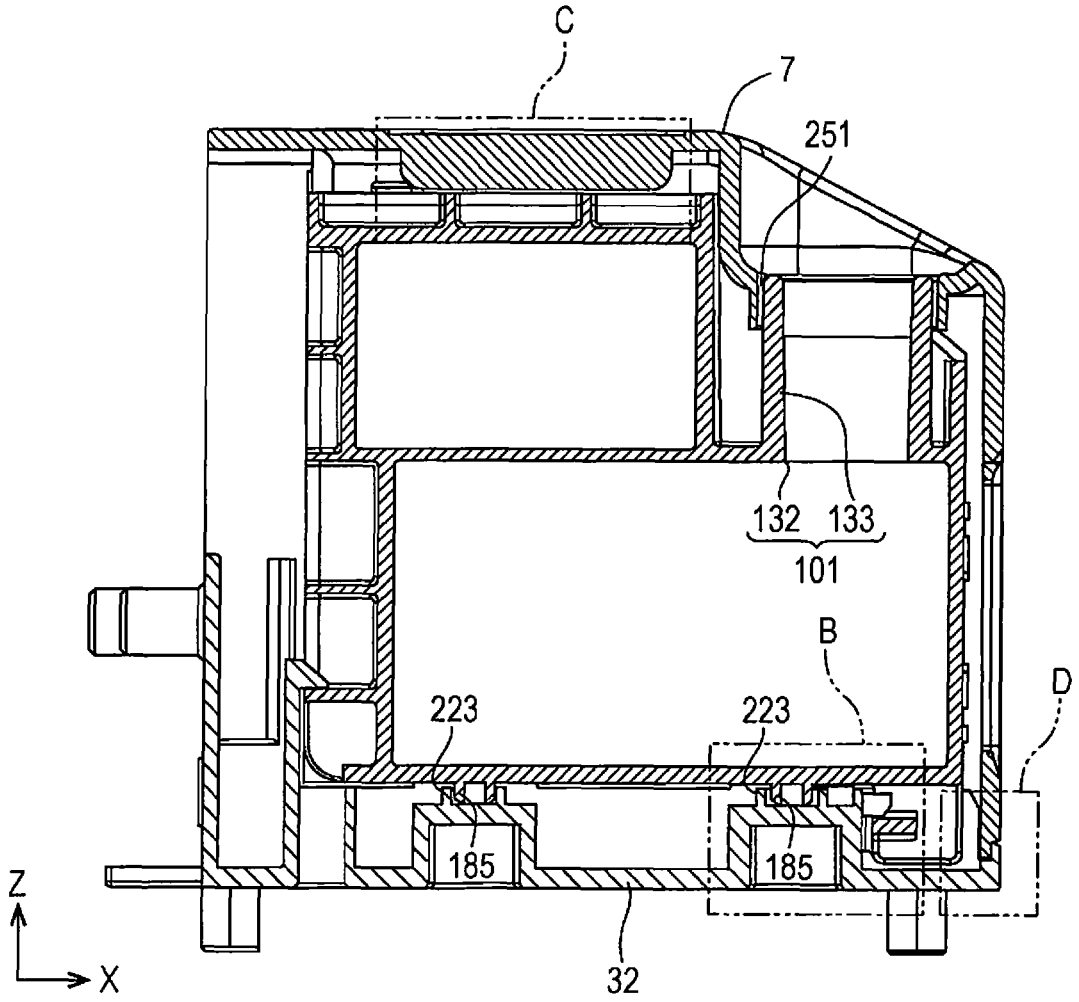
FIG. 27 is a sectional view when the tank, the supporting frame, and the second case are cut along A-A line in FIG. 26 in the first embodiment.

When the tank 9 is disposed in the tank disposition area 205 of the supporting frame 32, and the second case 7 is fitted into the supporting frame 32, it is possible to store the tank 9 between the supporting frame 32 and the second case 7. At this time, as illustrated in FIG. 27 which is a sectional view when the tank 9, the supporting frame 32, and the second case 7 are cut along A-A line in FIG. 26, the side wall 133 of the ink injecting portion 101 in the tank 9 is inserted into the opening 251 of the second case 7. Note that, FIG. 27 illustrates a state where, the tank 9, the supporting frame 32, and the second case 7 are cut along the XZ plane passing through the two convex portions 185 of the tank 9 and the XZ plane passing through the ink injecting portion 101.

Figure 28:
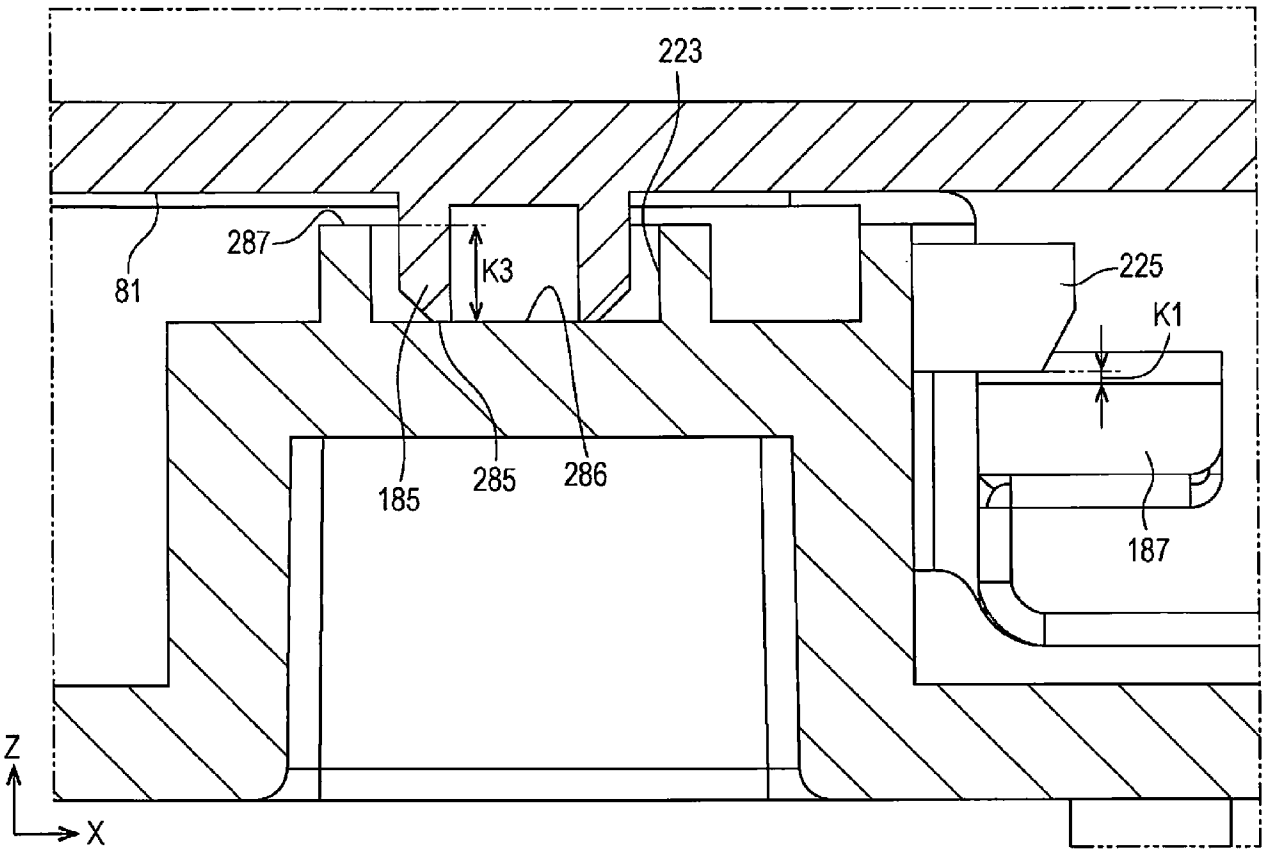
FIG. 28 is an enlarged view of a B part in FIG. 27.

When the tank 9 is stored between the supporting frame 32 and the second case 7, as described above, the supported portion 183 (FIG. 14) of the tank 9 comes in contact with the two mount portions 221 (FIG. 16) of the supporting frame 32. In addition, in each of the two convex portions 185 of the tank 9, as illustrated in FIG. 28 which is an enlarged view of a B portion in FIG. 27, the endmost portion 285 in the convex portion 185 in the −Z-axis direction lands on the bottom portion 286 in the concave portion 223 of the supporting frame 32. With this, a position of the tank 9 along the Z-axis is determined with respect to the supporting frame 32. At this time, a gap is provided between the concave portion 223 and the convex portion 185. In addition, a gap is provided between the endmost portion 287 of the concave portion 223 in Z-axis direction and the first wall 81 of the tank 9. Further, at this time, a gap is provided, along the Z-axis, also between the first engaging portion 225 of the supporting frame 32 and the first engaged portion 187 of the tank 9. In the following description, a gap distance, which is along the Z-axis, between the first engaging portion 225 and the first engaged portion 187 is referred to as a distance K1.

Meanwhile, in the embodiment, as illustrated in FIG. 28, the endmost portion 285 of the convex portion 185 lands on the bottom portion 286 in the concave portion 223, and it is set that a gap is provided between the endmost portion 287 of the concave portion 223 and the first wall 81 of the tank 9. However, a setting is not limited to the above setting, for example, it may be set that the endmost portion 287 of the concave portion 223 and the first wall 81 of the tank 9 come in contact with each other, and a gap is provided between the endmost portion 285 of the convex portion 185 and the bottom portion 286 in the concave portion 223. In this setting, the position of the tank 9 along the Z-axis is determined with respect to the supporting frame 32.

Figure 29:
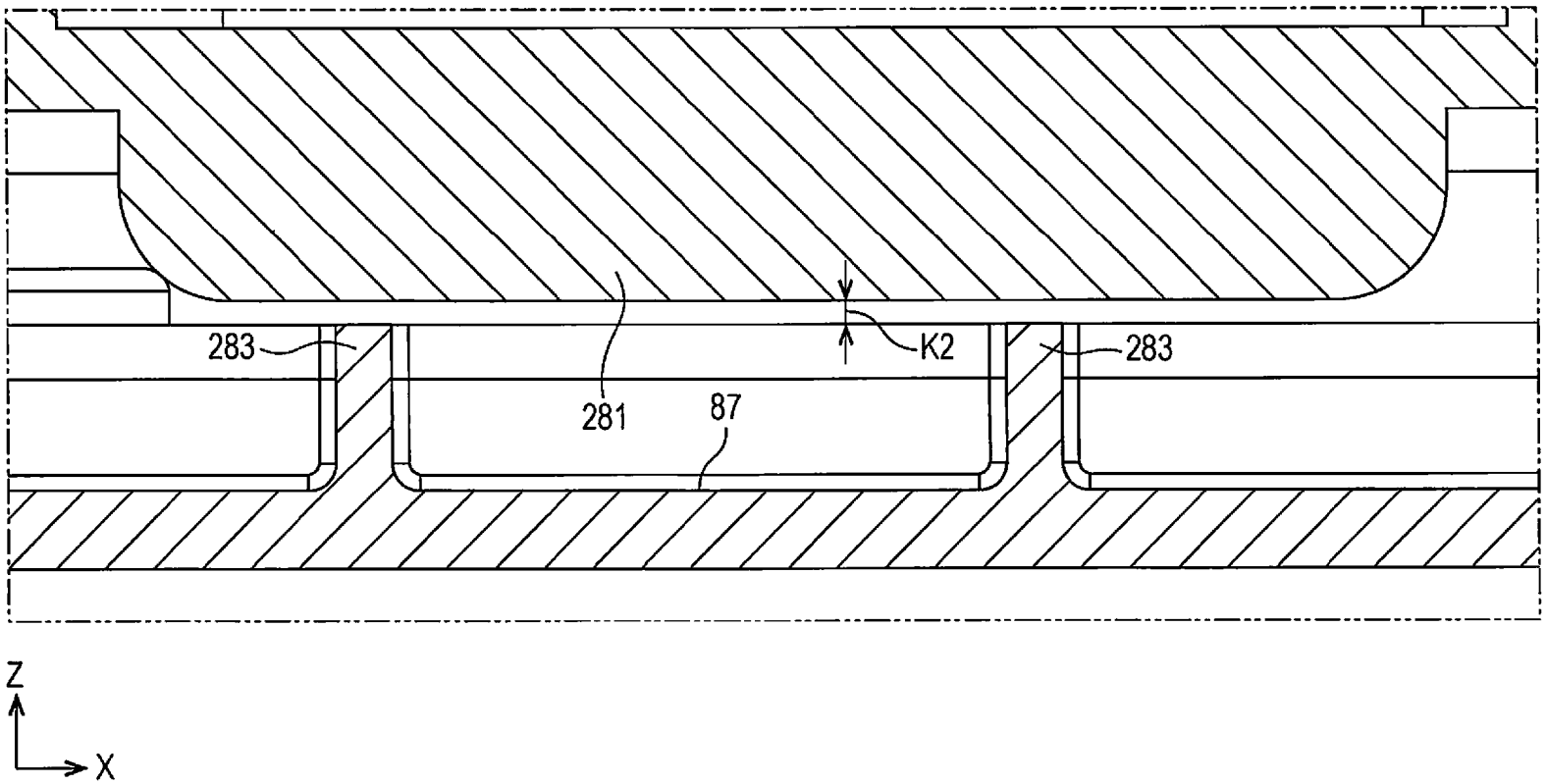
FIG. 29 is an enlarged view of a C part in FIG. 27.

In addition, in the tank 9, as illustrated in FIG. 29 which is an enlarged view of a C portion in FIG. 27, a gap is provided between the rib 283 and the projecting portion 281. In the following description, a gap distance, which is along the Z-axis, between the rib 283 and the projecting portion 281 is referred to as a distance K2. The distance K2 can be considered a distance between the tank 9 and the second case 7 in the Z-axis direction. In addition, in each of the two convex portions 185 of the tank 9, the distance, which is along the Z-axis, between the endmost portion 285 and the endmost portion 287 is referred to as a distance K3.

In the embodiment, when a force acts on the tank 9 in the Z-axis direction, the position of the tank 9 with respect to the supporting frame 32 is changed to the Z-axis direction in some cases. This is because that it is difficult to firmly fix the force between the tank 9 and the supporting frame 32 when the second engaging portion 227 and the second engaged portion 191 are engaged with each other. However, in the embodiment, in a case where the position of the tank 9 with respect to the supporting frame 32 is changed to the Z-axis direction, the rib 283 (FIG. 29) of the tank 9 is capable of coming in contact with the projecting portion 281 of the second case 7. With this, it is possible to regulate displacement of the tank 9 in the Z-axis direction.

In addition, in the embodiment, in a case where the position of the tank 9 with respect to the supporting frame 32 is changed to the Z-axis direction, the first engaged portion 187 (FIG. 28) of the tank 9 is capable of coming in contact with the first engaging portion 225 of the supporting frame 32. With this, it is possible to regulate displacement of the tank 9 in the Z-axis direction. With this, it is possible to omit a component such as a screw for attaching the tank 9 to the supporting frame 32, and thus it is likely to reduce the number of components. In addition, since it is possible to omit a component for attaching the tank 9 to the supporting frame 32, it is possible to reduce labor for attaching the tank 9 to the supporting frame 32.

In addition, in the embodiment, the distance K2 is shorter than the distance K3. Therefore, even in a case where the position of the tank 9 with respect to the supporting frame 32 or the second case 7 is deviated in Z-axis direction, the tank 9 is regulated by the second case 7 before the convex portion 185 is deviated from the concave portion 223. Accordingly, it is possible to reduce the deviation of the position of the tank 9 with respect to the supporting frame 32 or the second case 7 from a predetermined range.

In addition, in the embodiment, the distance K1 is shorter than the distance K3. With this, even in a case where the position of the tank 9 with respect to the supporting frame 32 or the second case 7 is deviated in the Z-axis direction, the tank 9 is regulated by the supporting frame 32 before the convex portion 185 is deviated from the concave portion 223. Accordingly, it is possible to reduce the deviation of the position of the tank 9 with respect to the supporting frame 32 or the second case 7 from a predetermined range.

Further, in the embodiment, the convex portion 185 is inserted into the concave portion 223, and thus it is possible to regulate the displacement of the position of the tank 9 with respect to the supporting frame 32 or the second case 7, which is changed to the X-axis direction or the −X-axis direction, and changed to the Y-axis direction or the −Y-axis direction. In addition, in the embodiment, each of the two convex portions 185 is inserted into each of the two concave portions 223, and thus, for example, it is likely to prevent the tank 9 from rotating around the insertion of the convex portion 185A (FIG. 14) into the concave portion 223 with respect to the supporting frame 32.

In the embodiment, the first engaged portion 187 is positioned in the area closer to the fourth wall 84 than the third wall 83 as illustrated in FIG. 13. In addition, the second engaged portion 191 is positioned in the area closer to the third wall 83 than the fourth wall 84. With this, the position of the tank 9 with respect to the supporting frame 32 in the Z-axis direction is regulated by the first engaged portion 187 which is positioned in the area closer to the fourth wall 84 than the third wall 83, the second engaged portion 191 which is positioned in the area closer to the third wall 83 than the fourth wall 84. As a result, it is likely to improve accuracy of the position of the tank 9 with respect to the supporting frame 32 in the Z-axis direction.

In addition, in the embodiment, the connecting portion 115 is positioned in the area close to the fourth wall 84 than the third wall 83, as illustrated in FIG. 13. In addition, the first engaged portion 187 is positioned in the area closer to the fourth wall 84 than the third wall 83 as illustrated in FIG. 13. Both of the first engaged portion 187 and the connecting portion 115 are positioned in the area close to the fourth wall 84 than the third wall 83, and thus it can be said that the connecting portion 115 is poisoned in the vicinity of the first engaged portion 187. Here, the accuracy of the position of the tank 9 with respect to the supporting frame 32 in the Z-axis direction is higher as being close to the first engaged portion 187 in the areas of the tank 9. For this reason, in a case where the connecting portion 115 is positioned in the vicinity of the first engaged portion 187, the accuracy of the position of the connecting portion 115 with respect to the supporting frame 32 in the Z-axis direction is improved. Accordingly, it is likely to suppress a connection failure occurring between the connecting portion 115 and the supply tube 43 caused by the variation of the position of the connecting portion 115 with respect to the supporting frame 32 in the Z-axis direction.

In addition, in the embodiment, the first engaged portion 187 is positioned in the area closer to the fourth wall 84 than the third wall 83 as illustrated in FIG. 13. In addition, the fourth wall 84 includes a viewing portion having the light transmissivity. With this, the first engaged portion 187 is positioned in the vicinity of the fourth wall 84 including the viewing portion, and thus it is likely to improve accuracy of the position of the viewing portion with respect to the supporting frame 32 in the Z-axis direction.

Further, in the embodiment, as illustrated in FIG. 13, the first engaged portion 187 is positioned on the side opposite to the second engaged portion 191 by interposing the first section 181 therebetween. With this, the first engaged portion 187 and the second engaged portion 191 which are positioned on the side opposite to each other by interposing the first section 181 therebetween, and thus the position of the tank 9 with respect to the supporting frame 32 in the Z-axis direction is regulated. As a result, it is likely to improve accuracy of the position of the tank 9 with respect to the supporting frame 32 in the Z-axis direction.

Note that, in the embodiment, a configuration such that the two convex portions 185 are provided in the tank 9, and the two concave portions 223 are provided in the supporting frame 32 may be employed. However, a configuration of the tank 9 and the supporting frame 32 is not limited thereto. As the configuration of the tank 9 and the supporting frame 32, for example, a configuration such that the two convex portions 185 are provided in the supporting frame 32, and the two concave portions 223 are provided in the tank 9 may be employed. Further, as the configuration of the tank 9 and the supporting frame 32, for example, a configuration such that one of the two convex portions 185 and one of the two concave portions 223 are provided in the tank 9, and one of the two convex portions 185 and one of the two concave portions 223 are provided in the supporting frame 32. It is possible to obtain the same effect as in the above-described embodiment with any configuration described above. In addition, the number of the convex portions 185 and the number of the concave portions 223 are not respectively limited to two. The number of the convex portions 185 and the number of the concave portions 223 may be respectively one or three or more.

In addition, in the embodiment, the ink injecting portion 101 is positioned in the area close to the fourth wall 84 than the third wall 83, as illustrated in FIG. 13. Further, at least a portion of the first engaged portion 187 is positioned in an area overlapping the ink injecting portion 101 of the first wall 81 in the Z-axis direction. That is, at least a portion of the first engaged portion 187 overlaps the ink injecting portion 101. With such a configuration, when the cap 143 is detached from the ink injecting portion 101 in the Z-axis direction, it is likely that a force acting on the tank 9 in the Z-axis direction is cancelled by a reaction on the first engaged portion 187 in the −Z-axis direction. With this, when the cap 143 is detached from the ink injecting portion 101, it is likely to prevent the tank 9 from being displaced to the Z-axis direction.

Figure 30:
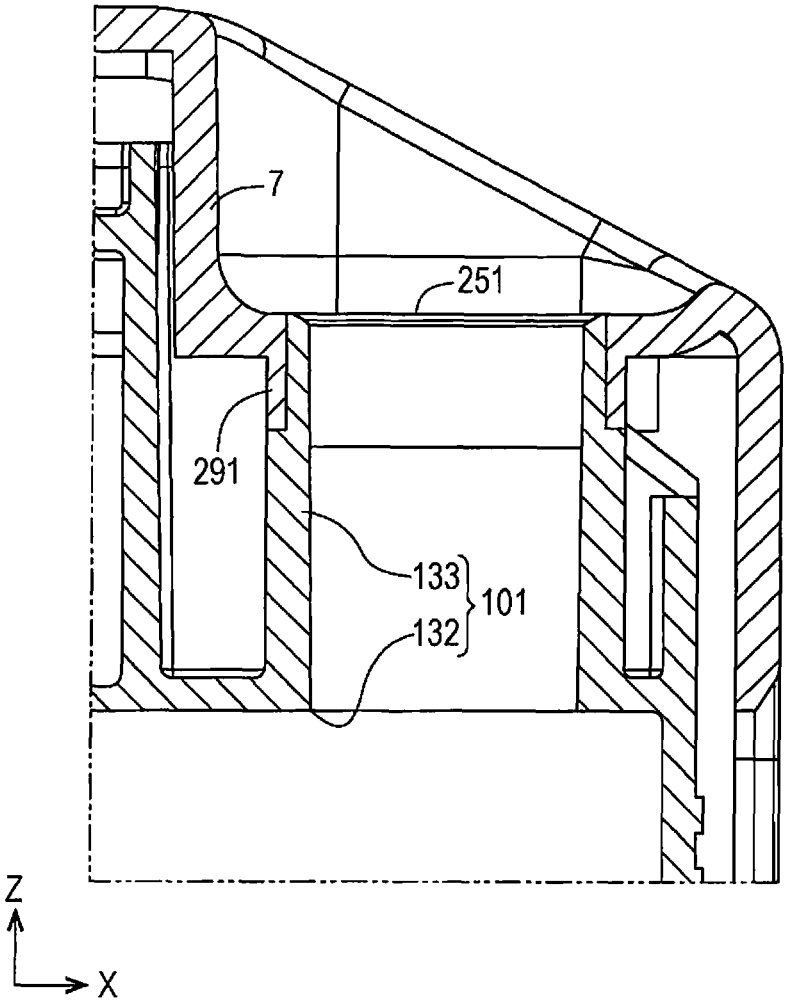
FIG. 30 is a sectional view illustrating another example of the ink injecting portion and the second case in the first embodiment.

Meanwhile, as the configuration such that it is likely to prevent the tank 9 from being displaced in the Z-axis direction when the cap 143 is detached from the ink injecting portion 101, for example, a configuration such that the ink injecting portion 101 is regulated by the opening 251 of the second case 7 in the −Z-axis direction may be employed, as illustrated in FIG. 30. In the configuration as illustrated in FIG. 30, the side wall 133 of the ink injecting portion 101 is regulated by the end portion of the side wall 291 surrounding the opening 251 in the −Z-axis direction. With such a configuration, it is possible to directly regulate the displacement of the ink injecting portion 101 to the Z-axis direction by the second case 7, and thus when the cap 143 is detached from the ink injecting portion 101, it is likely to efficiently prevent the tank 9 from being displaced to the Z-axis direction.

Figure 31:
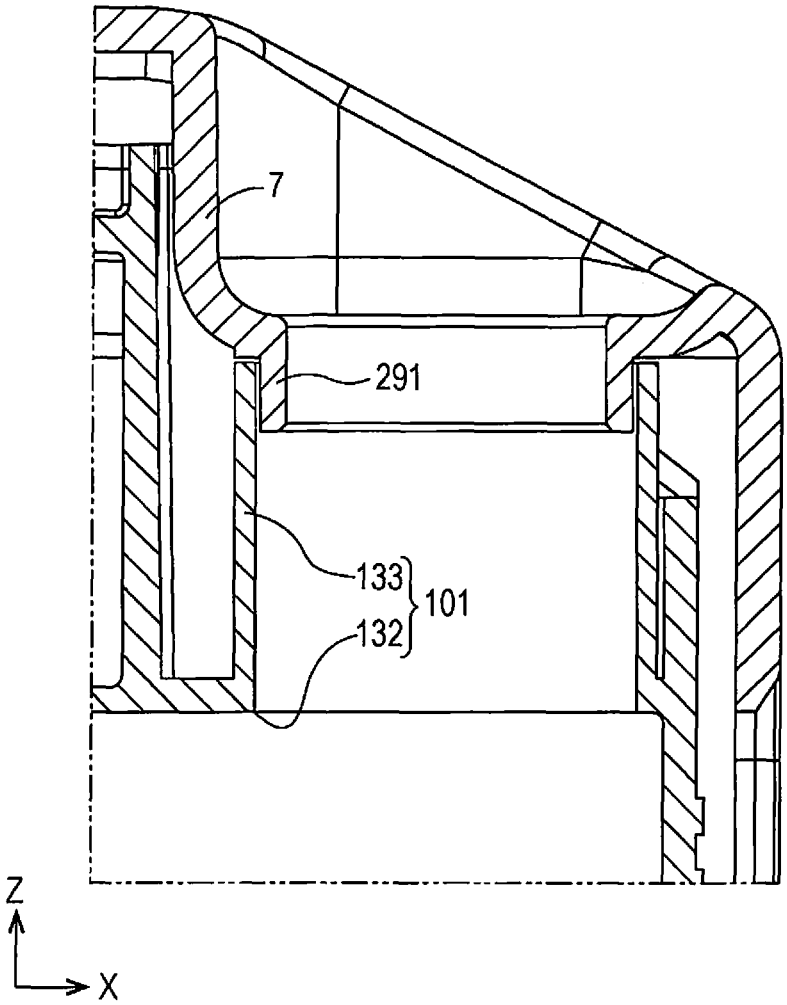
FIG. 31 is a sectional view illustrating another example of the ink injecting portion and the second case in the first embodiment.

In addition, as the configuration such that it is likely to prevent the tank 9 from being displaced in the Z-axis direction when the cap 143 is detached from the ink injecting portion 101, for example, a configuration such that the end portion of the side wall 133 of the ink injecting portion 101 in the Z-axis direction is directly regulated by the second case 7 may be employed, as illustrated in FIG. 31. In the configuration, the side wall 291 is inserted into the second case 7 of the side wall 133. In the example as illustrated in FIG. 31, when the cap 143 is detached from the ink injecting portion 101, it is likely that to efficiently prevent the tank 9 from being displaced to the Z-axis direction.

Figure 32:
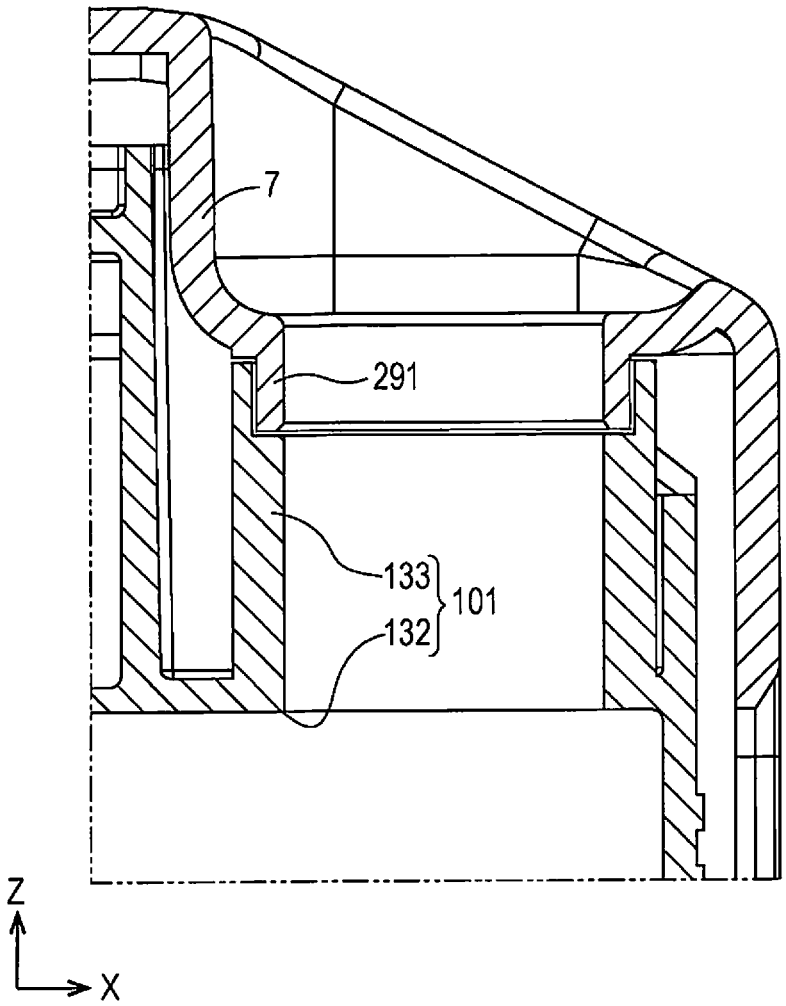
FIG. 32 is a sectional view illustrating another example of the ink injecting portion and the second case in the first embodiment.

Further, when the cap 143 is detached from the ink injecting portion 101, as the configuration such that it is likely to prevent the tank 9 from being displaced to the Z-axis direction, for example, the example which is illustrated in FIG. 32 may be also employed. In the example, in comparison to the example illustrated in FIG. 31, a step between the inner wall of the side wall 133 of the ink injecting portion 101 and the inner wall of the side wall 291 of the second case 7 is decreased. In the example illustrated in FIG. 32, when the cap 143 is detached from the ink injecting portion 101, it is likely to efficiently prevent the tank 9 from being displaced in the Z-axis direction. Further, with such a configuration, in comparison to the example illustrated in FIG. 31, it is likely to avoid that the cap 143 is caught by the second case 7 when the cap 143 is detached from the ink injecting portion 101. For this reason, in the example illustrated in FIG. 32, in comparison to the example illustrated in FIG. 31, the cap 143 is easily detached from the ink injecting portion 101.

Figure 33:
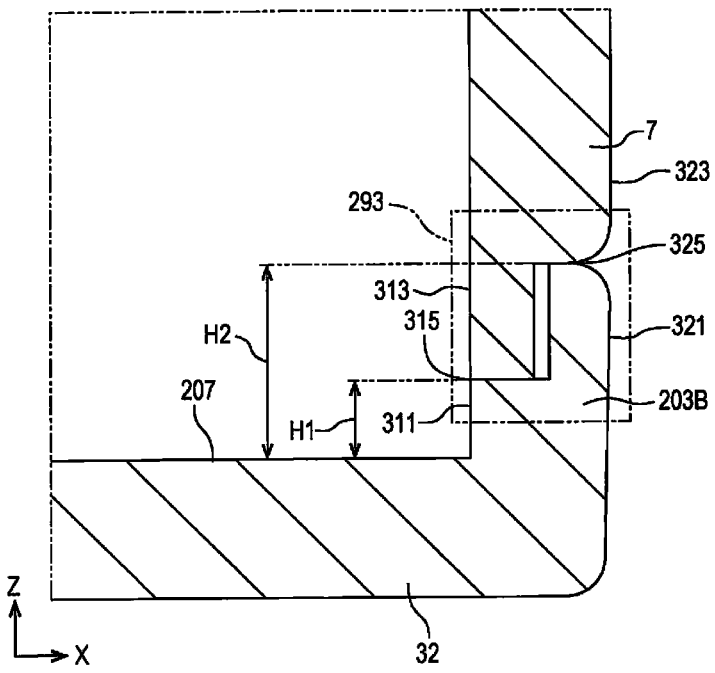
FIG. 33 is an enlarged view of a D part in FIG. 27.

Here, in the embodiment, as illustrated in FIG. 33 which is an enlarged view of a D portion in FIG. 27, in the second case 7 and the supporting frame 32, a portion of the partition wall 203B of the supporting frame 32 and a portion of the second case 7 which faces a portion of the partition wall 203B are fitted into each other. In a fitting portion 293 in which a portion of the partition wall 203B and a portion of the second case 7 are fitted into each other, an inner wall 311 of a portion of the partition wall 203B and an inner wall 313 of a portion of the second case 7 come in contact with each other at a first boundary 315. The inner wall 311 of the portion of the partition wall 203B and the inner wall 313 the portion of the second case 7 form an inside surface of a wall which partitions off a space in which the tank 9 is stored. In addition, in the fitting portion 293 in which a portion of the partition wall 203B and a portion of the second case 7 are fitted into each other, an outer wall 321 of a portion of the partition wall 203B and, an outer wall 323 of a portion of the second case 7 come in contact with each other at a second boundary 325. The outer wall 321 of the portion of the partition wall 203B and the outer wall 323 of the portion of the second case 7 form an outside surface of a wall which partitions off the space in which the tank 9 is stored.

In addition, in the concave portion 207 of the supporting frame 32, a height H1 from the bottom portion of a portion which is adjacent to the fitting portion 293 of the partition wall 203B to the first boundary 315 is lower than a height H2 from the bottom portion to the second boundary 325. In other words, when comparing the height H1 of the first boundary 315 with the height H2 of the second boundary 325, the height H2 of the second boundary 325 is higher than the height H1 of the first boundary 315. For this reason, for example, when the ink which is spilled out from the ink injecting portion 101 is dripped down along the inside surface on which the supporting frame 32 and the second case 7 are fitted into each other, it is likely that the ink which is dripped down along the inside surface reaches into the concave portion 207 by passing through the first boundary 315. This is because that it is difficult for the liquid which is dripped down along the inside surface to go up from the first boundary 315 to the second boundary 325 of which the height position is higher than that of the first boundary 315. With this, it is likely to prevent the liquid, which is spilled out from the ink injecting portion 101 from leaking to the outside of the tank unit 5. As a result, it is likely to suppress dirty due to the liquid.

Figure 34:
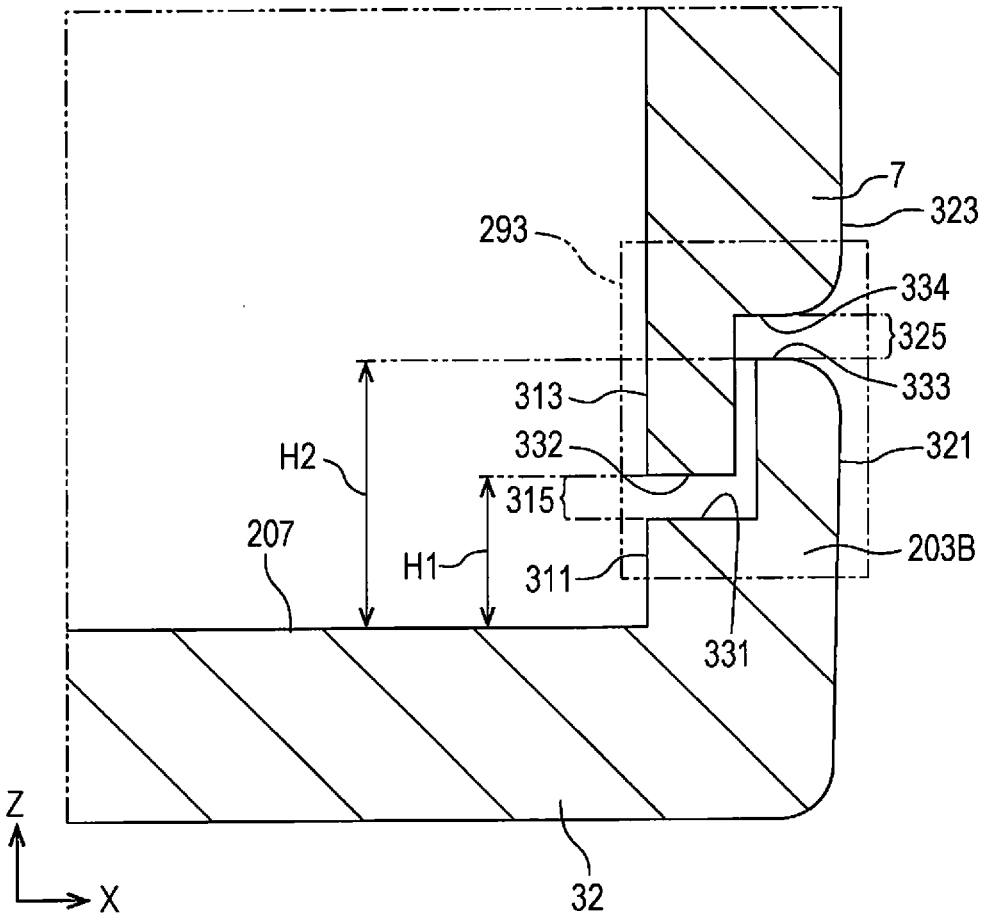
FIG. 34 is a sectional view illustrating another example of the supporting frame and the second case in the first embodiment.

Meanwhile, in the embodiment, when the second case 7 and the supporting frame 32 are fitted into each other, the inner wall 311 of a portion of the partition wall 203B and the inner wall 313 of a portion of the second case 7 come in contact with each other at the first boundary 315. Further, the outer wall 321 of a portion of the partition wall 203B and the outer wall 323 of a portion of the second case 7 come in contact with each other at the second boundary 325. However, a configuration of the second case 7 and the supporting frame 32 is not limited thereto. As the configuration of the second case 7 and the supporting frame 32, for example, as illustrated in FIG. 34, a configuration such that a gap is provided between an end portion 331 of the inner wall 311 of a portion of the partition wall 203B in the Z-axis direction and an end portion 332 of the inner wall 313 of a portion of the second case 7 in the −Z-axis direction may be employed. In addition, a configuration such that a gap is provided between an end portion 333 of the outer wall 321 of a portion of the partition wall 203B in the Z-axis direction and an end portion 334 of the outer wall 323 of a portion of the second case 7 in the −Z-axis direction may also be employed. In this case, an area of the gap between the end portion 331 and the end portion 332 is defined as the first boundary 315. In addition, an area of the gap between the end portion 333 and the end portion 334 is defined as the second boundary 325.

As an example of the configuration of the second case 7 and the supporting frame 32, a configuration such that a gap is provided between the end portion 331 and the end portion 332, and a gap is provided between the end portion 333 and the end portion 334 may be employed. In addition, as another example of the configuration of the second case 7 and the supporting frame 32, a configuration such that a gap is provided between the end portion 331 and the end portion 332, and the end portion 333 and the end portion 334 come in contact with each other may be employed. Further, as still another example of the configuration the second case 7 and the supporting frame 32, a configuration such that the end portion 331 and the end portion 332 come in contact with each other, and a gap is provided between the end portion 333 and the end portion 334 may be employed. In any example described above, as long as the end portion 333 is positioned further from the end portion 332 in the Z-axis direction, it is possible to obtain an effect that the ink is prevented from leaking to the outside of the tank unit 5. Note that, in the first embodiment, the second case 7 corresponds to the lid portion, the supporting frame 32 corresponds to the supporting portion, the Z-axis direction corresponds to the first direction, and the X-axis direction corresponds to the second direction.

Second Embodiment

Figure 35:
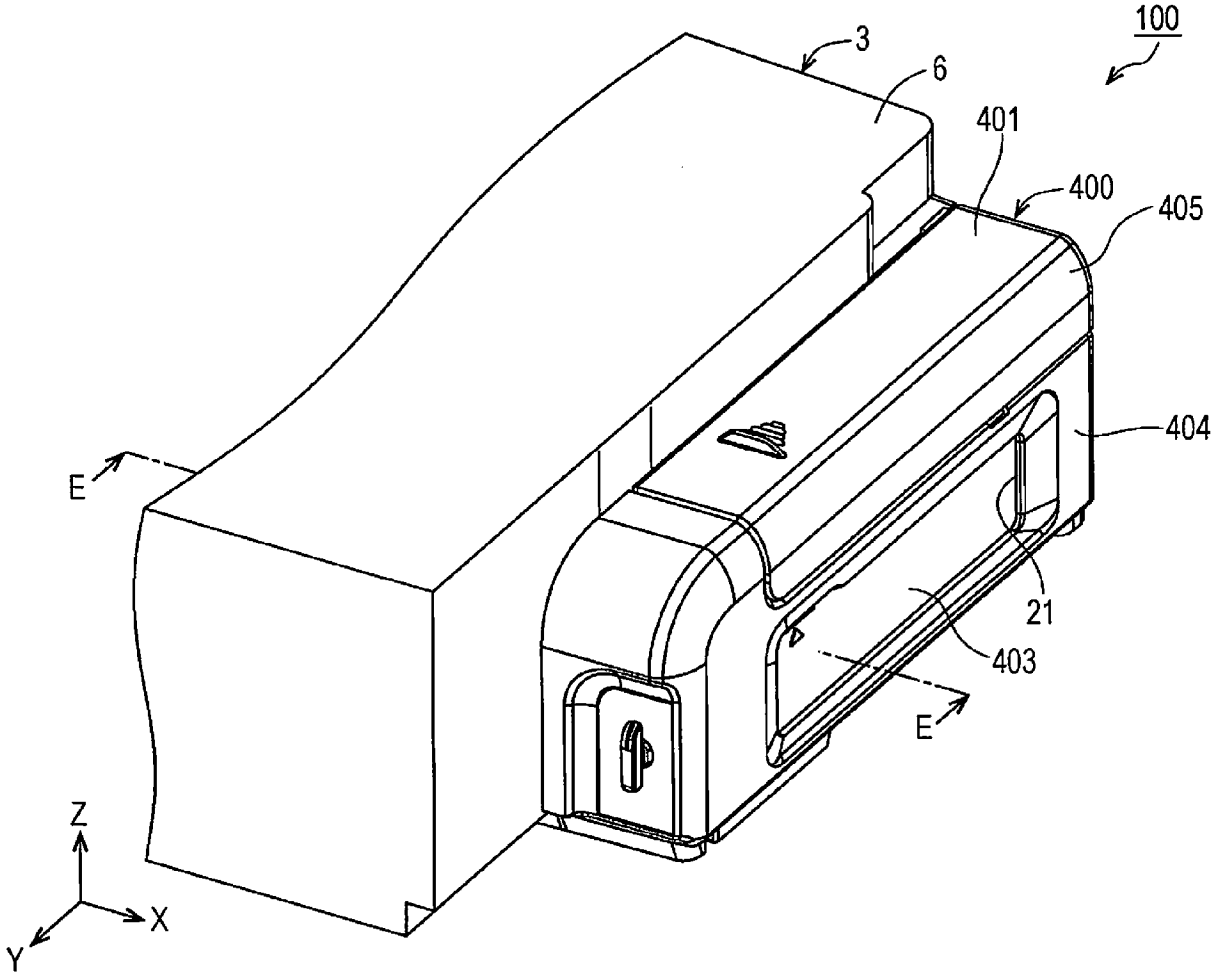
FIG. 35 is a perspective view illustrating a liquid ejecting system in a second embodiment.

In the second embodiment, a liquid ejecting system 100 includes a printer 3 and a tank unit 400, as illustrated in FIG. 35. The tank unit 400 is fixed to the outer periphery of the printer 3. Since the printer 3 has the same configuration as in the first embodiment, the illustration of in the drawing is simplified, and the specific description thereof will be omitted. In the following description, the same components as in the first embodiment are denoted by the same reference numerals as in the first embodiment and the specific description thereof will be omitted. Note that, in FIG. 35, X, Y, and Z axes which are axes of coordinates that cross orthogonally with each other are illustrated. Also in the drawings thereafter, the X, Y, and Z axes are illustrated if necessary. The X, Y, and Z axes In FIG. 35, and the X, Y, and Z axes in the drawings after FIG. 35 are based on the X, Y, and Z axes in FIG. 1.

The tank unit 400 includes a second case 401 and a tank 403. In addition, similar to the first embodiment, the tank unit 400 also includes a supply tube 43 which is not shown. A first case 6 and a second case 401 of the printer 3 forms an outer shell of the liquid ejecting system 100. The second case 401 includes a case main body 404 and a cover 405. The case main body 404 is provided with a window portion 21. An operator can visually recognize the tank 403 via the window portion 21. At least a portion of an area which faces the window portion 21 of the tank 403 has light transmissivity. In the tank 403, at least a portion of the area which faces the window portion 21 can be used as a viewing portion through which the amount of the ink can be visually recognized.

Figure 36:
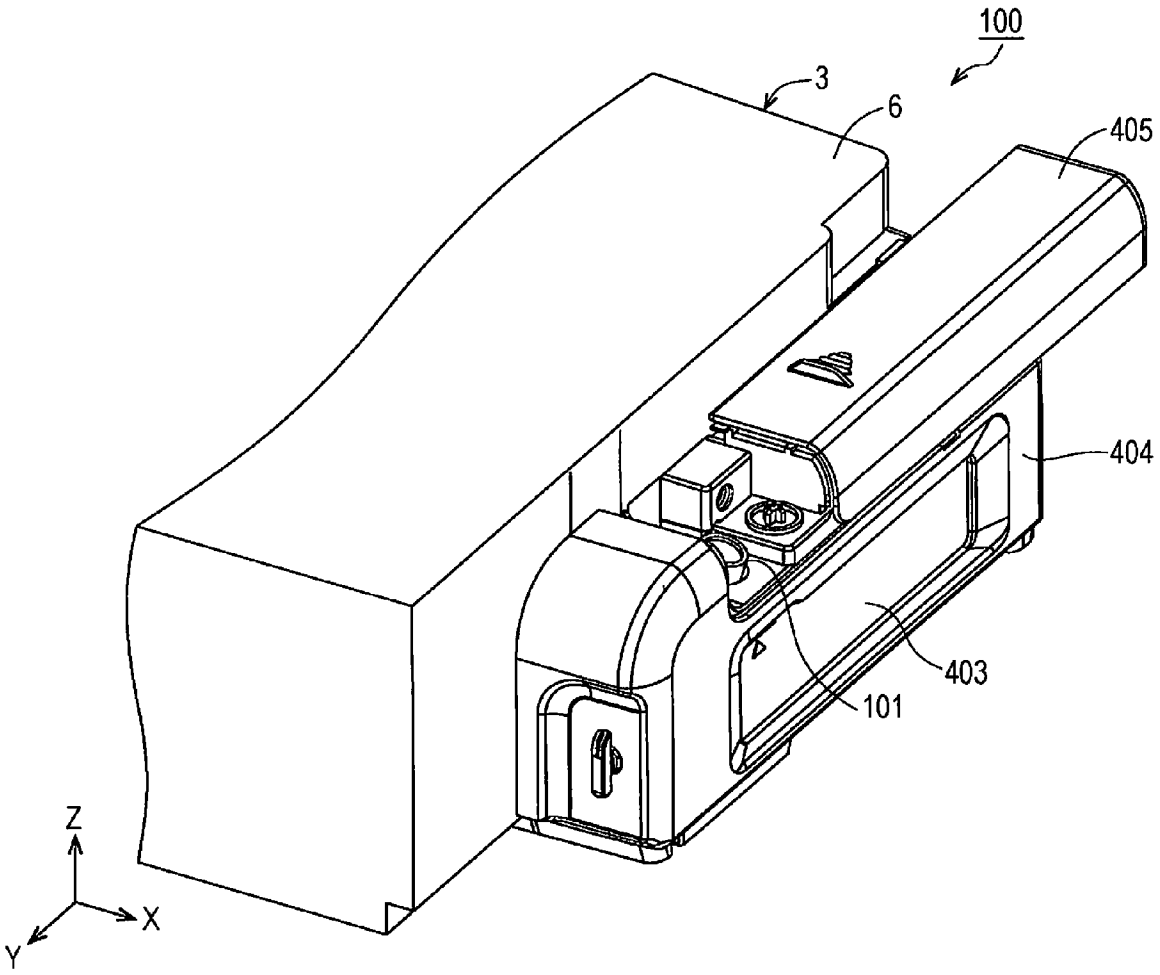
FIG. 36 is a perspective view illustrating the liquid ejecting system in the second embodiment.

The cover 405 is formed to be slidable with respect to the case main body 404 in the Y-axis, as illustrated in FIG. 36. When the cover 405 is made to slide in the −Y-axis direction with respect to the case main body 404 (hereinafter, expressed as that the cover 405 is opened), the ink injecting portion 101 of the tank 403 is exposed. The operator can inject the ink into the tank 403 from the ink injecting portion 101 in a state where the ink injecting portion 101 is exposed by opening the cover 405.

Figure 37:
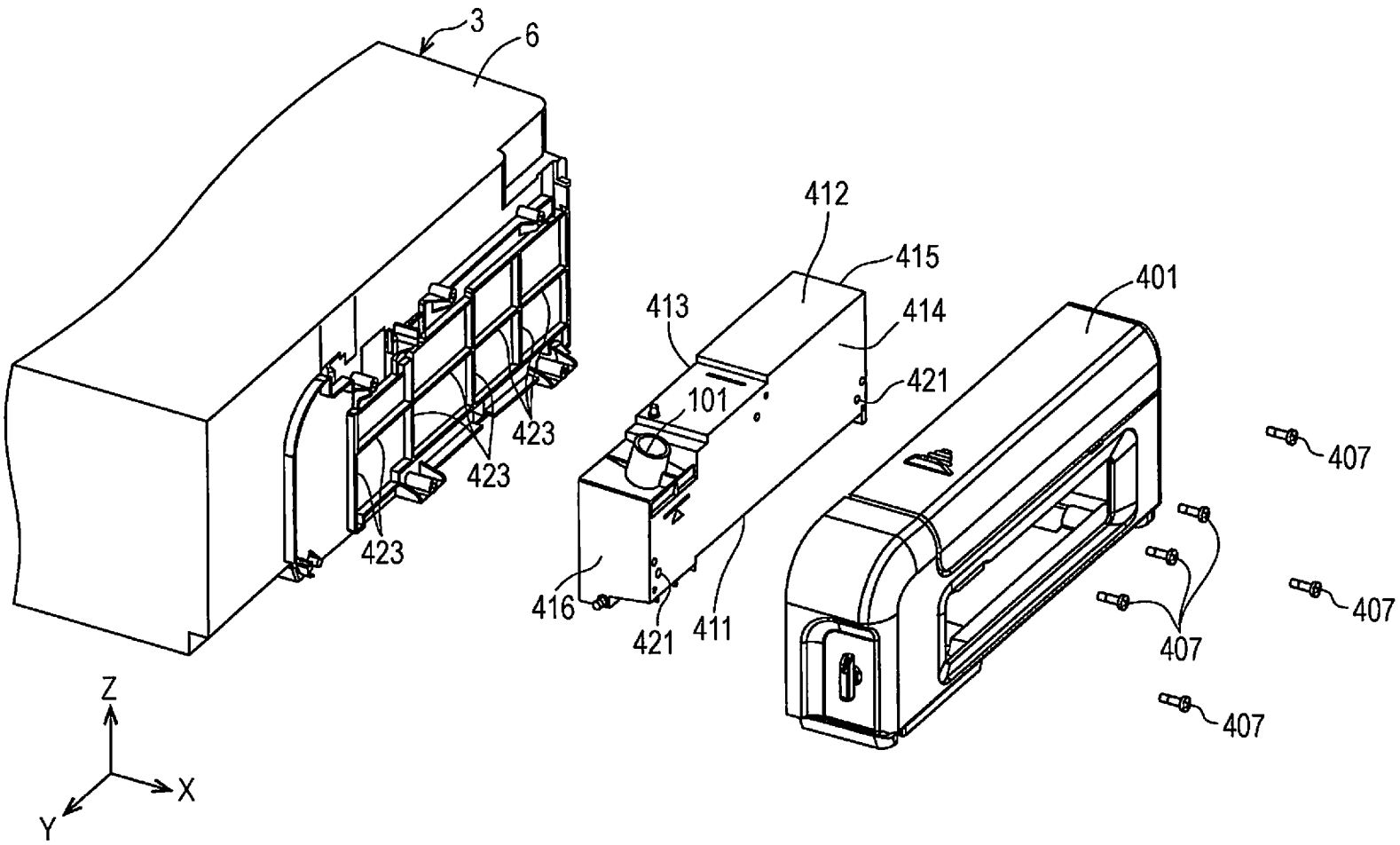
FIG. 37 is an exploded perspective view of a printer, a tank, and a second case in the second embodiment.

The first case 6 and the second case 401 are formed separately from each other. For this reason, in the embodiment, it is possible to separate the second case 401 from the first case 6 as illustrated in FIG. 37. The second case 401 is coupled with the first case 6 by an attaching screw 407. The tank 403 is disposed between the first case 6 and the second case 401. The tank 403 includes a first wall 411 and a second wall 412 which are two walls in a line along the Z-axis. In addition, the tank 403 includes a third wall 413 and a fourth wall 414 which are two walls in a line along the X-axis. In addition, the tank 403 includes a fifth wall 415 and a sixth wall 416 which are which are two walls in a line along the Y-axis.

The first wall 411 and the second wall 412 face each other along the Z-axis. The second wall 412 is positioned further from the first wall 411 in the Z-axis direction. The third wall 413 and the fourth wall 414 face each other along the X-axis. The fourth wall 414 is positioned further from the third wall 413 in the X-axis direction. Each of the third wall 413 and the fourth wall 414 intersects with both of the first wall 411 and the second wall 412. The fifth wall 415 and the sixth wall 416 face each other along the Y-axis. The sixth wall 416 is positioned further from the fifth wall 415 in the Y-axis direction. Each of the fifth wall 415 and the sixth wall 416 intersects both of the first wall 411 and the second wall 412.

Two holes 421 are formed on the fourth wall 414 of the tank 403. The two holes 421 are recessed toward the third wall 413 side from the fourth wall 414. The two holes 421 are fixed in the fourth wall 414. In other words, the two holes 421 do not pass through the fourth wall 414. For this reason, the two holes 421 do not reach the ink storage portion in the tank 403. In addition, in the first case 6 of the printer 3, the contact portion 423 is provided in an area which faces the tank 403. The contact portion 423 is projected to the tank 403 side from the first case 6, and is formed into a rib shape.

Figure 38:
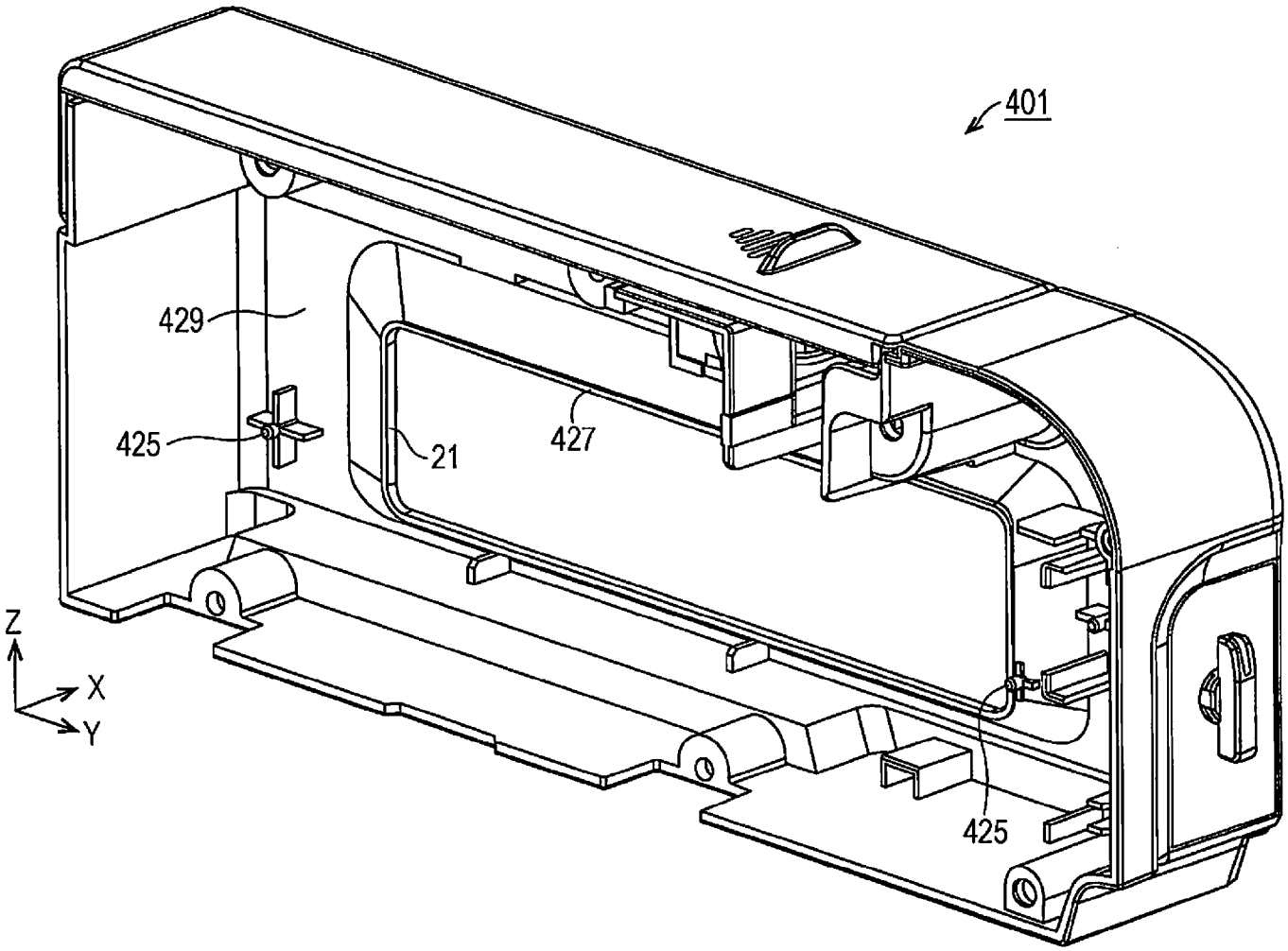
FIG. 38 is a perspective view illustrating the second case in the second embodiment.

The second case 401 is, as illustrated in FIG. 38, provided with two shafts 425 and a projecting portion 427. The projecting portion 427 is formed into a ring shape along a frame of the window portion 21. The projecting portion 427 surrounds the window portion 21. The projecting portion 427 is directed to the tank 403 side further than the inner wall 429 of the second case 401, that is, is projected to the −X-axis direction. Meanwhile, the inner wall 429 is an inner wall which faces the printer 3 side of the inner wall of the second case 401. The two shafts 425 are provided on the inner wall 429, and are directed to the tank 403 side further than the inner wall 429, that is, are projected to the −X-axis direction. The two shafts 425 are positioned on the side opposite to each other by interposing the window portion 21 therebetween. The two shafts 425 are projected to the tank 403 side further than the projecting portion 427.

Figure 39:
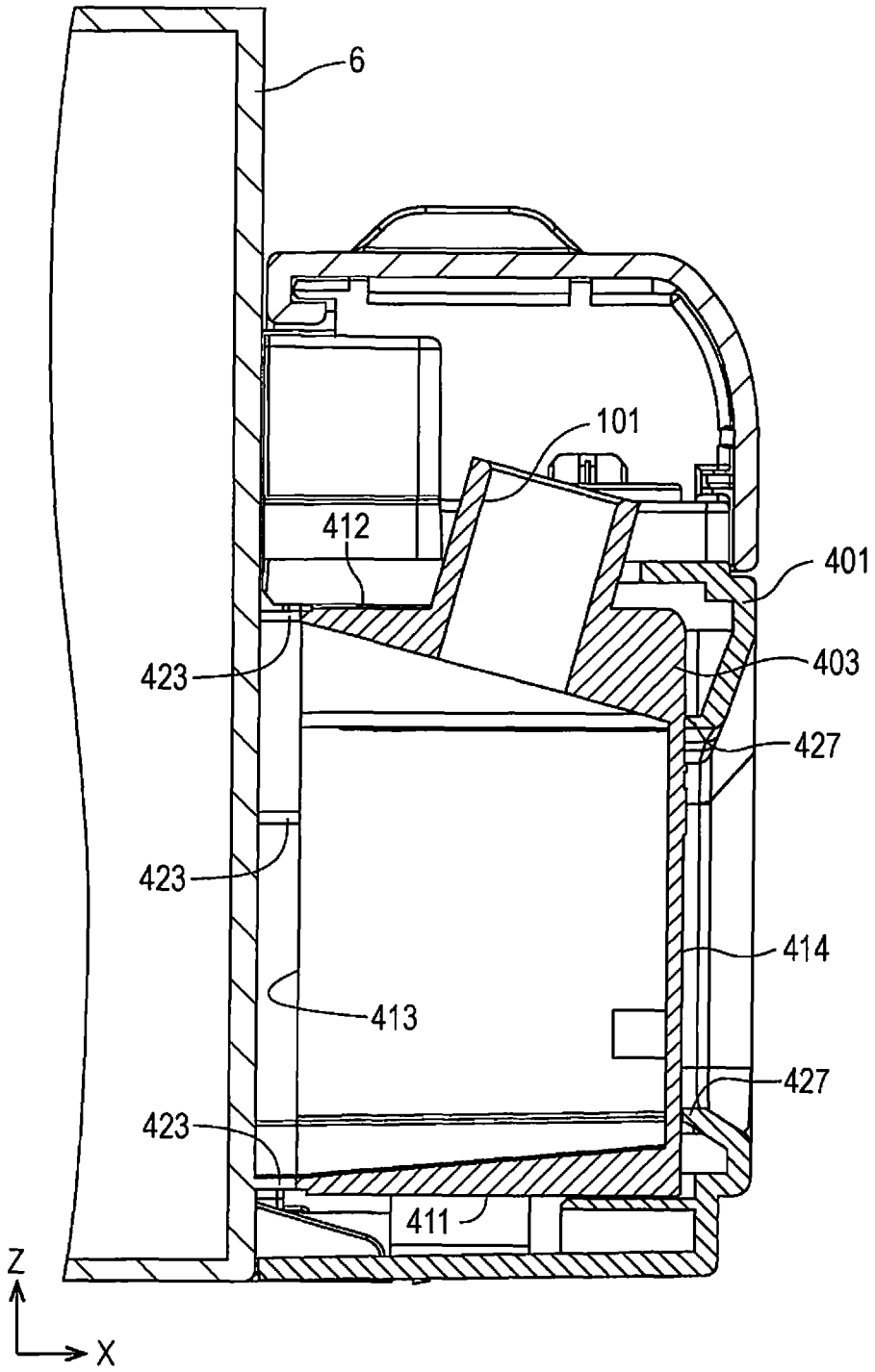
FIG. 39 is a sectional view along E-E line in FIG. 35.

In the liquid ejecting system 100 having the above-described configuration, as illustrated in FIG. 39 which is a sectional view along E-E line in FIG. 35, the tank 403 is held by the first case 6 and the second case 401 along the X-axis. The projecting portion 427 of the second case 401 comes in contact with the fourth wall 414 of the tank 403. With this, the tank 403 is pressed by the second case 401 in the −X-axis direction. On the other hand, the third wall 413 of the tank 403 comes in contact with the contact portion 423 of the first case 6. With this, the tank 403 is held by the projecting portion 427 of the second case 401 and the contact portion 423 of the first case 6. At this time, each of the two holes 421 (FIG. 37) of the tank 403 is inserted into each of the two shafts 425 (FIG. 38) of the second case 401. With this, a position of the tank 403 with respect to the second case 401 is regulated in the rotation direction. Therefore, a position of the tank 403 with respect to the printer 3 is fixed.

According to the embodiment, it is possible to omit a component such as a screw for attaching the tank 403 to the first case 6 or the second case 401, and thus it is likely to reduce the number of components. In addition, since it is possible to omit a component for attaching the tank 403 to the first case 6 or the second case 401, it is possible to reduce labor for fixing the position of the tank 403 with respect to printer 3. In addition, the projecting portion 427 of the second case 401 comes in contact with the fourth wall 414 of the tank 403, and the tank 403 is pressed to the printer 3 side, and thus it is likely to improve the accuracy of the position of the tank 403 with respect to the second case 401 in a direction from the fourth wall 414 from the third wall 413. Note that, in the second embodiment, the second case 401 corresponds to the lid portion, the Z-axis direction corresponds to the first direction, and the X-axis direction corresponds to the second direction.

Third Embodiment

In the above-described embodiments, the plurality of tanks 9 and the tanks 403 are not built in the first case 6 which covers the mechanism unit 10. In other words, in above-described embodiments, a configuration such that the plurality of tanks 9 and the tanks 403 are disposed on the outer side of the first case 6 is employed. However, a configuration such that the plurality of tanks 9 and the tanks 403 are built in the first case 6 may be also employed. Herein below, in regards to the configuration such that the plurality of tanks 9 and the tanks 403 are built in the case, a multifunction machine which is an example of the liquid ejecting system will be described as an example of the third embodiment.

Figure 40:
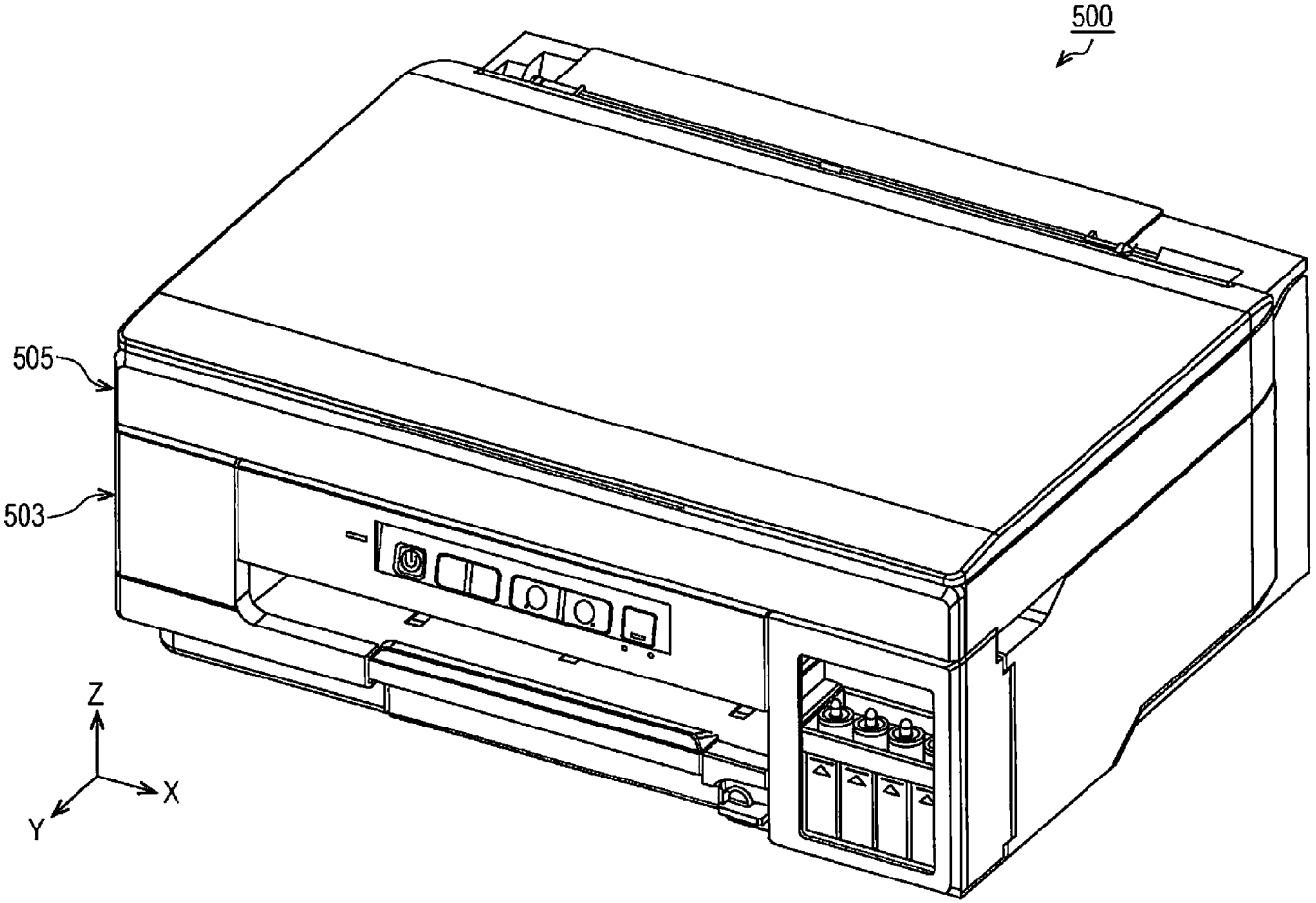
FIG. 40 is a perspective view illustrating a multifunction machine in a third embodiment.

In the embodiment, a multifunction machine 500 includes, as illustrated in FIG. 40, a printer 503 and a scanner unit 505. In the multifunction machine 500, the printer 503 and the scanner unit 505 are overlapped with each other. The scanner unit 505 is positioned perpendicularly upward the printer 503 in a state of using printer 503. Note that, FIG. 40 shows X, Y, and Z axes which are axes of coordinates and are orthogonal to each other. Also in the drawings thereafter, the X, Y, and Z axes are illustrated if necessary. The X, Y, and Z axes In FIG. 40, and the X, Y, and Z axes in the drawings after FIG. 40 are based on the X, Y, and Z axes in FIG. 1. In addition, in the multifunction machine 500, the same components as in the liquid ejecting system 1 and the liquid ejecting system 100 are denoted by the same reference numerals as in the liquid ejecting system 1 and the liquid ejecting system 100, and the specific description thereof will be omitted.

Figure 41:
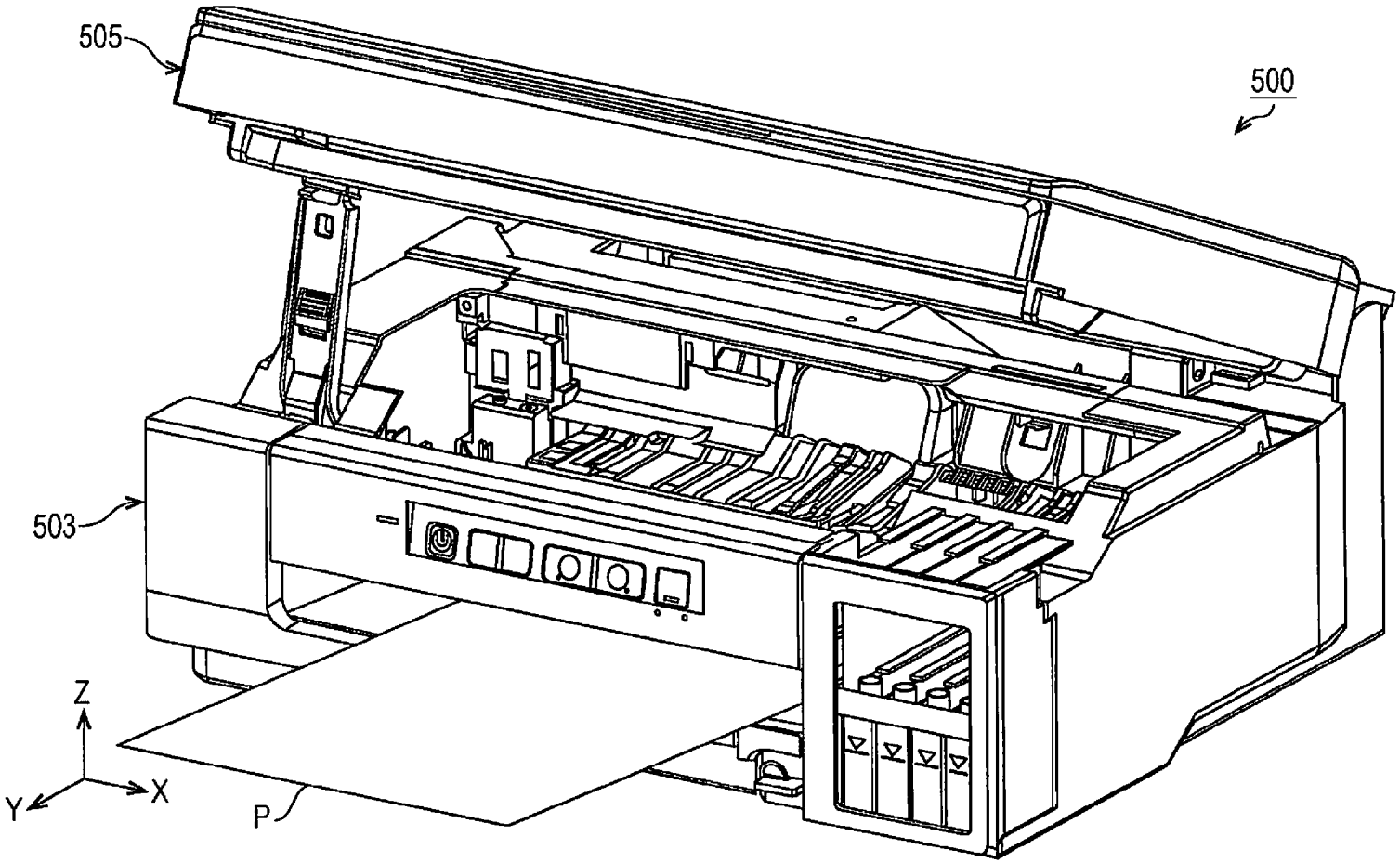
FIG. 41 is a perspective view illustrating a multifunction machine in the third embodiment.

The scanner unit 505 is a flat bed type, and includes such an imaging element (not shown) as an image sensor, an original platen, and a lid. The scanner unit 505 can read an image or the like, which is recorded on a medium such as a sheet, as image data via the imaging element. For this reason, the scanner unit 505 serves as a reading device for reading an image or the like. The scanner unit 505 is formed to be slidable with respect to the case 507 of the printer 503, as illustrated in FIG. 41. In addition, a surface on the printer 503 side of the original platen of the scanner unit 505 serves as the lid of the printer 503 by covering the case 507 of the printer 503.

Figure 42:
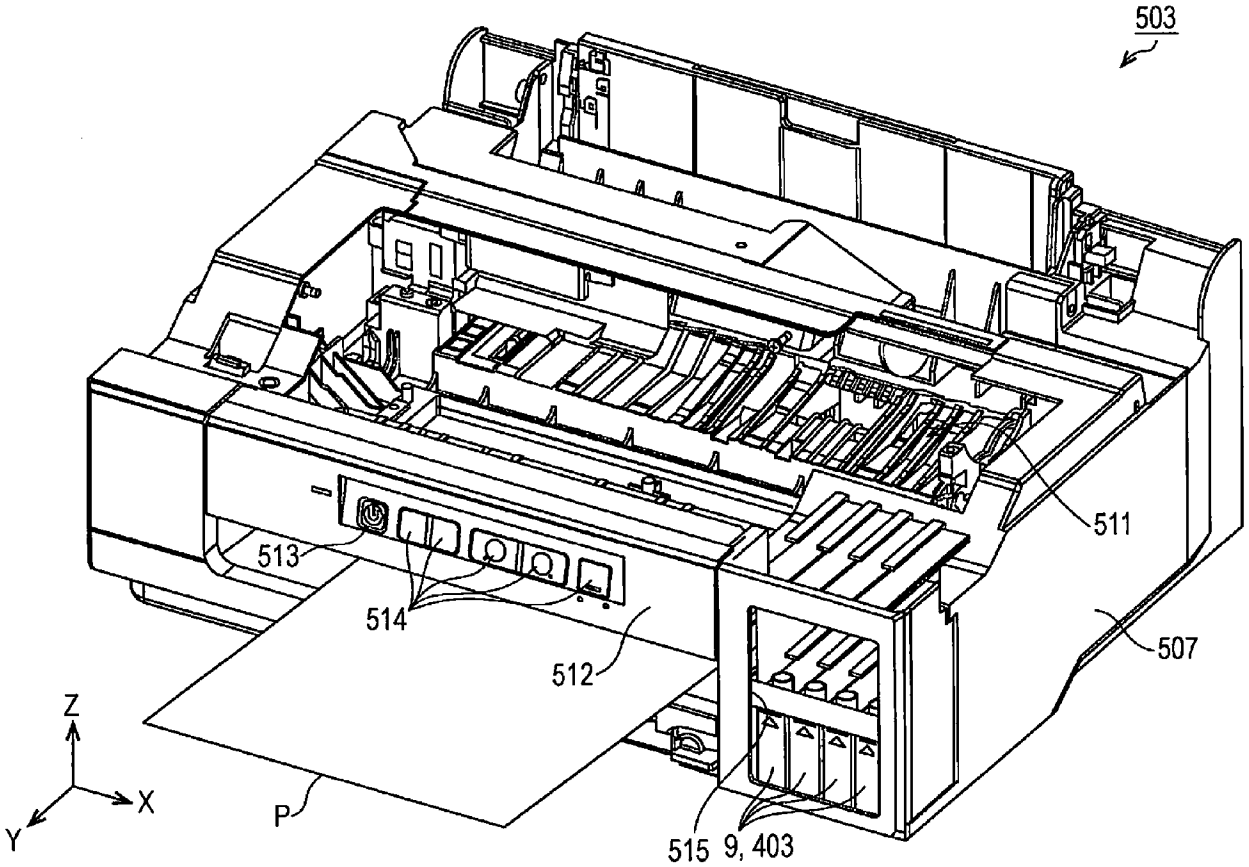
FIG. 42 is a perspective view illustrating the printer in the third embodiment.

The printer 503 can performed the printing on a printing medium P such as a printing sheet by ink which is an example of a liquid. The printer 503 includes a case 507, the plurality of tanks 9 (the tanks 403) which are an example of a liquid container, as illustrated in FIG. 42. The case 507 is a component which is integrally formed and forms an outer shell of the printer 503, and stores the mechanism unit 511 of the printer 503. The plurality of tanks 9 (the tank 403) are stored in the case 507, and each of the plurality of tanks 9 stores the ink which is used for printing. Four tanks 9 (the tanks 403) are provided in the printer 503. The types of ink for four tanks 9 (the tanks 403) are different from each other. In the printer 503, as the type of ink, four types of black ink, yellow ink, magenta ink, and cyan ink are employed. In addition, four tanks 9 (the tanks 403) of which the ink types are different from each other are provided one by one.

In addition, the printer 503 includes a control panel 512. The control panel 512 is provided with a power button 513, and other control buttons 514. An operator which operates the printer 503 can operate the power button 513 and the control buttons 514 while facing the control panel 512. In the printer 503, a surface on which the control panel 512 is provided is set to a front surface. In the front surface of the printer 503, the window portion 515 is provided in the case 507. The window portion 515 includes light transmissivity. In addition, the above-described four tanks 9 (the tank 403) are provided in a position which overlaps with the window portion 515. For this reason, the operator can visually recognize the four tanks 9 (the tanks 403) via the window portion 515.

In the printer 503, an area facing the window portion 515 of each of the tanks 9 (the tanks 403) has the light transmissivity. It is possible to visually recognize the ink in the tank 9 (the tank 403) from the area having the light transmissivity in each of the tanks 9 (the tanks 403). Therefore, the operator can visually recognize the four tanks 9 (the tanks 403) via the window portion 515, and thus it is possible to visually recognize the amount of the ink in the tank 9 (the tank 403). In the printer 503, since the window portion 515 is provided on the front surface of the printer 503, the operator can visually recognize each of the tanks 9 (the tanks 403) from the window portion 515 while facing the control panel 512. For this reason, the operator can grasp the remaining amount of ink in each of the tanks 9 (the tanks 403) while operating the printer 503.

Figure 43:
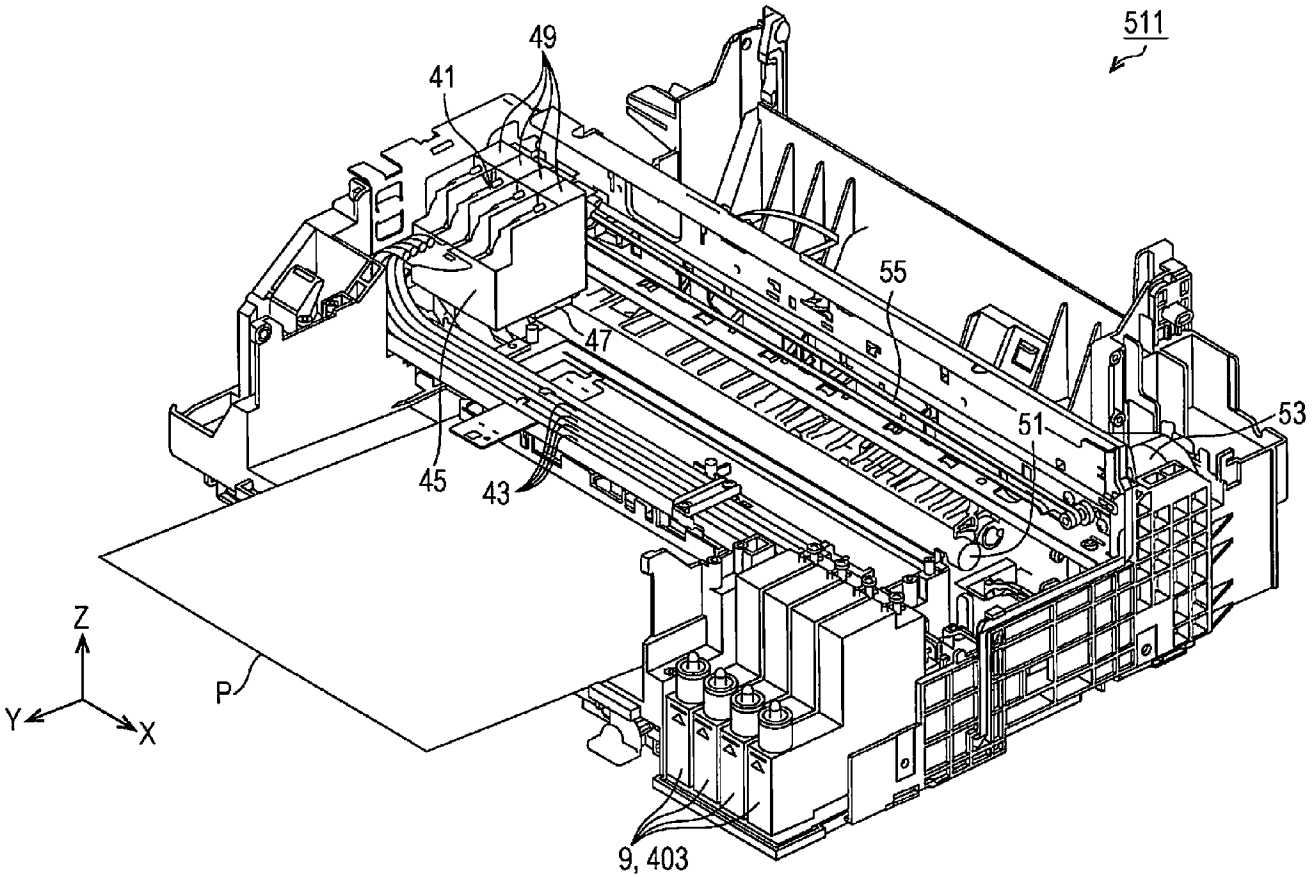
FIG. 43 is a perspective view illustrating a mechanism unit of the printer in the third embodiment.

The printer 503 includes a printing unit 41 and a supply tube 43, as illustrated in FIG. 43 which is a perspective view illustrating the mechanism unit 511. The printing unit 41 and the supply tube 43 have the same configurations as the printing unit 41 and the supply tube 43 in each of the liquid ejecting system 1 and the liquid ejecting system 100. Also in the printer 503, similar to the liquid ejecting system 1 and the liquid ejecting system 100, the medium transport mechanism drives the transport roller 51 by using a driving force from a motor (not shown), and thus the printing medium P is transported along the Y-axis direction. In addition, in the printer 503, similar to the liquid ejecting system 1 and the liquid ejecting system 100, the head transport mechanism transfers the driving force from the motor 53 to the carriage 45 via the timing belt 55, and thus the carriage 45 is transported along the X-axis direction. The print head 47 is mounted on the carriage 45. For this reason, the print head 47 can be transported in the X-axis direction by the head transport mechanism via the carriage 45. With the medium transport mechanism and the head transport mechanism, the printing is performed on the printing medium P by discharging the ink from the print head 47 while changing a relative position of the print head 47 with respect to the printing medium P.

In the above embodiments, a liquid ejecting apparatus may be a liquid ejecting apparatus which consumes other liquids in addition to the ink by ejecting, discharging, or coating. Note that, the liquid having a very small amount of droplets which is ejected from the liquid ejecting apparatus leaves a trail of a grain shape, a tear shape, and a thread shape. In addition, the liquid described here is preferably a material which is capable of being consumed in the liquid ejecting apparatus. For example, the material may be one in a state of being a liquid phase, and the material includes a high or low viscosity liquid such as sol, gel water, and a fluid-like material such as an inorganic solvent, an organic solvent, a solution, a liquid resin, a liquid metal (metal melt). In addition, as a state of material, not only the liquid, but also a material which is obtained by dissolving, dispersing, or mixing particles of a functional material which is formed of a solid material such as a pigment or a metallic particle in a solvent may be included. Examples of a representative example of the liquid include a liquid crystal other than the ink as described-above embodiments. Here, the ink is intended to include various liquid compositions such as a typical water-based ink, an oil-based ink, a gel ink, and a hot melt ink. As a specific example of the liquid ejecting apparatus, for example, a liquid ejecting apparatus for ejecting a liquid which includes materials, such as an electrode material or a color material in a form of being dispersed or dissolved, used for manufacturing a liquid crystal display, an electroluminescence (EL) display, a surface light emission display, or a color filter. In addition, the specific example may include a liquid ejecting apparatus for ejecting biological organic material which is used for manufacturing biochips, a liquid ejecting apparatus for ejecting a liquid which serves as a specimen used as a precision pipette, a textile printing apparatus, or a micro dispenser. Further, the specific example may include a liquid ejecting apparatus for ejecting a lubricating oil at a pin point to a precision machine such as a watch or a camera, and a liquid ejecting apparatus for ejecting a transparent resin liquid such as an ultraviolet cured resin on a substrate in order to form a micro hemispherical lens (optical lens) used for an optical communication element. In addition, a liquid ejecting apparatus for ejecting an etchant such as acid or alkali for etching a substrate or the like may be included.

REFERENCE SIGNS LIST

1, 100: LIQUID EJECTING SYSTEM
3: PRINTER
5: TANK UNIT
6: FIRST CASE
7: SECOND CASE
9: TANK
10: MECHANISM UNIT
11: PAPER DISCHARGE PORTION
13: FRONT SURFACE
15: FRONT SURFACE
17: CONTROL PANEL
18A: POWER BUTTON
18B: CONTROL BUTTON
19: SIDE PORTION
21: WINDOW PORTION
23: FRONT SURFACE
25: FRONT SURFACE
27: SIDE PORTION
28: UPPER LIMIT MARK
29: LOWER LIMIT MARK
31: ATTACHING SCREW
32: SUPPORTING FRAME
33: ATTACHING SCREW
41: PRINTING UNIT
43: SUPPLY TUBE
45: CARRIAGE
47: PRINT HEAD
49: RELAY UNIT
51: TRANSPORT ROLLER
53: MOTOR
55: TIMING BELT
61: CASE
63: SHEET MEMBER
64: BONDING PORTION
65: STORAGE PORTION
67: COMMUNICATION PORTION
68: ATMOSPHERE CHAMBER
73: COMMUNICATION PATH
80: BASE WALL
81: FIRST WALL
82: SECOND WALL
83: THIRD WALL
84: FOURTH WALL
85: FIFTH WALL
86: SIXTH WALL
87: SEVENTH WALL
91: CONCAVE PORTION
99: CONCAVE PORTION
101: INK INJECTING PORTION
105: EXTENDING PORTION
105A, 105B, 105C, 105D: AREA
108: GROOVE
109: CONCAVE PORTION
111: EIGHTH WALL
112: NINTH WALL
113: TENTH WALL
115: CONNECTING PORTION
116: SUPPLY PORT
118: AIR COMMUNICATING PORT
121, 122: COMMUNICATION PORT
131: CONCAVE PORTION
132: OPENING
133: SIDE WALL
141: INK
143: CAP
151: FIRST COMMUNICATION PATH
152: SECOND COMMUNICATION PATH
153: THIRD COMMUNICATION PATH
154: FOURTH COMMUNICATION PATH
155: FIFTH COMMUNICATION PATH
156: SIXTH COMMUNICATION PATH
161: INVERTING PORTION
162: BENDING PORTION
163: BENDING PORTION
164: BENDING PORTION
165: INVERTING PORTION
166: BENDING PORTION
181: FIRST SECTION
182: SECOND SECTION
183: SUPPORTED PORTION
185, 185A 185B: CONVEX PORTION
187: FIRST ENGAGED PORTION
189: OPENING
191: SECOND ENGAGED PORTION
193: RIB
201: BASE PORTION
203, 203A, 203B: PARTITION WALL
204, 204A, 204B, 204C, 204D, 204E: PARTITION WALL
205, 205A, 205B, 205C, 205D: TANK DISPOSITION AREA
207: CONCAVE PORTION
221: MOUNT PORTION
223: CONCAVE PORTION
225: FIRST ENGAGING PORTION
227: SECOND ENGAGING PORTION
229, 229A, 229B: MOUNT WALL
231: BENDING PORTION
233: BENDING PORTION
235: OPENING
237: SECOND PARTITION WALL
251: OPENING

253: CONCAVE PORTION
261: FIRST WALL
262: SECOND WALL
263: THIRD WALL
264: FOURTH WALL
281: PROJECTING PORTION
283: RIB
285: ENDMOST PORTION
286: BOTTOM PORTION
287: ENDMOST PORTION
291: SIDE WALL
293: FITTING PORTION
311: INNER WALL
313: INNER WALL
315: FIRST BOUNDARY
321: OUTER WALL
323: OUTER WALL
325: SECOND BOUNDARY
331: END PORTION
332: END PORTION
333: END PORTION
334: END PORTION
400: TANK UNIT
401: SECOND CASE
403: TANK
405: COVER
407: ATTACHING SCREW
411: FIRST WALL
412: SECOND WALL
413: THIRD WALL
414: FOURTH WALL
415: FIFTH WALL
416: SIXTH WALL
421: HOLE
423: CONTACT PORTION
425: SHAFT
427: PROJECTING PORTION
441: PLUMBING AREA
443: REGULATING PORTION
445: FIRST SECTION
447: SECOND SECTION
449: BENDING PORTION
500: MULTIFUNCTION MACHINE
503: PRINTER
505: SCANNER UNIT
507: CASE
511; MECHANISM UNIT
512: CONTROL PANEL
513: POWER BUTTON
514: CONTROL BUTTON
515: WINDOW PORTION
P: PRINTING MEDIUM

The invention claimed is:

1. A liquid container which is mountable on a mount portion in a state of being engaged into a first engaging portion with respect to a supporting portion including the first engaging portion and the mount portion, the liquid container comprising:

a first wall portion including a first section which is mountable on the mount portion;

a second wall portion facing the first wall portion;

a third wall portion intersecting with the first wall portion and the second wall portion;

a fourth wall portion which faces the third wall portion, and intersects with the first wall portion and the second wall portion;

a first engaged portion which is capable of being engaged into the first engaging portion; and a liquid injecting portion which is projected to the side opposite to the first wall portion side from the second wall portion, and is capable of being blocked by a plug member, wherein when a direction from the first wall portion to the second wall portion is defined as a first direction, the first engaged portion is projected to the side opposite to the second wall portion side from the first wall portion, and is capable of coming in contact with the first engaging portion in the first direction, and at least a portion of the first engaged portion overlaps the liquid injecting portion in the first direction.

2. The liquid container according to claim 1, further comprising:

a second engaged portion which is capable of coming in contact with a second engaging portion that the supporting portion includes in the first direction, wherein the first engaged portion is positioned in an area closer to the fourth wall portion than the third wall portion, and the second engaged portion is positioned in an area closer to the third wall portion than the fourth wall portion.

3. The liquid container according to claim 1, further comprising:

a connecting portion which is connectable to a tube in a direction opposite to the first direction from the first wall portion, wherein the first engaged portion is positioned in an area closer to the fourth wall portion than the third wall portion, and the connecting portion is positioned in an area closer to the fourth wall portion than the third wall portion.

4. The liquid container according to claim 1, wherein the first engaged portion includes a ring-shaped frame, and when a direction from the third wall portion to the fourth wall portion is defined as a second direction, at least a portion of the first engaging portion extends to the second direction, and is insertable into the frame.

5. The liquid container which is capable of being further engaged with a second engaging portion that the supporting portion includes, according to claim 1, wherein the second engaging portion has a hook shape, the second engaged portion is a projecting portion which is projected from the third wall portion to the side opposite to the fourth wall portion side from the third wall portion, and wherein the projecting portion is configured to be engaged with the hook shape of the second engaging portion.

6. The liquid container according to claim 1, wherein the first engaged portion is positioned in an area closer to the fourth wall portion than the third wall portion, and the fourth wall portion includes an area having light transmissivity.

7. A liquid container which is mountable on a mount portion in a state of being engaged into a first engaging portion with respect to a supporting portion including the first engaging portion and the mount portion, the liquid container comprising:

a first wall portion including a first section which is mountable on the mount portion;

a second wall portion facing the first wall portion;

a third wall portion intersecting with the first wall portion and the second wall portion;

a fourth wall portion which faces the third wall portion, and intersects with the first wall portion and the second wall portion;

a first engaged portion which is capable of being engaged into the first engaging portion;

a liquid injecting portion which is projected to the side opposite to the first wall portion side from the second wall portion and is capable of being blocked by a plug member; and a second engaged portion which is capable of coming in contact with a second engaging portion that the supporting portion includes in the first direction, wherein when a direction from the first wall portion to the second wall portion is defined as a first direction, the first engaged portion is projected to the side opposite to the second wall portion side from the first wall portion, and is capable of coming in contact with the first engaging portion in the first direction, the liquid injecting portion is positioned in an area closer to the fourth wall portion than the third wall portion, the second engaged portion is positioned in an area closer to the third wall portion than the fourth wall portion, and at least a portion of the first engaged portion is positioned in an area which overlaps the liquid injecting portion of the first wall portion in the first direction, or is positioned between the area overlapping the liquid injecting portion and the fourth wall portion.

8. A liquid container which is mountable on a mount portion in a state of being engaged into a first engaging portion with respect to a supporting portion including the first engaging portion and the mount portion, the liquid container further comprising:

a first engaged portion which is projected to a direction opposite to a first direction from a second section of the first wall portion when a direction in which the mount portion faces a first section is defined as a first direction in a state where the first section of a first wall portion in the liquid container is mounted on the mount portion; and a liquid injecting portion which is projected to the side opposite to the first wall portion side from the second wall portion, and is capable of being blocked by a plug member, wherein the first engaged portion is capable of being engaged with the first engaging portion in the first direction, and at least a portion of the first engaged portion overlaps the liquid injecting portion in the first direction.

9. The liquid container according to claim 8, wherein the plug member is attachable to and detachable from the liquid injecting portion in the first direction and the direction opposite to the first direction.

10. The liquid container which is capable of being further engaged with a second engaging portion that the supporting portion includes, according to claim 8, further comprising:

a second engaged portion which is capable of coming in contact with the second engaging portion in the first direction, wherein the first engaged portion is positioned on the side opposite to the second engaged portion by interposing the first section therebetween in a state where the liquid container is mounted on the mount portion.

11. A liquid container unit comprising:

a supporting portion including a first engaging portion and a mount portion;

a liquid container which is mountable on the mount portion in a state of being engaged with the first engaging portion; and a lid portion which is fitted into the supporting portion, wherein the liquid container includes a first wall portion including a first section which is mountable on the mount portion, a second wall portion facing the first wall portion, a third wall portion intersecting with the first wall portion and the second wall portion, a fourth wall portion which faces the third wall portion, and intersects with the first wall portion and the second wall portion, and a first engaged portion which is capable of being engaged into the first engaging portion, when a direction from the first wall portion to the second wall portion is defined as a first direction, the first engaged portion is projected to the side opposite to the second wall portion side from the first wall portion, and is capable of coming in contact with the first engaging portion in the first direction, the liquid container is positioned between the supporting portion and the lid portion, the liquid container includes a liquid injecting portion which is capable of being blocked by a plug member, the liquid injecting portion which is projected to the side opposite to the mount portion side from the liquid container is provided, the lid portion includes an opening and at least a portion of the liquid injecting portion is positioned in the opening.

12. A liquid ejecting system comprising:

the liquid container unit according to claim 11;

a liquid ejecting apparatus which is provided with a liquid ejecting head; and a tube which is capable of supplying a liquid to the liquid ejecting head from the liquid container of the liquid container unit, wherein the liquid container unit is fixed to an outer periphery of the liquid ejecting apparatus.

13. A liquid ejecting apparatus comprising:

a supporting portion which includes a first engaging portion and a mount portion;

a lid portion which is fitted into the supporting portion;

a liquid ejecting head which is disposed between the lid portion and the supporting portion, and is capable of ejecting a liquid;

a liquid container which is mountable on the mount portion of the supporting portion in a state of being engaged with the first engaging portion, and is positioned between the supporting portion and the lid portion;

a tube which is positioned between the lid portion and the supporting portion, and is capable of supplying a liquid to the liquid ejecting head from the liquid container; and a liquid injecting portion which is projected to the side opposite to the first wall portion side from the second wall portion, and is capable of being blocked by a plug member, wherein the liquid container includes a first wall portion including a first section which is mountable on the mount portion, a second wall portion facing the first wall portion, a third wall portion intersecting with the first wall portion and the second wall portion, a fourth wall portion which faces the third wall portion, and intersects with the first wall portion and the second wall portion, and a first engaged portion which is capable of being engaged into the first engaging portion, when a direction from the first wall portion to the second wall portion is defined as a first direction, the first engaged portion is projected to the side opposite to the second wall portion side from the first wall portion, and is capable of coming in contact with the first engaging portion in the first direction, and at least a portion of the first engaged portion overlaps the liquid injecting portion in the first direction.

* * * * *